US012133590B1

(12) United States Patent
Gonzalez

(10) Patent No.: US 12,133,590 B1
(45) Date of Patent: Nov. 5, 2024

(54) FLUID DISPENSER

(71) Applicant: Mario Gonzalez, Denver, CO (US)

(72) Inventor: Mario Gonzalez, Denver, CO (US)

( * ) Notice: Subject to any disclaimer, the term of this patent is extended or adjusted under 35 U.S.C. 154(b) by 0 days.

(21) Appl. No.: 18/649,788

(22) Filed: Apr. 29, 2024

Related U.S. Application Data

(60) Provisional application No. 63/463,458, filed on May 2, 2023.

(51) Int. Cl.
*A46B 11/00* (2006.01)
*A46B 5/00* (2006.01)

(52) U.S. Cl.
CPC ..... *A46B 11/0041* (2013.01); *A46B 5/0095* (2013.01); *A46B 11/0024* (2013.01); *A46B 11/0055* (2013.01); *A46B 11/0065* (2013.01); *A46B 11/0089* (2013.01)

(58) Field of Classification Search
CPC ..... A46B 11/0024; A46B 11/0041; A46B 11/0065
USPC ..... 401/184, 186, 270, 277
See application file for complete search history.

(56) References Cited

U.S. PATENT DOCUMENTS 7,513,707 B2 * 4/2009 Eggleden ..... A45D 27/04 401/153
8,262,390 B1 * 9/2012 Levine ..... B65D 47/42 401/277
9,216,072 B2 * 12/2015 Joyashiki ..... A61C 17/005
9,936,797 B2 * 4/2018 Kolb ..... A46B 11/0041
10,172,441 B2 * 1/2019 Wu ..... A46B 9/04

FOREIGN PATENT DOCUMENTS

DE 202013005487 U1 * 10/2014 ..... A45D 27/04

* cited by examiner

*Primary Examiner* — Jennifer C Chiang
(74) *Attorney, Agent, or Firm* — Roger A. Jackson

(57) ABSTRACT

A fluid dispenser for manually applying a selected fluid to a desired location, the fluid dispenser includes a reservoir for the selected fluid, the reservoir has a flexible resilient body plus an applicator assembly with a cavity that is in communication with the reservoir, applicator assembly also has a partial disposing of a plurality of bristle elements, such that the cavity openly terminates within the plurality of bristle elements, wherein operationally the selected fluid is manually moved from the reservoir interior via manually squeezing the surrounding sidewall with the selected fluid moving into the cavity, and finally dispensing adjacent to the plurality of bristles.

6 Claims, 43 Drawing Sheets

FLUID DISPENSER

CROSS-REFERENCE TO RELATED APPLICATION

This application claims the benefit of U.S. provisional patent application Ser. No. 63/463,458 filed on May 2, 2023 by Mario Gonzalez of Denver, Colorado, U.S.

BACKGROUND OF INVENTION

The present invention is generally relates to a fluid dispenser typically used for directing a selected fluid to a desired location, and more particularly to a manually operated fluid dispenser utilizing a reservoir to store the selected fluid and to manually dispense the selected fluid through an applicator assembly that includes a plurality of bristles.

There are a variety of fluid dispensers in the prior art. Fluid dispenser components typically comprise: a reservoir, a means for regulating fluid flow, and an applicator. The reservoir contains a fluid and also has a means for motivating the fluid to communicate into the means for regulating the fluid flow and further communicating to the applicator. The means for motivating the fluid out of the reservoir can be anything from simply using gravity to having a means for increasing the pressure of the fluid in the reservoir thus motivating the fluid to flow out of the reservoir through the means for regulating the fluid flow and onward to the applicator. The means for motivating the fluid out of the reservoir outside of simply using gravity can include using a movable piston inside of a close fitting bore such as in a hypodermic needle, or having a reservoir constructed of a resilient material wherein the reservoir is compressed in some manner to reduce its interior volume thus raising the pressure of the fluid in the reservoir. The means for regulating the fluid flow can include simply having a selectively sized fluid flow passageway, or a valve of some type. The applicator portion of the fluid dispenser can include a pen quill, a hollow needle being a cannula with a lumen, a brush with bristles, or a sponge type material, and the like. There are many issues surrounding the fluid dispenser, such as accurate controlling of the measured volumes of the fluid dispensed, how to handle the many different types of fluids and their properties, such as viscosity, miscibility of the flows through the applicator and onto the desired surface, area, or volumemetric cavity at the desired location. Other issues for fluid dispensers would include fluid waste, spillage, leakage, and reuse of the fluid dispenser after a period of inactivity wherein the fluid may dry or harden in or on any of the fluid dispenser components.

Typically, once the fluid leaves the sealed reservoir it is exposed to atmospheric air wherein the fluid's volatile compounds start to evaporate and initiate the fluid drying or hardening process which may cause fluid communication problems for the fluid dispenser components being the means to regulate fluid flow and the applicator as the fluid viscosity greatly increases and can essentially cause the fluid dispenser to become inoperative. Also, another issue is the communication of the fluid to the applicator itself, such as with a conventional brush that is dipped into a fluid wherein the fluid is deposited all over the brush which typically causes an excess amount of fluid on the brush requiring at least one brush stroke to remove excess fluid from the brush before use, with typically only one side of the brush which will be applied to the surface and the like. In addition, reservoir breakage and accidental discharge of the fluid can be problems while the fluid dispenser is in use. control the volume of fluid to be dispensed depends to a large degree upon the volumetric accuracy required, with the piston and bore apparatus being substantially the most accurate, however, having a higher cost to manufacture and also having the attendant disadvantage of requiring a close fitting dynamic fluid seal between the piston and the bore. Also, utilizing a specifically sized volume of reservoir to dispense a selected amount of fluid can result in material waste in the form of making the reservoirs' individually disposable for a single use, or adding additional apparatus to make the reservoir refillable for multiple uses from one reservoir. The use of a resilient reservoir is appealing due to lower cost and simplicity; however, the addition of apparatus to create some sort of mechanical stop or stops can also add complexity and cost to the fluid dispenser assembly.

What is needed is a fluid dispenser that overcomes the previously identified issues related to fluid dispensers, being selectable volumes of fluid to dispense from the reservoir, the means of controlling or regulating the fluid flow, having reduced susceptibility to the fluid drying or hardening from exposure to atmospheric air, the method of applying the fluid to the applicator, and having the reservoir separable from the means of controlling the regulating the fluid flow. While at the same time keeping the objectives of simplicity, function and minimal manufacturing cost paramount. This requires a reservoir that has an easily controllable interior volume adjustment with reduced risk of rupture, breakage, or leakage of the reservoir fluid and with the reservoir having a resealable outlet that minimizes the problems of the fluid drying or hardening that would restrict the fluid communicating from the reservoir outlet that is caused from the fluid being exposed to atmospheric air while the same time reducing the risk of accidental spillage of the fluid from the reservoir. Also, this would require that the means of controlling and regulating the fluid flow would deposit the fluid to an interior portion of the applicator thus minimizing the need for removal of excess fluid from the applicator prior to use.

SUMMARY OF THE INVENTION

The present invention is the fluid dispenser for manually applying the selected fluid to a desired location, including the reservoir assembly that is able to contain the selected fluid, the reservoir includes a flexible resilient body portion constructed of a surrounding sidewall with a surrounding sidewall outer surface and an opposing surrounding sidewall inner surface, the surrounding sidewall having a first end portion and an opposing second end portion. The first end portion having a sealing cap portion with a sealing cap inside surface and an opposing sealing cap outside surface, and the second end portion having an aperture interface, wherein the inner surface, the inside surface, and the aperture interface define the reservoir interior volume that is in fluid communication with the aperture interface.

Further included in the fluid dispenser is the applicator assembly having a proximal end portion and an opposing distal end portion, the applicator assembly includes the cavity disposed within the applicator assembly, wherein the cavity facilitates fluid communication from the proximal end portion to the distal end portion, the cavity terminates in the proximal end portion in a substantially fluid tight coupling that is removably received by the aperture interface to operationally accommodate fluid communication from the reservoir interior to the cavity. The distal end portion has a partial disposing of a plurality of bristle elements, such that the cavity openly terminates in the distal end portion at a discharge port that is adjacent to the plurality of bristle elements, wherein operationally the selected fluid is manually moved from the reservoir interior via manually squeezing the surrounding sidewall with the selected fluid moving into the aperture interface and further into the cavity, and finally dispensing adjacent to the plurality of bristles.

These and other objects of the present invention will become more readily appreciated and understood from a consideration of the following detailed description of the exemplary embodiments of the present invention when taken together with the accompanying drawings, in which;

BRIEF DESCRIPTION OF DRAWINGS

FIG. 25 is cross sectional view 25-25 from FIG. 24, wherein FIG. 25 shows the element disposed within the inner surface of the surrounding sidewall with an anti-rotation key slot in the element outer periphery that is slidably engaged to the key that is disposed on the inner surface of the surrounding sidewall;

FIG. 28 shows cross sectional view 28-28 from FIGS. 26 and 27, wherein FIG. 28 shows a close-up of the assembly of the disc that has a protrusion that is slidably engaged to the helical wrap channel, wherein the lengthwise slot in the sleeve moves the protrusion of the disc along the sleeve lengthwise axis via the protrusion sliding within the helical channel as the sleeve rotates within the third surrounding sidewall through the manual rotation of the manual grasping extension;

FIG. 30 is view 30-30 from FIG. 28, wherein FIG. 30 shows a close-up of the assembly of the disc that has a protrusion that is slidably engaged to the helical wrap channel, wherein the lengthwise slot in the sleeve moves the protrusion of the disc along the sleeve lengthwise axis via the protrusion sliding within the helical channel as the sleeve rotates within the third surrounding sidewall through the manual rotation of the manual grasping extension (not shown);

DETAILED DESCRIPTION OF THE INVENTION

Figure 1:
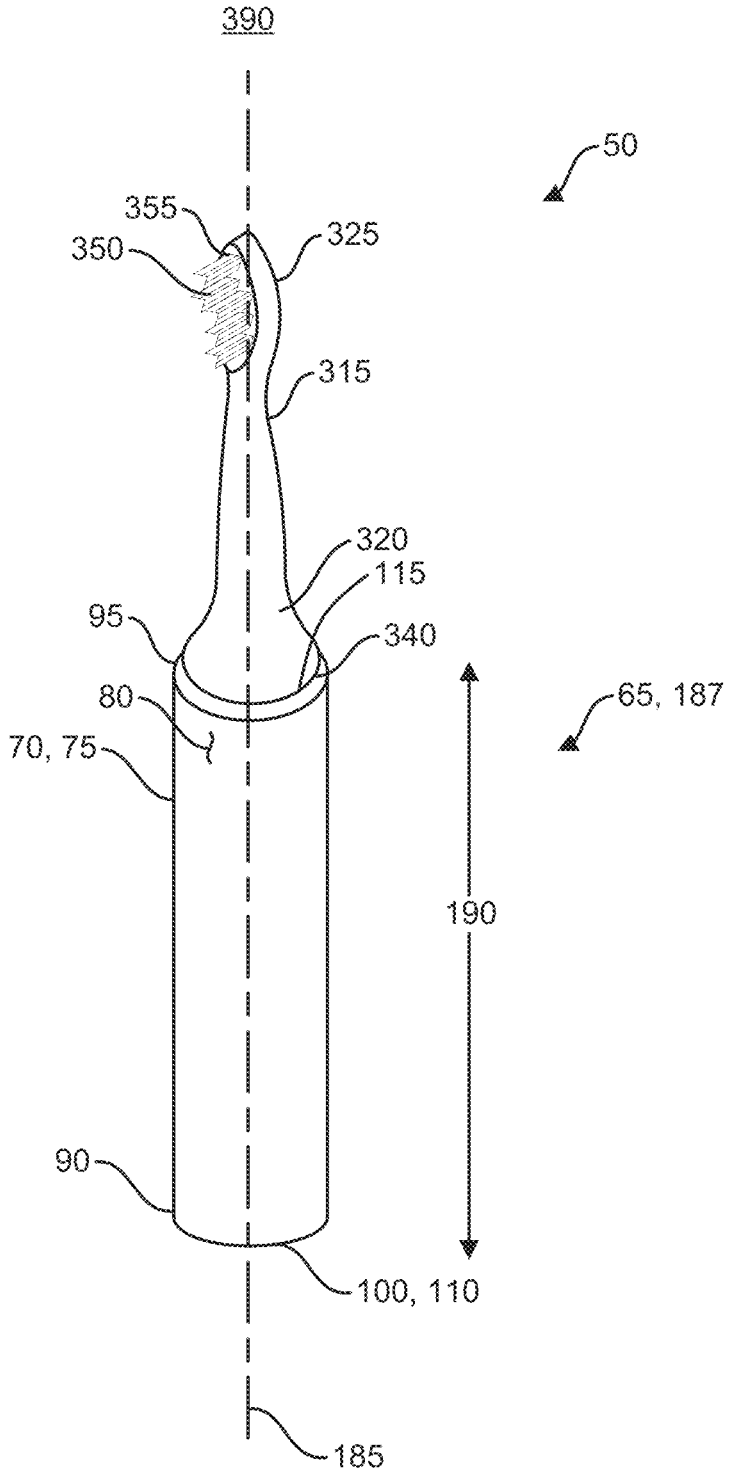
FIG. 1 shows an upper perspective view of the fluid dispenser that includes the plurality of bristle elements, the applicator assembly, the reservoir assembly, the surrounding sidewall in the uncompressed state, and the sealing cap portion.

With initial reference to FIG. 1 shown is an upper perspective view of the fluid dispenser 50 that includes the plurality of bristle elements 350, the applicator assembly 315, the reservoir assembly 65, the surrounding sidewall 75 in the uncompressed state 187, and the sealing cap portion 100.

Figure 2:
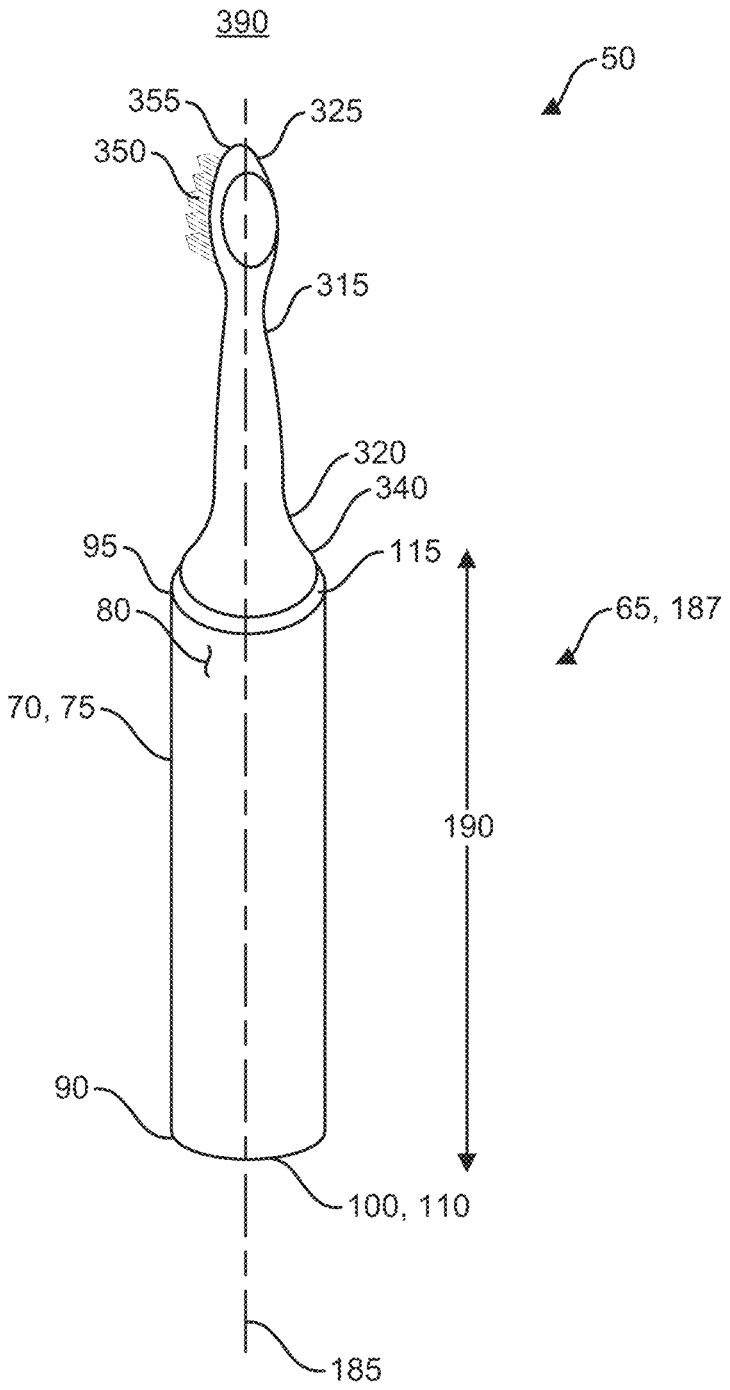
FIG. 2 shows another upper perspective view of the fluid dispenser that includes the plurality of bristle elements, the applicator assembly, the reservoir assembly, the surrounding sidewall in the uncompressed state, and the sealing cap portion.

Next, FIG. 2 shows another upper perspective view of the fluid dispenser 50 that includes the plurality of bristle elements 350, the applicator assembly 315, the reservoir assembly 65, the surrounding sidewall 75 in the uncompressed state 187, and the sealing cap portion 100.

Figure 3:
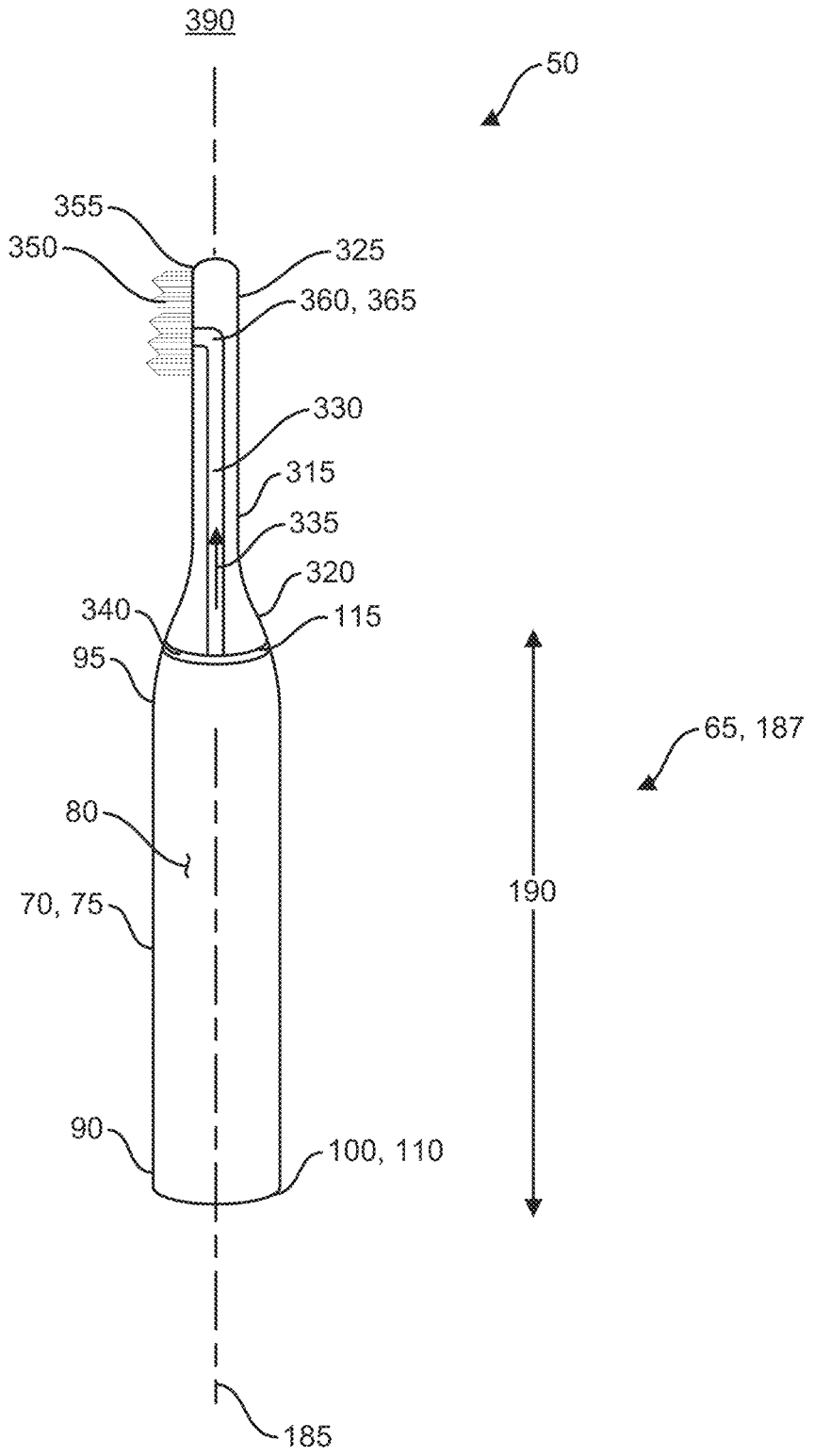
FIG. 3 shows a side elevation view of the fluid dispenser that includes the plurality of bristle elements, the applicator assembly with the cavity, the reservoir assembly, the surrounding sidewall in the uncompressed state, and the sealing cap portion.

Further, FIG. 3 shows a side elevation view of the fluid dispenser 50 that includes the plurality of bristle elements 350, the applicator assembly 315 with the cavity 330, the reservoir assembly 65, the surrounding sidewall 75 in the uncompressed state 187, and the sealing cap portion 100.

Figure 4:
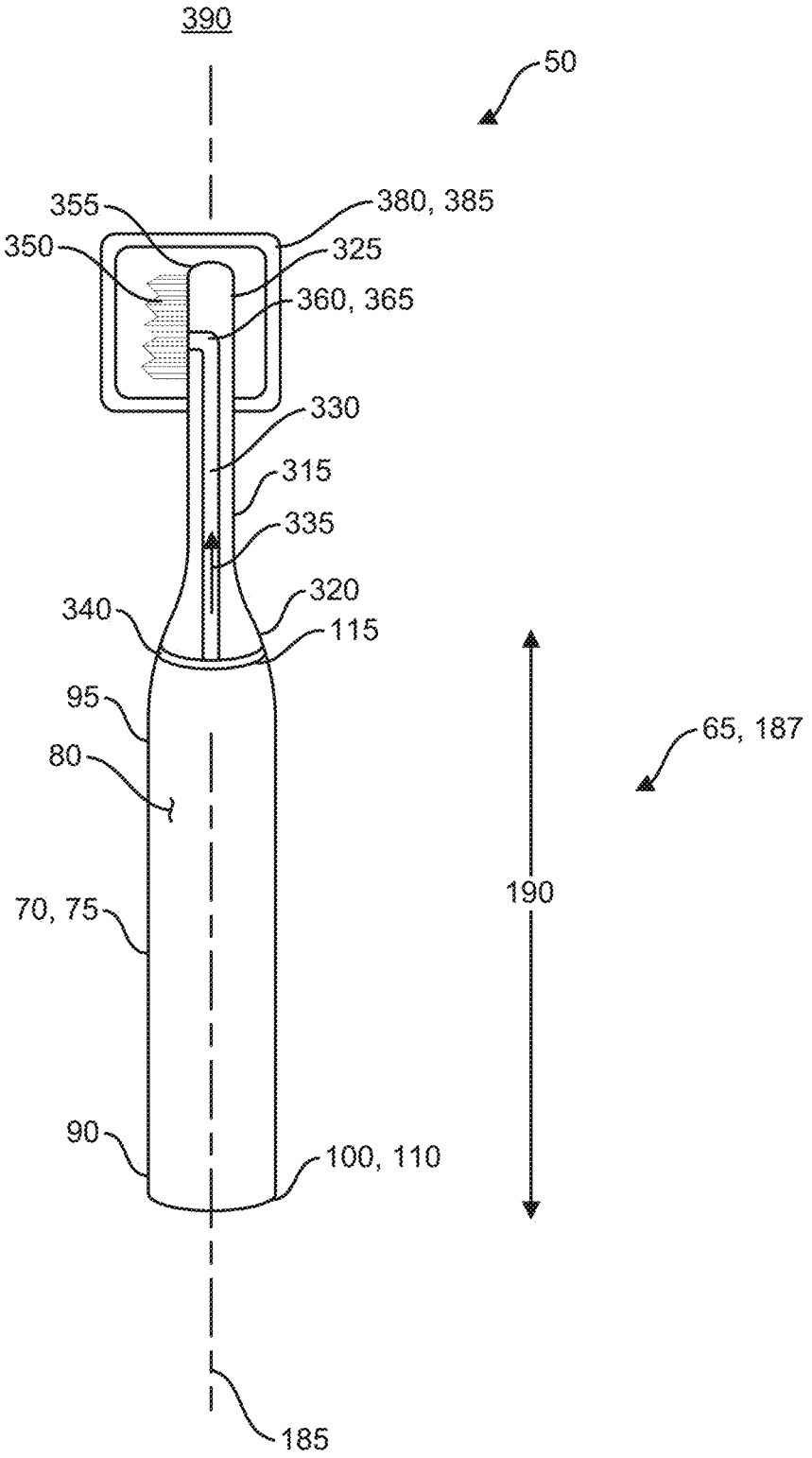
FIG. 4 shows a side elevation view of the fluid dispenser that includes the plurality of bristle elements with the cross section of the bristle elements cover, the applicator assembly with the cavity, the reservoir assembly, the surrounding sidewall in the uncompressed state, and the sealing cap portion.

Continuing, FIG. 4 shows a side elevation view of the fluid dispenser 50 that includes the plurality of bristle elements 350 with the cross section of the bristle elements 350 cover 380, the applicator assembly 315 with the cavity 330, the reservoir assembly 65, the surrounding sidewall 75 in the uncompressed state 187, and the sealing cap portion 100.

Figure 5:
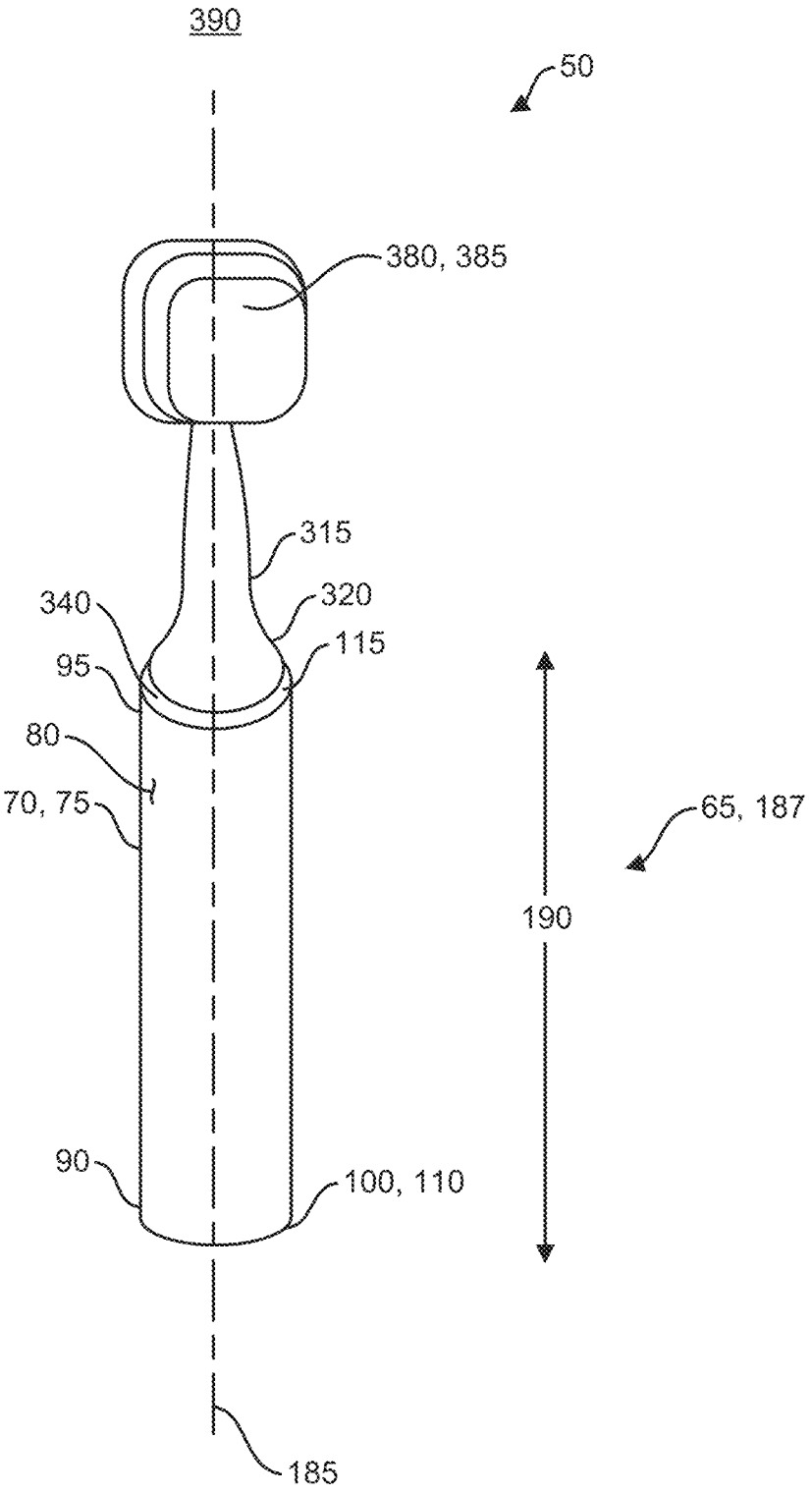
FIG. 5 shows a side elevation view of the fluid dispenser that includes the plurality of bristle elements (not shown) with the bristle elements cover outer surface shown, the applicator assembly, the reservoir assembly, the surrounding sidewall in the uncompressed state, and the sealing cap portion.

Further, FIG. 5 shows a side elevation view of the fluid dispenser 50 that includes the plurality of bristle elements 350 (not shown) with the bristle elements 350 cover 380 outer surface shown, the applicator assembly 315, the reservoir assembly 65, the surrounding sidewall 75 in the uncompressed state 187, and the sealing cap portion 100.

Figure 6:
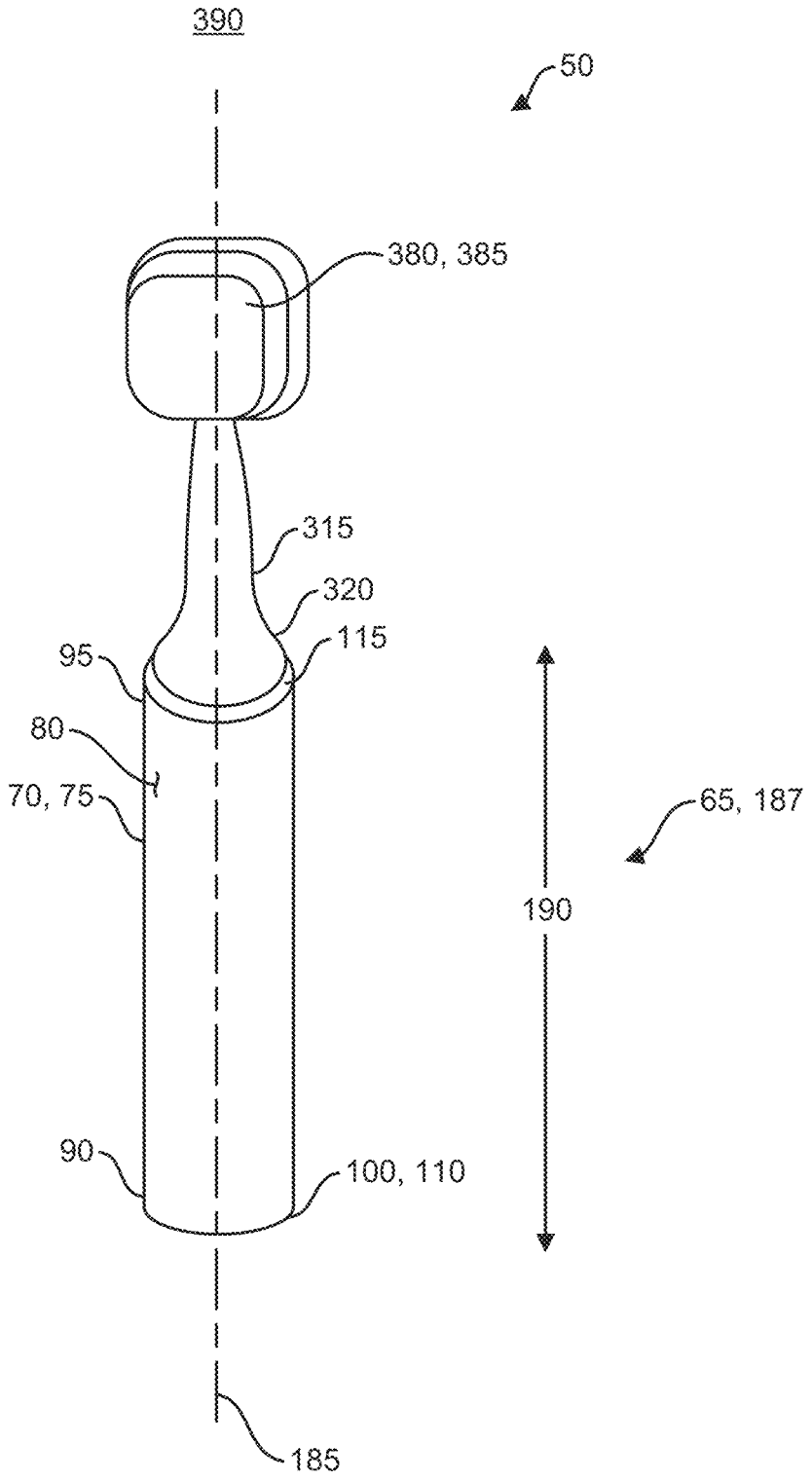
FIG. 6 shows another side elevation view of the fluid dispenser that includes the plurality of bristle elements (not shown) with the bristle elements cover outer surface shown, the applicator assembly, the reservoir assembly, the surrounding sidewall in the uncompressed state, and the sealing cap portion.

Next, FIG. 6 shows another side elevation view of the fluid dispenser 50 that includes the plurality of bristle elements 350 (not shown) with the bristle elements 350 cover 380 outer surface shown, the applicator assembly 315, the reservoir assembly 65, the surrounding sidewall 75 in the uncompressed state 187, and the sealing cap portion 100.

Figure 7:
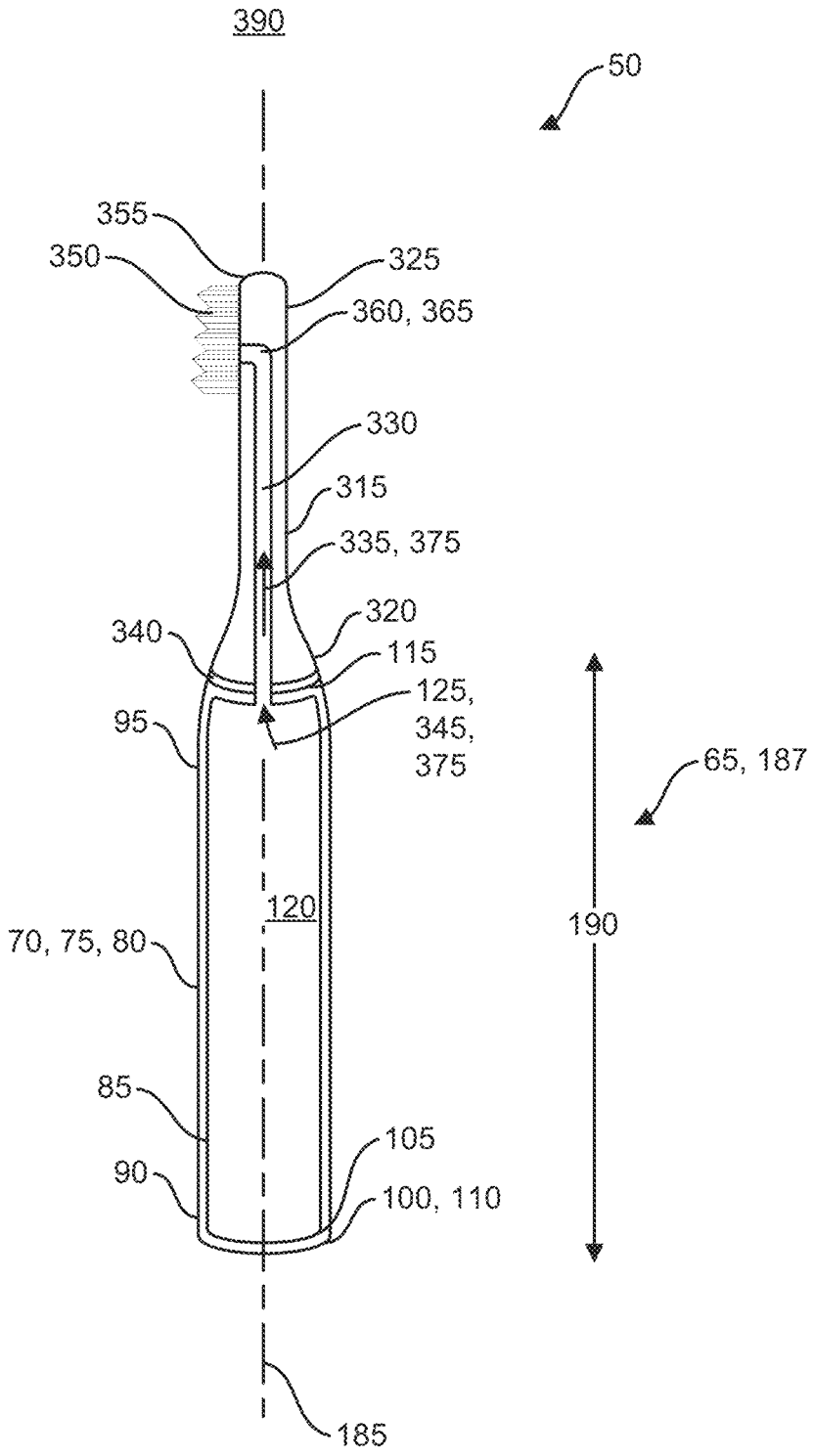
FIG. 7 shows a side elevation view of the fluid dispenser that includes the plurality of bristle elements, the applicator assembly with the cavity, the reservoir assembly, the surrounding sidewall in the uncompressed state showing the reservoir interior volume, and the sealing cap portion.

Further, FIG. 7 shows a side elevation view of the fluid dispenser 50 that includes the plurality of bristle elements 350, the applicator assembly 315 with the cavity 330, the reservoir assembly 65, the surrounding sidewall 75 in the uncompressed state 187 showing the reservoir interior volume 120, and the sealing cap portion 100.

Figure 8:
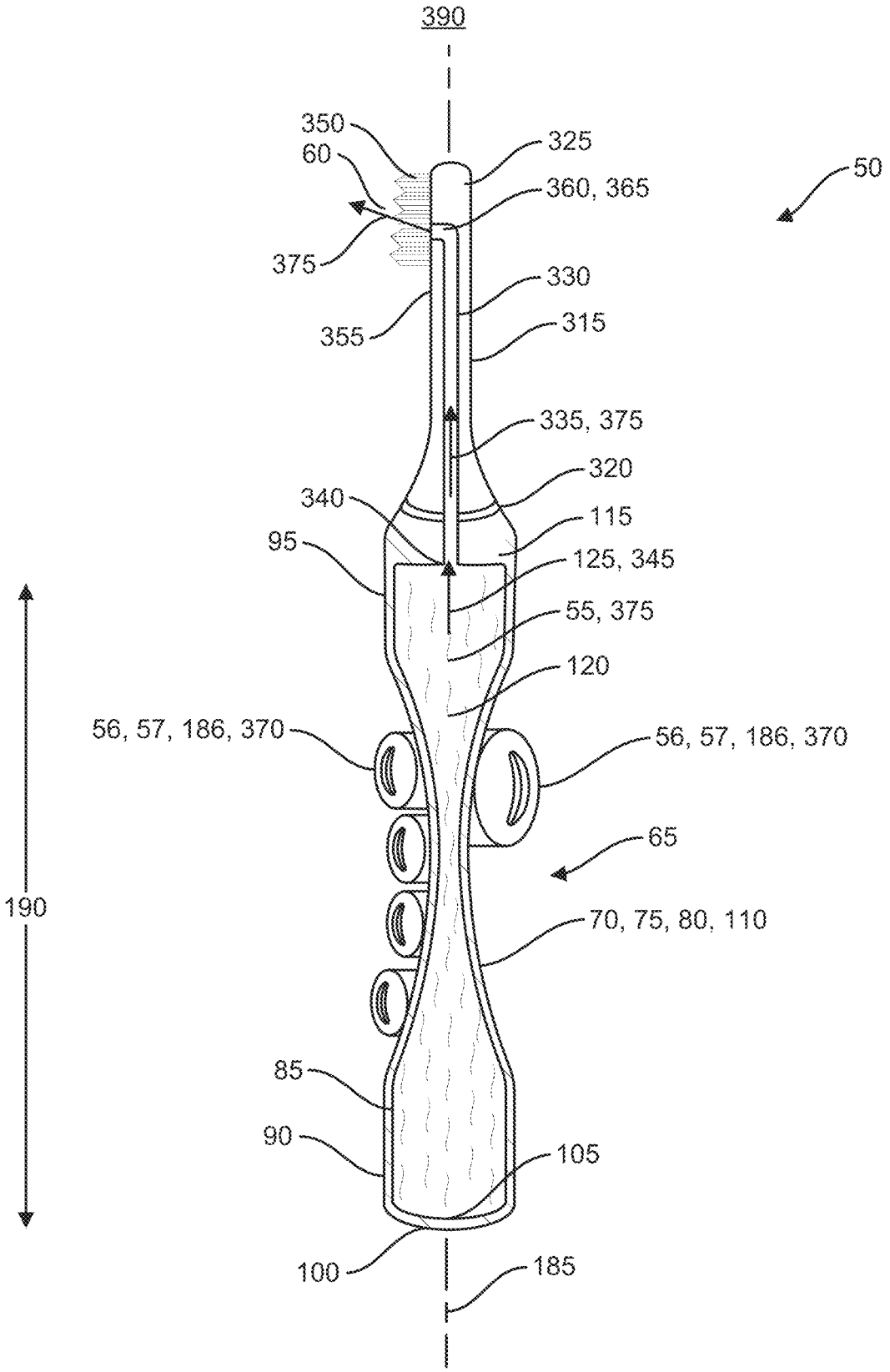
FIG. 8 shows a side elevation view of the fluid dispenser that includes the plurality of bristle elements, the applicator assembly with the cavity, the reservoir assembly, the surrounding sidewall in the manual compression state showing the reservoir interior volume reduced, and the sealing cap portion, wherein the selected fluid coming out the discharge port within the plurality of bristles.

Continuing, FIG. 8 shows a side elevation view of the fluid dispenser 50 that includes the plurality of bristle elements 350, the applicator assembly 315 with the cavity 330, the reservoir assembly 65, the surrounding sidewall 75 in the manual compression state 186 showing the reservoir interior volume 120 reduced, and the sealing cap portion 100, wherein the selected fluid 55 coming out the discharge port 360 within the plurality of bristles 350.

Figure 9:
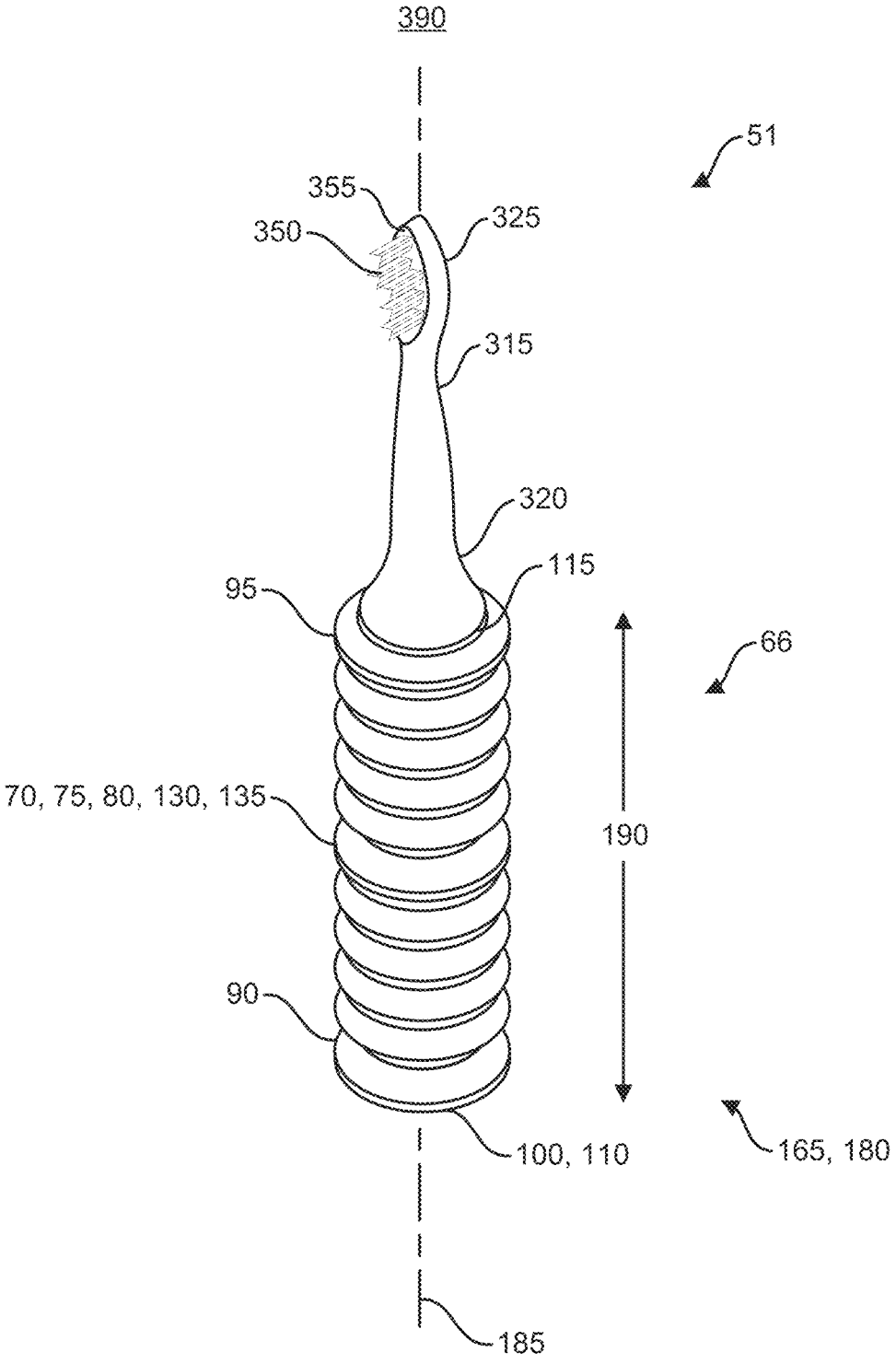
FIG. 9 shows an upper perspective view of the first alternative embodiment of the fluid dispenser that includes the plurality of bristle elements, the applicator assembly, the first reservoir assembly, the snap bellows surrounding sidewall in the manual extension state, and the sealing cap portion.

Further, FIG. 9 shows an upper perspective view of the first alternative embodiment 51 of the fluid dispenser that includes the plurality of bristle elements 350, the applicator assembly 315, the first reservoir assembly 66, the snap bellows surrounding sidewall 130 in the manual extension state 165, and the sealing cap portion 100.

Figure 10:
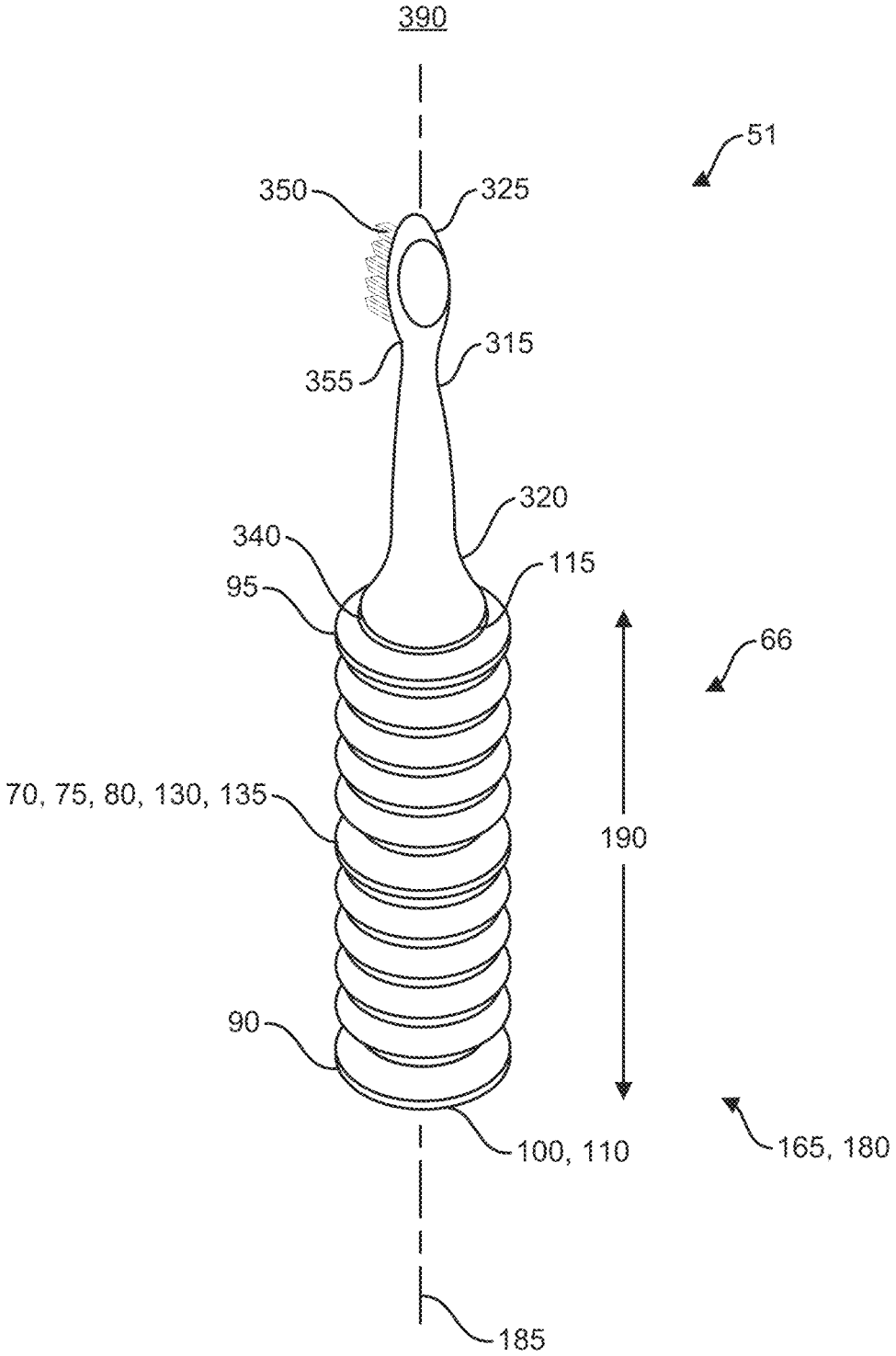
FIG. 10 shows another upper perspective view of the first alternative embodiment of the fluid dispenser that includes the plurality of bristle elements, the applicator assembly, the first reservoir assembly, the snap bellows surrounding sidewall in the manual extension state, and the sealing cap portion.

Next, FIG. 10 shows another upper perspective view of the first alternative embodiment 51 of the fluid dispenser that includes the plurality of bristle elements 350, the applicator assembly 315, the first reservoir assembly 66, the snap bellows surrounding sidewall 130 in the manual extension state 165, and the sealing cap portion 100.

Figure 11:
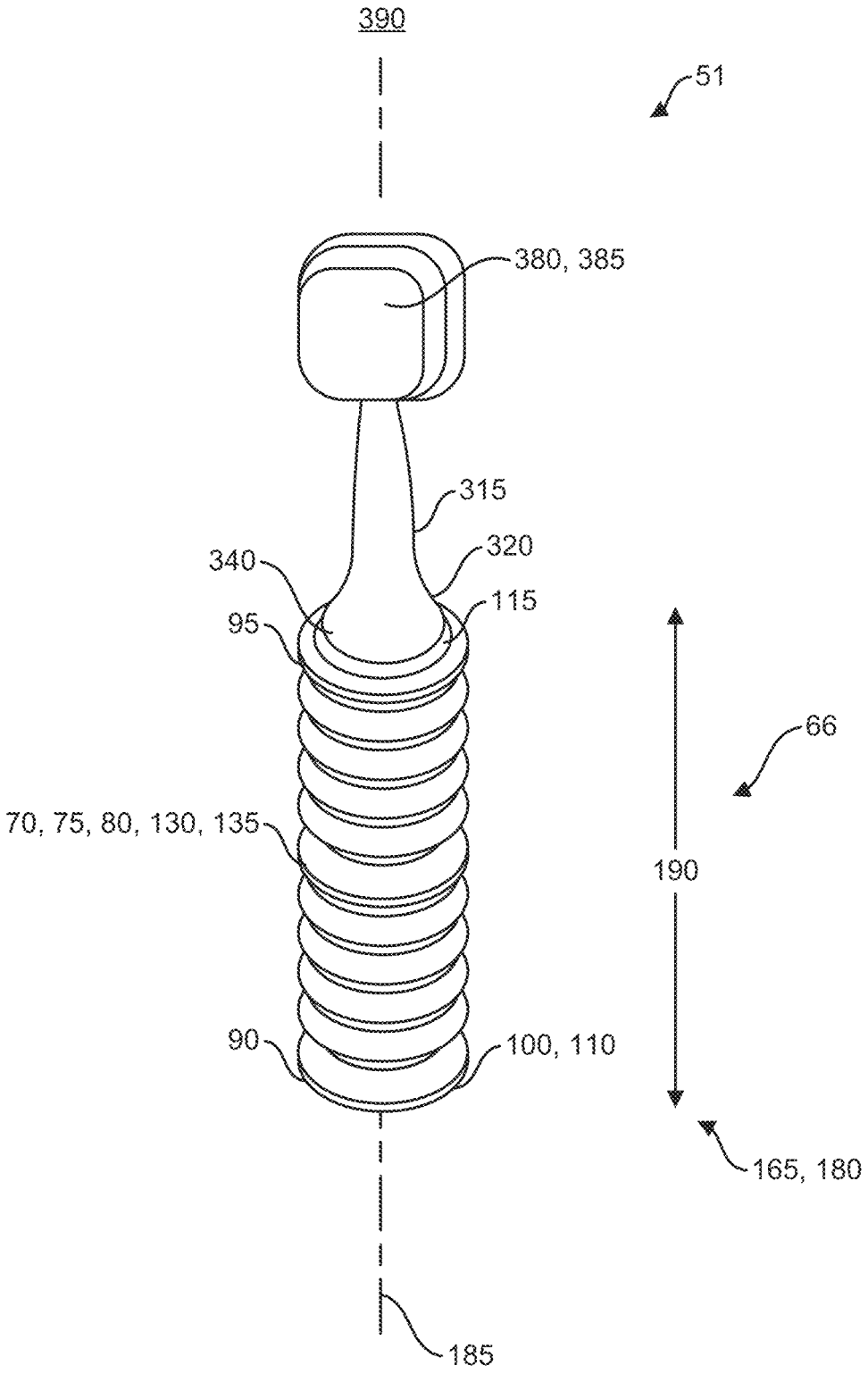
FIG. 11 shows an upper perspective view of the first alternative embodiment of the fluid dispenser that includes the plurality of bristle elements (not shown) with the bristle elements cover outer surface shown, the applicator assembly, the first reservoir assembly, the snap bellows surrounding sidewall in the manual extension state, and the sealing cap portion.

Also, FIG. 11 shows an upper perspective view of the first alternative embodiment 51 of the fluid dispenser that includes the plurality of bristle elements 350 (not shown) with the bristle elements cover 380 outer surface shown, the applicator assembly 315, the first reservoir assembly 66, the snap bellows surrounding sidewall 130 in the manual extension state 165, and the sealing cap portion 100.

Figure 12:
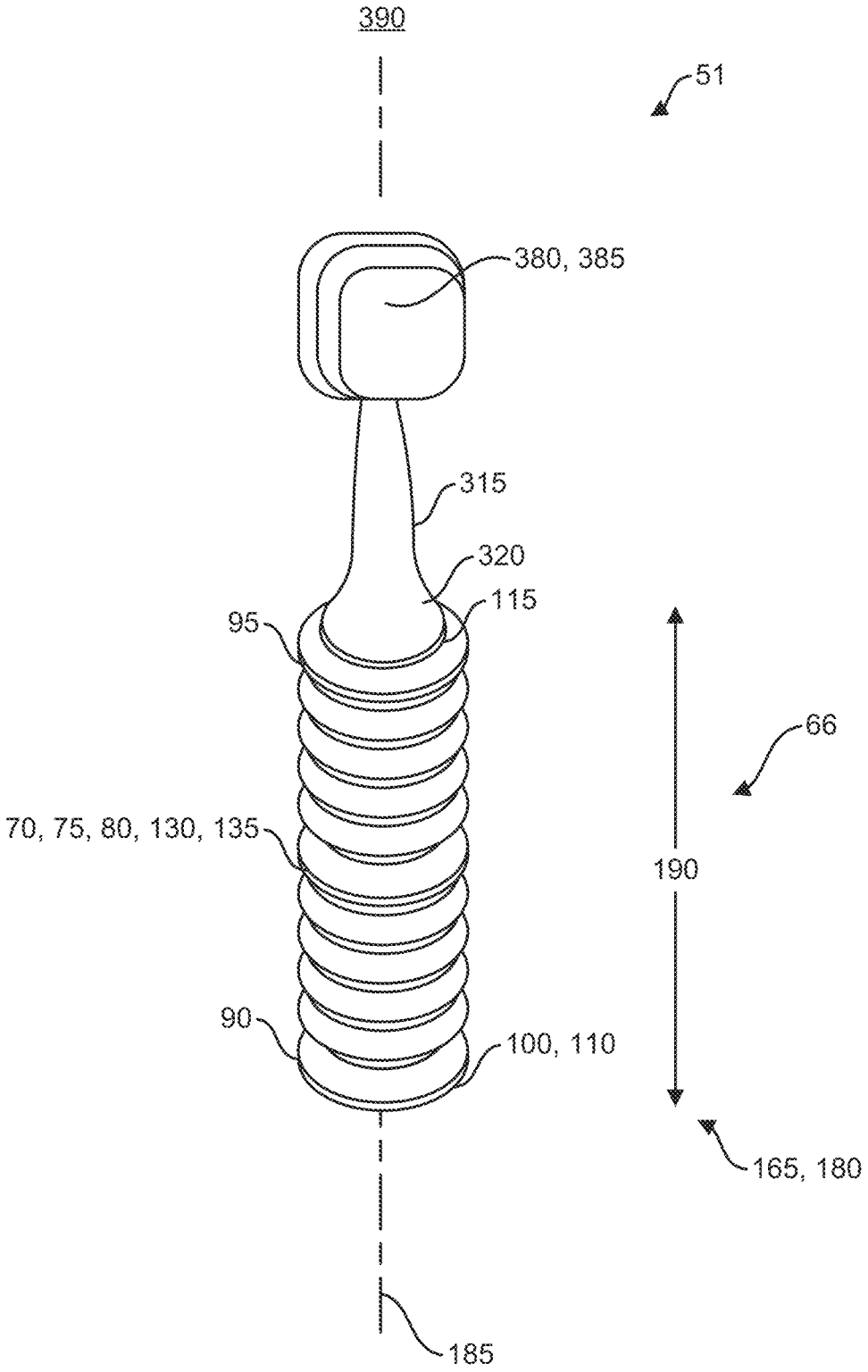
FIG. 12 shows another upper perspective view of the first alternative embodiment of the fluid dispenser that includes the plurality of bristle elements (not shown) with the bristle elements cover outer surface shown, the applicator assembly, the first reservoir assembly, the snap bellows surrounding sidewall in the manual extension state, and the sealing cap portion.

In addition, FIG. 12 shows another upper perspective view of the first alternative embodiment 51 of the fluid dispenser that includes the plurality of bristle elements 350 (not shown) with the bristle elements cover 380 outer surface shown, the applicator assembly 315, the first reservoir assembly 66, the snap bellows surrounding sidewall 130 in the manual extension state 165, and the sealing cap portion 100.

Figure 13:
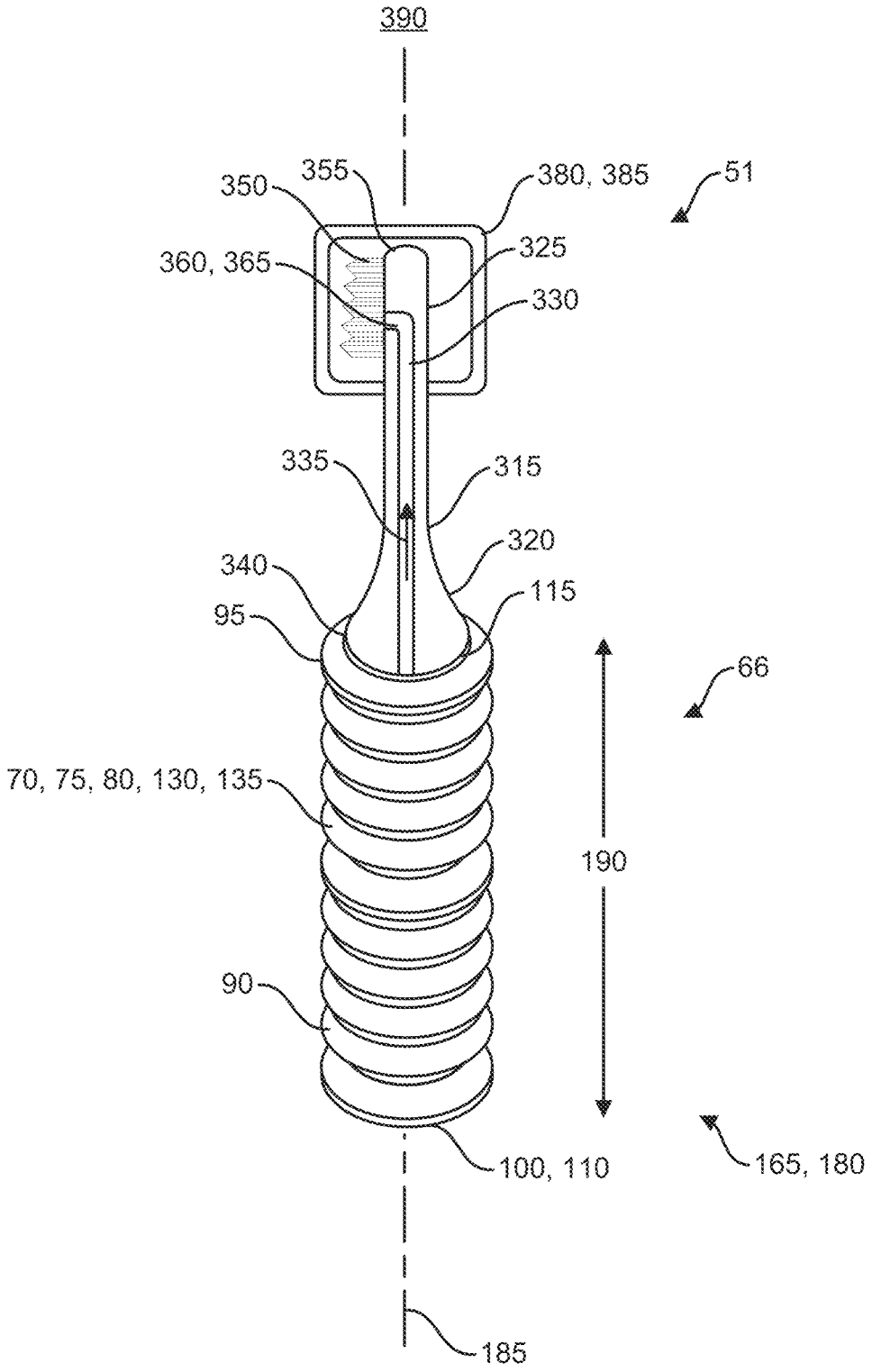
FIG. 13 shows another upper perspective view of the first alternative embodiment of the fluid dispenser that includes the plurality of bristle elements with the bristle elements cover cross section shown, the applicator assembly with the cavity, the first reservoir assembly, the snap bellows surrounding sidewall in the manual extension state, and the sealing cap portion.

Further, FIG. 13 shows another upper perspective view of the first alternative embodiment 51 of the fluid dispenser that includes the plurality of bristle elements 350 with the bristle elements cover 380 cross section shown, the applicator assembly 315 with the cavity 330, the first reservoir assembly 66, the snap bellows surrounding sidewall 130 in the manual extension state 165, and the sealing cap portion 100.

Figure 14:
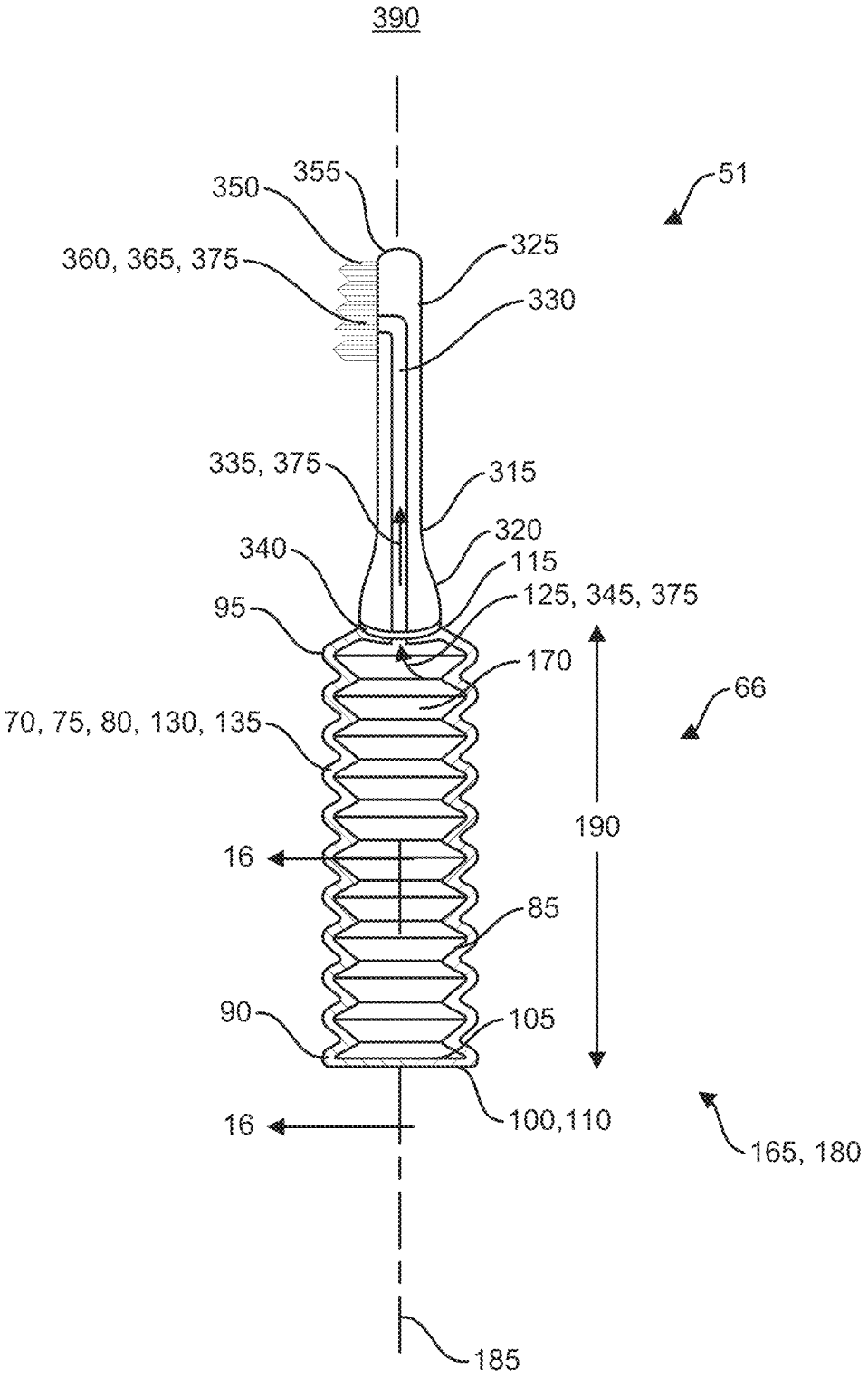
FIG. 14 shows another upper perspective view of the first alternative embodiment of the fluid dispenser that includes the plurality of bristle elements, the applicator assembly with the cavity, the first reservoir assembly, the first reservoir interior volume, the snap bellows surrounding sidewall in the manual extension state, and the sealing cap portion.

Next, FIG. 14 shows another upper perspective view of the first alternative embodiment 51 of the fluid dispenser that includes the plurality of bristle elements 350, the applicator assembly 315 with the cavity 330, the first reservoir assembly 66, the first reservoir interior volume 170, the snap bellows surrounding sidewall 130 in the manual extension state 165, and the sealing cap portion 100.

Figure 15:
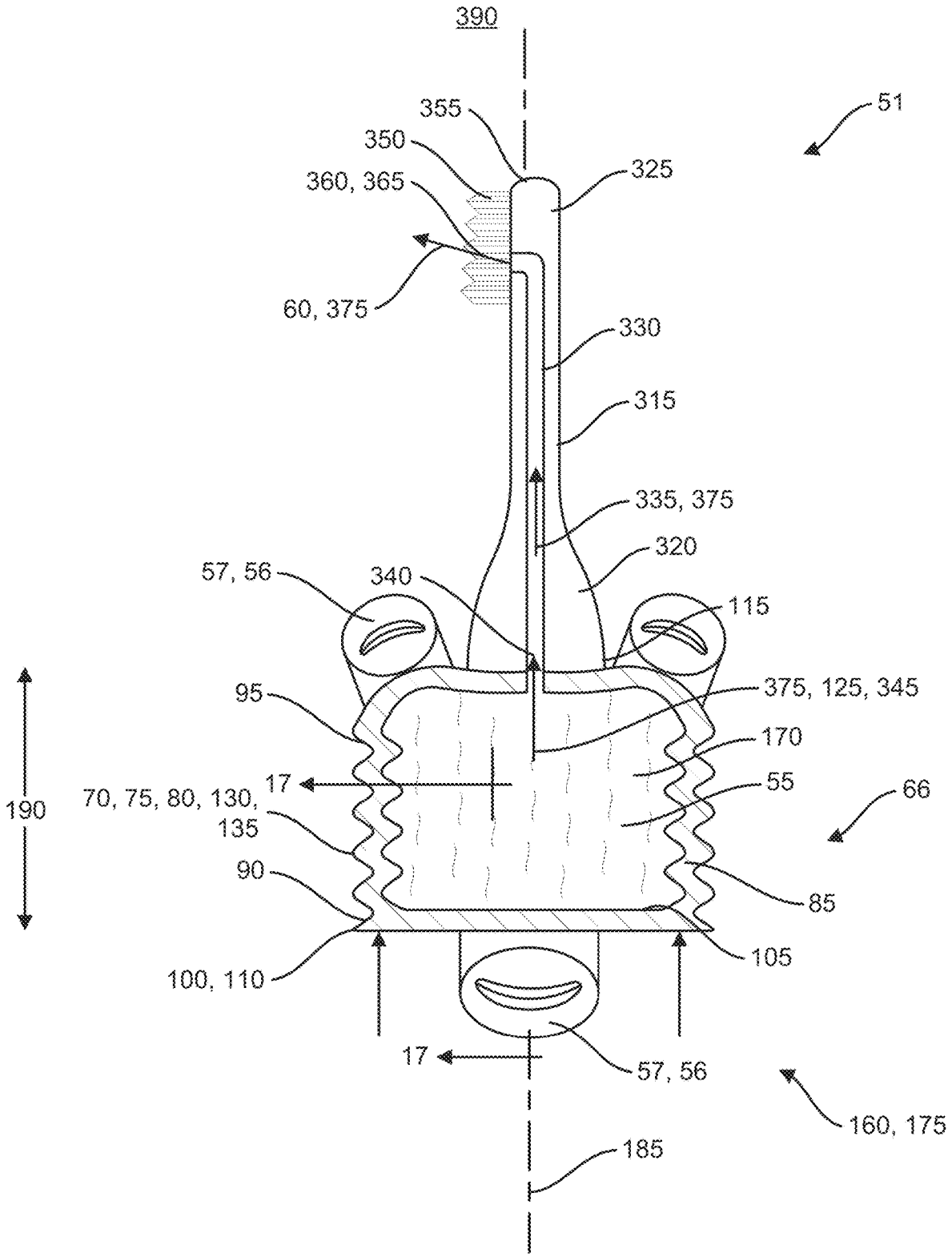
FIG. 15 shows a side elevation view of the first alternative embodiment of the fluid dispenser that includes the plurality of bristle elements, the applicator assembly with the cavity, the first reservoir assembly, the first reservoir interior volume, the snap bellows surrounding sidewall in the manual body retracting compression state showing the first reservoir interior volume reduced, and the sealing cap portion, wherein the selected fluid coming out the discharge port within the plurality of bristles.

Moving onward, FIG. 15 shows a side elevation view of the first alternative embodiment 51 of the fluid dispenser that includes the plurality of bristle elements 350, the applicator assembly 315 with the cavity 330, the first reservoir assembly 66, the first reservoir interior volume 170, the snap bellows surrounding sidewall 130 in the manual body retracting compression state 160 showing the first reservoir interior volume 170 reduced, and the sealing cap portion 100, wherein the selected fluid 55 coming out the discharge port 360 within the plurality of bristles 350.

Figure 16:
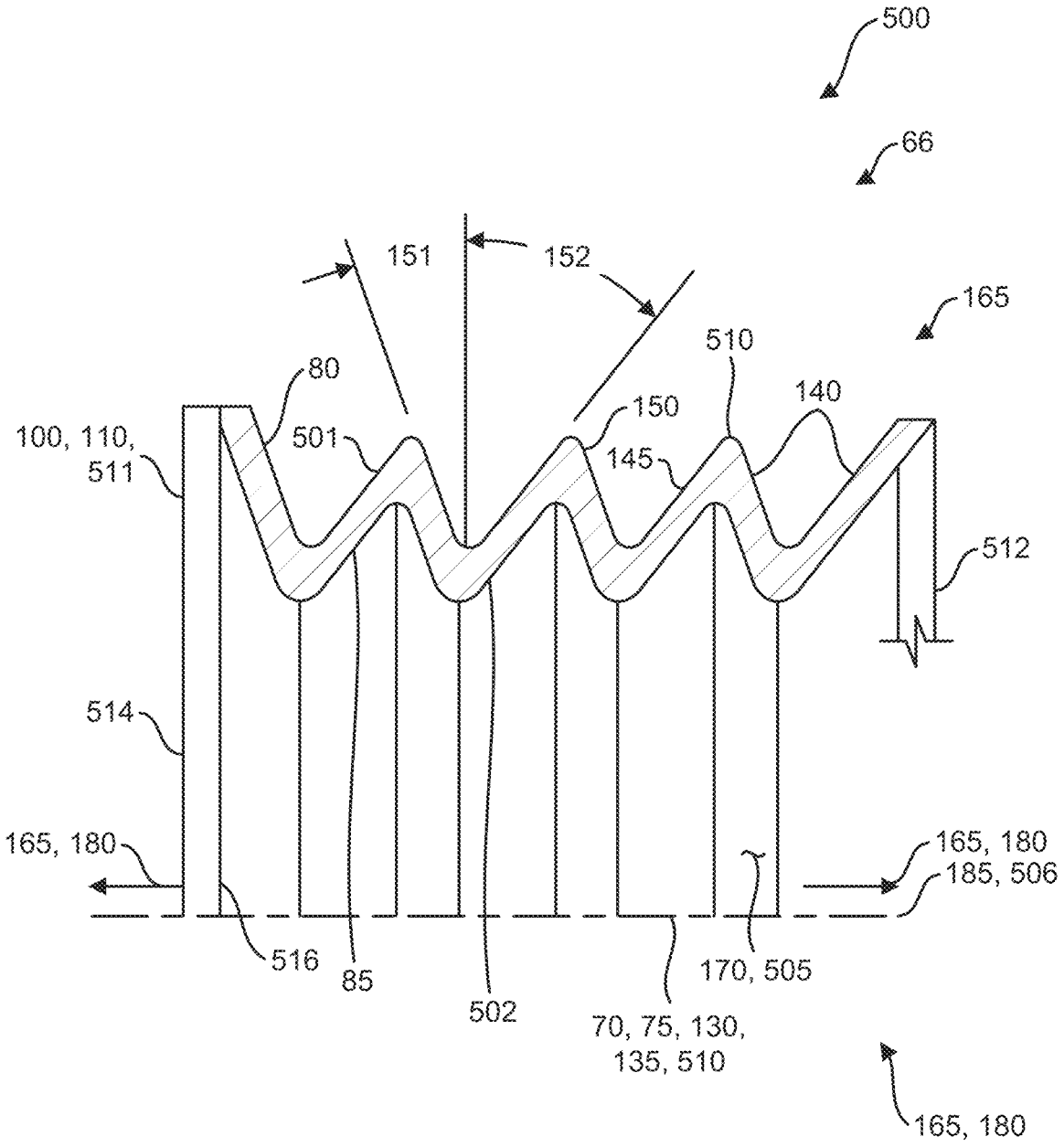
FIG. 16 shows cross section 16-16 from FIG. 14 of the snap bellows surrounding sidewall, wherein FIG. 16 specifically details the long and short sides of the bellows along with the large and small snap bellows angles, all with the snap bellows in the body extending state.

Next, FIG. 16 shows cross section 16-16 from FIG. 14 of the snap bellows surrounding sidewall 130, wherein FIG. 16 specifically details the long 145 and short 150 sides of the bellows 130 along with the large 152 and small 151 snap bellows angles, all with the snap bellows 130 in the body extending state 165.

Figure 17:
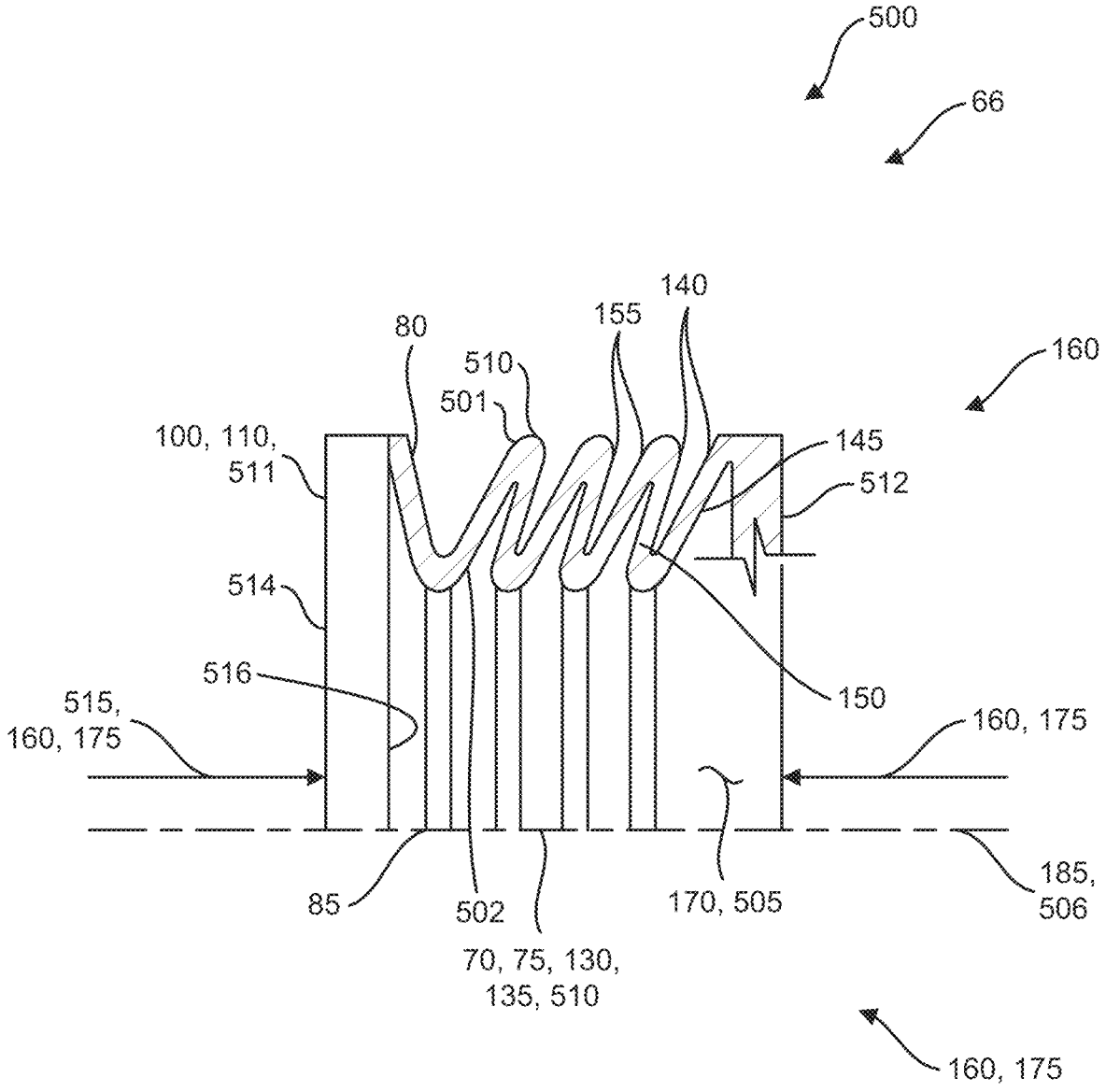
FIG. 17 shows cross section 17-17 from FIG. 15 of the snap bellows surrounding sidewall, wherein FIG. 17 specifically details the long and short sides of the bellows along with the large and small snap bellows angles, all with the snap bellows in the body retracting state with the fold back snap under of the bellows short and long sides to one another.

Further, FIG. 17 shows cross section 17-17 from FIG. 15 of the snap bellows surrounding sidewall 130, wherein FIG. 17 specifically details the long 145 and short 150 sides of the bellows 130 along with the large 152 and small 151 snap bellows angles, all with the snap bellows in the body retracting state 160 with the fold back snap under 155 of the bellows short 150 and long 145 sides to one another.

Figure 18:
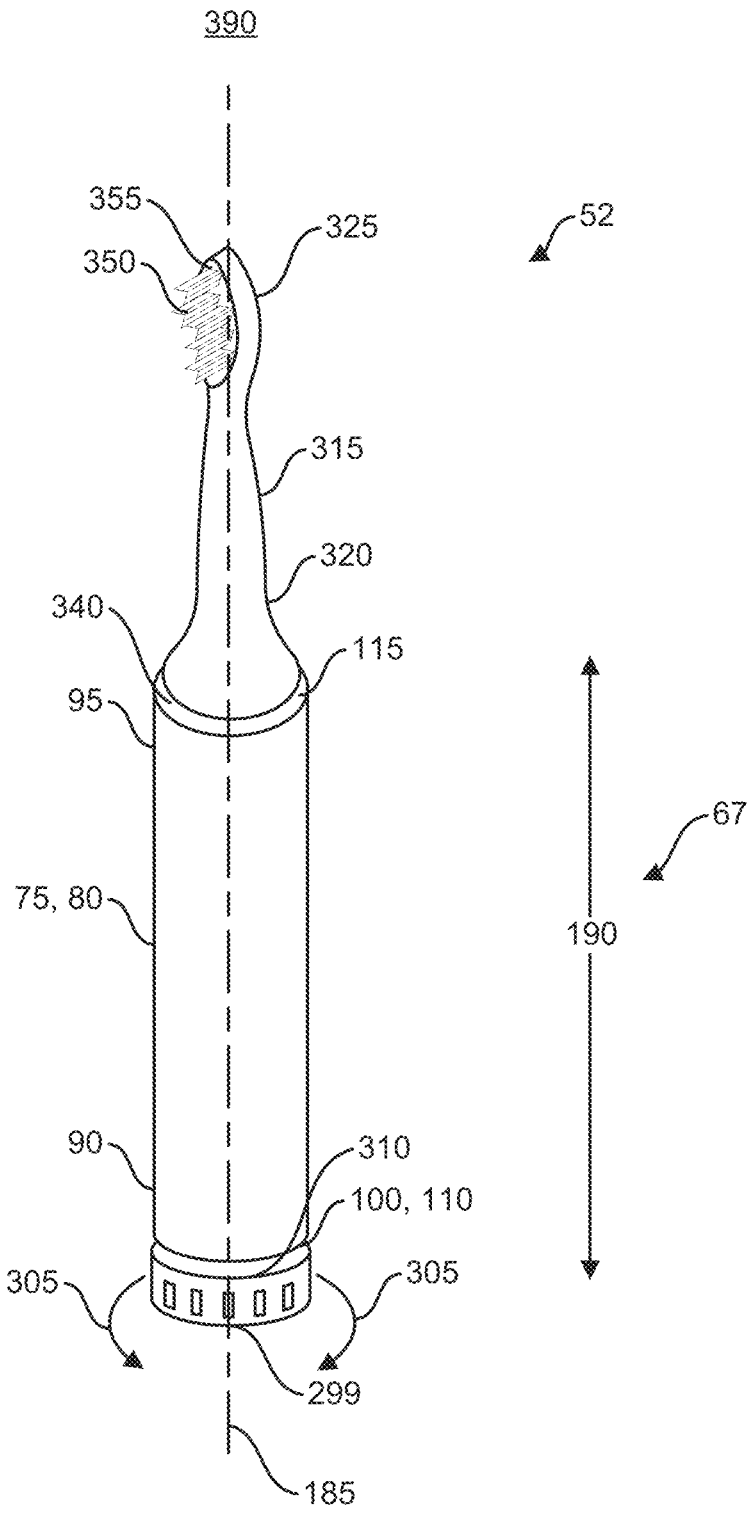
FIG. 18 shows an upper perspective view of the second alternative embodiment of the fluid dispenser that includes the plurality of bristle elements, the applicator assembly, the second reservoir assembly, the surrounding sidewall, and the turn knob extension.

Also, FIG. 18 shows an upper perspective view of the second alternative embodiment 52 of the fluid dispenser that includes the plurality of bristle elements 350, the applicator assembly 315, the second reservoir assembly 67, the surrounding sidewall 75, and the turn knob extension 299.

Figure 19:
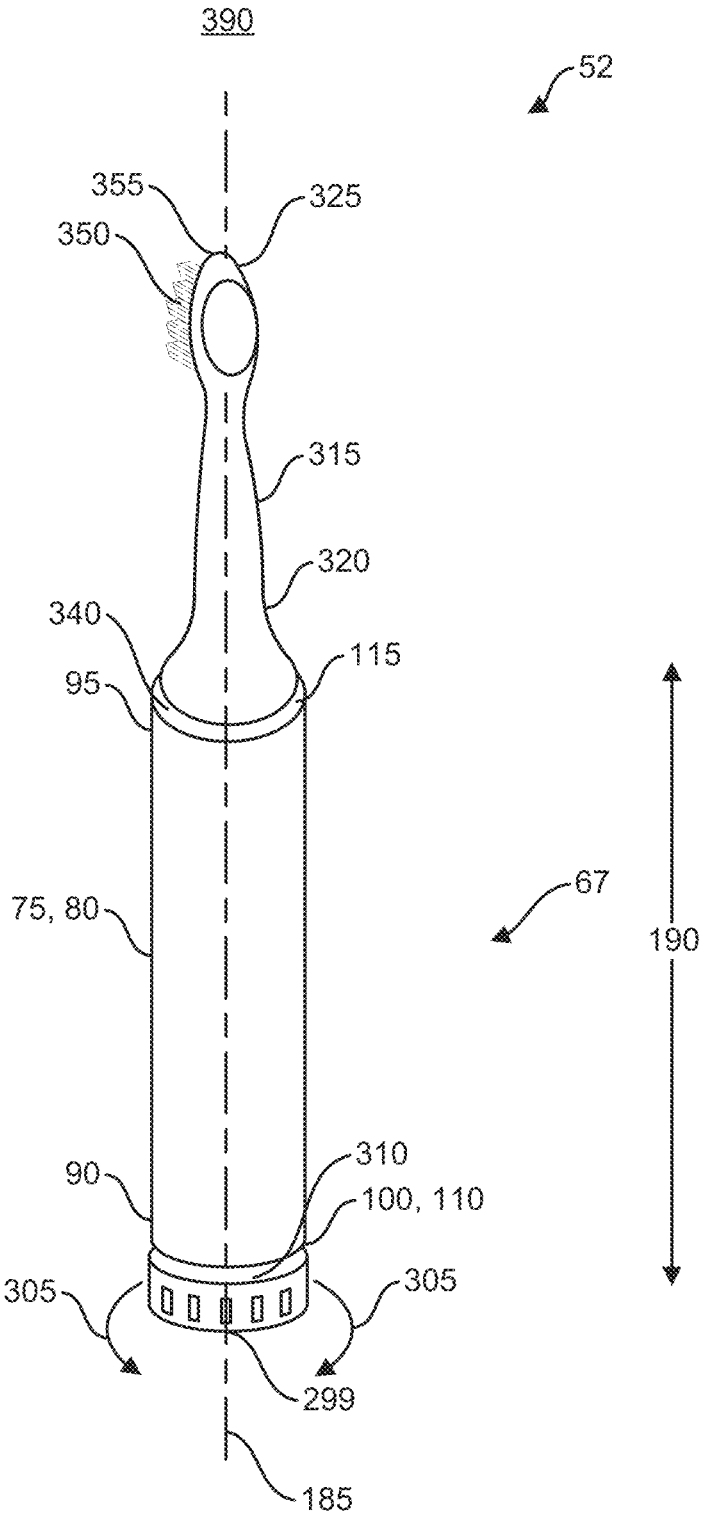
FIG. 19 shows another upper perspective view of the second alternative embodiment of the fluid dispenser that includes the plurality of bristle elements, the applicator assembly, the second reservoir assembly, the surrounding sidewall, and the turn knob extension.

Next, FIG. 19 shows another upper perspective view of the second alternative embodiment 52 of the fluid dispenser that includes the plurality of bristle elements 350, the applicator assembly 315, the second reservoir assembly 67, the surrounding sidewall 75, and the turn knob extension 299.

Figure 20:
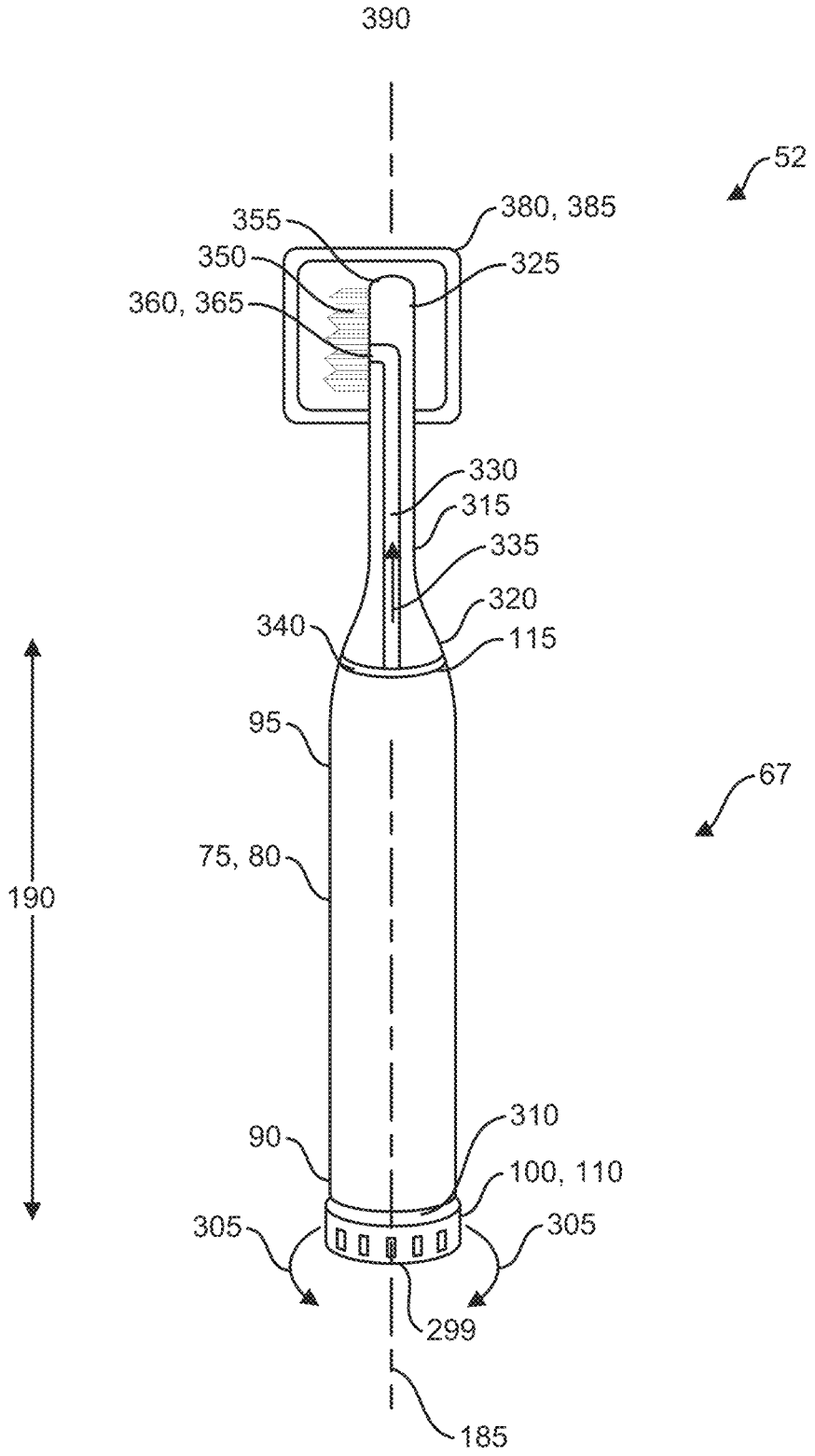
FIG. 20 shows an upper perspective view of the second alternative embodiment of the fluid dispenser that includes the plurality of bristle elements with a cross section of the cover over the plurality of bristle elements, the applicator assembly with the cavity, the second reservoir assembly, the surrounding sidewall, and the turn knob extension.

In addition, FIG. 20 shows an upper perspective view of the second alternative embodiment 52 of the fluid dispenser that includes the plurality of bristle elements 350 with a cross section of the cover 380 over the plurality of bristle elements 350, the applicator assembly 315 with the cavity 330, the second reservoir assembly 67, the surrounding sidewall 75, and the turn knob extension 299.

Figure 21:
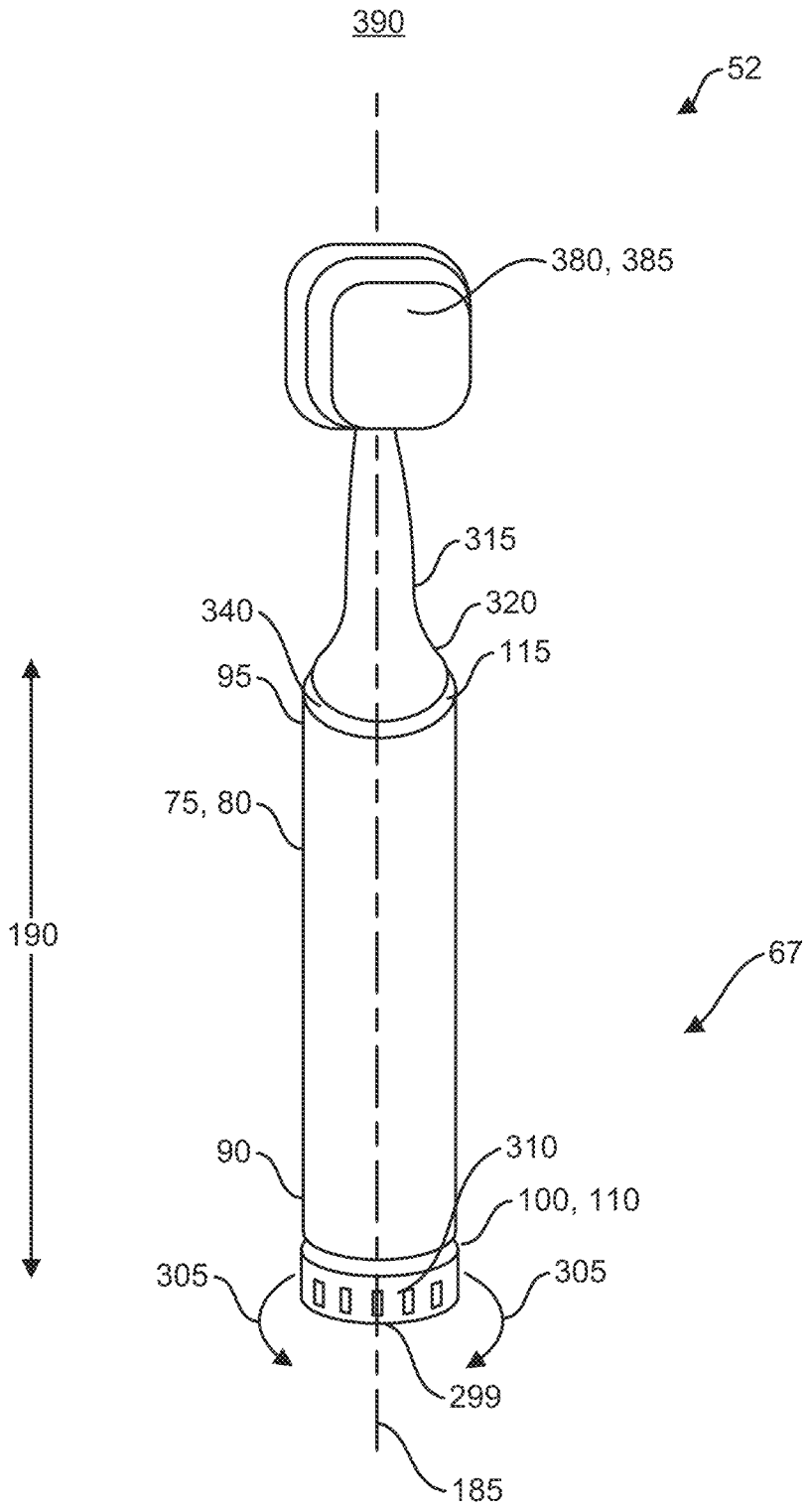
FIG. 21 shows an upper perspective view of the second alternative embodiment of the fluid dispenser that includes the plurality of bristle elements (not shown) with the outer surface of the cover over the plurality of bristle elements, the applicator assembly, the second reservoir assembly, the surrounding sidewall, and the turn knob extension.

Further, FIG. 21 shows an upper perspective view of the second alternative embodiment 52 of the fluid dispenser that includes the plurality of bristle elements 350 (not shown) with the outer surface of the cover 380 over the plurality of bristle elements 350, the applicator assembly 315, the second reservoir assembly 67, the surrounding sidewall 75, and the turn knob extension 299.

Figure 22:
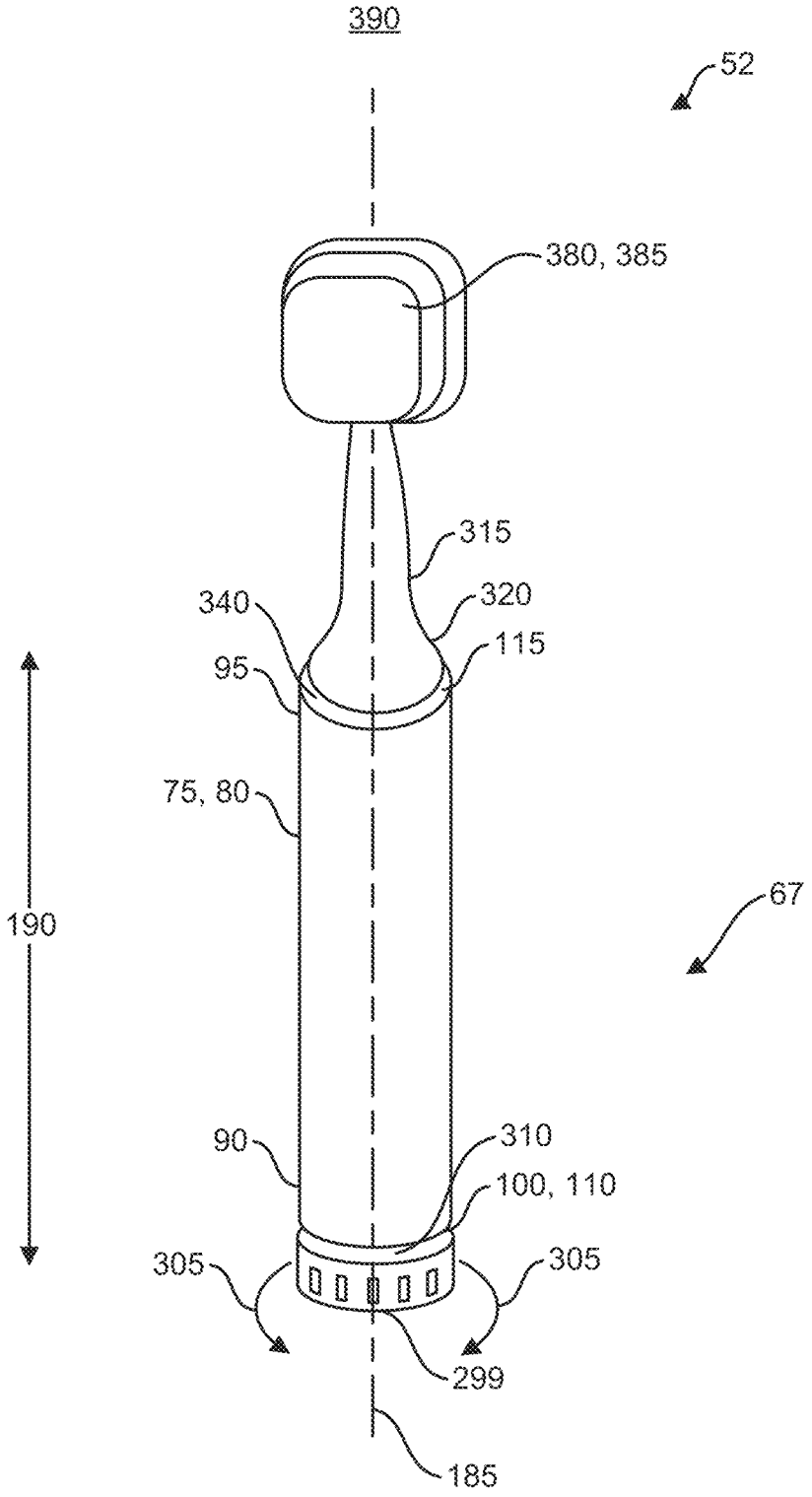
FIG. 22 shows another upper perspective view of the second alternative embodiment of the fluid dispenser that includes the plurality of bristle elements (not shown) with the outer surface of the cover over the plurality of bristle elements, the applicator assembly, the second reservoir assembly, the surrounding sidewall, and the turn knob extension.

Next, FIG. 22 shows another upper perspective view of the second alternative embodiment 52 of the fluid dispenser that includes the plurality of bristle elements 350 (not shown) with the outer surface of the cover 380 over the plurality of bristle elements 350, the applicator assembly 315, the second reservoir assembly 67, the surrounding sidewall 75, and the turn knob extension 299.

Figure 23:
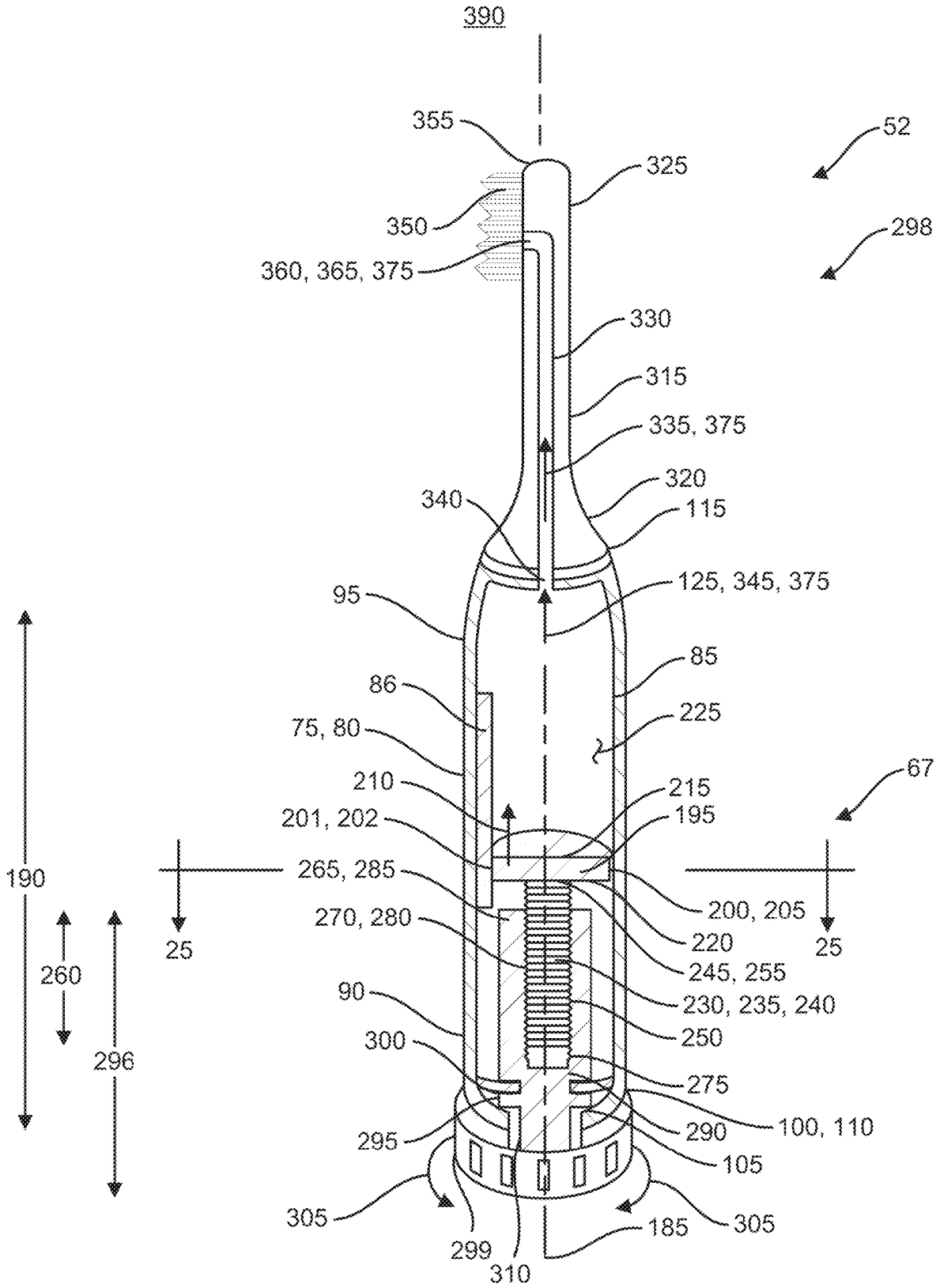
FIG. 23 shows a cross sectional view of the second alternative embodiment of the fluid dispenser that includes the plurality of bristle elements, the applicator assembly with the cavity, the second reservoir assembly, the surrounding sidewall, the variable second reservoir interior volume, the element having movement on the first threaded cylinder that is threadably engaged to the second threaded cylinder that is manually rotated by the turn knob extension, with the first threaded cylinder in the retracted state.

Continuing, FIG. 23 shows a cross sectional view of the second alternative embodiment 52 of the fluid dispenser that includes the plurality of bristle elements 350, the applicator assembly 315 with the cavity 330, the second reservoir assembly 67, the surrounding sidewall 75, the variable second reservoir interior volume 225, the element 195 having movement 210 on the first threaded cylinder 230 that is threadably engaged 280 to the second threaded cylinder 265 that is manually rotated 305 by the turn knob extension 299, with the first threaded cylinder 230 in the retracted state 298.

Figure 24:
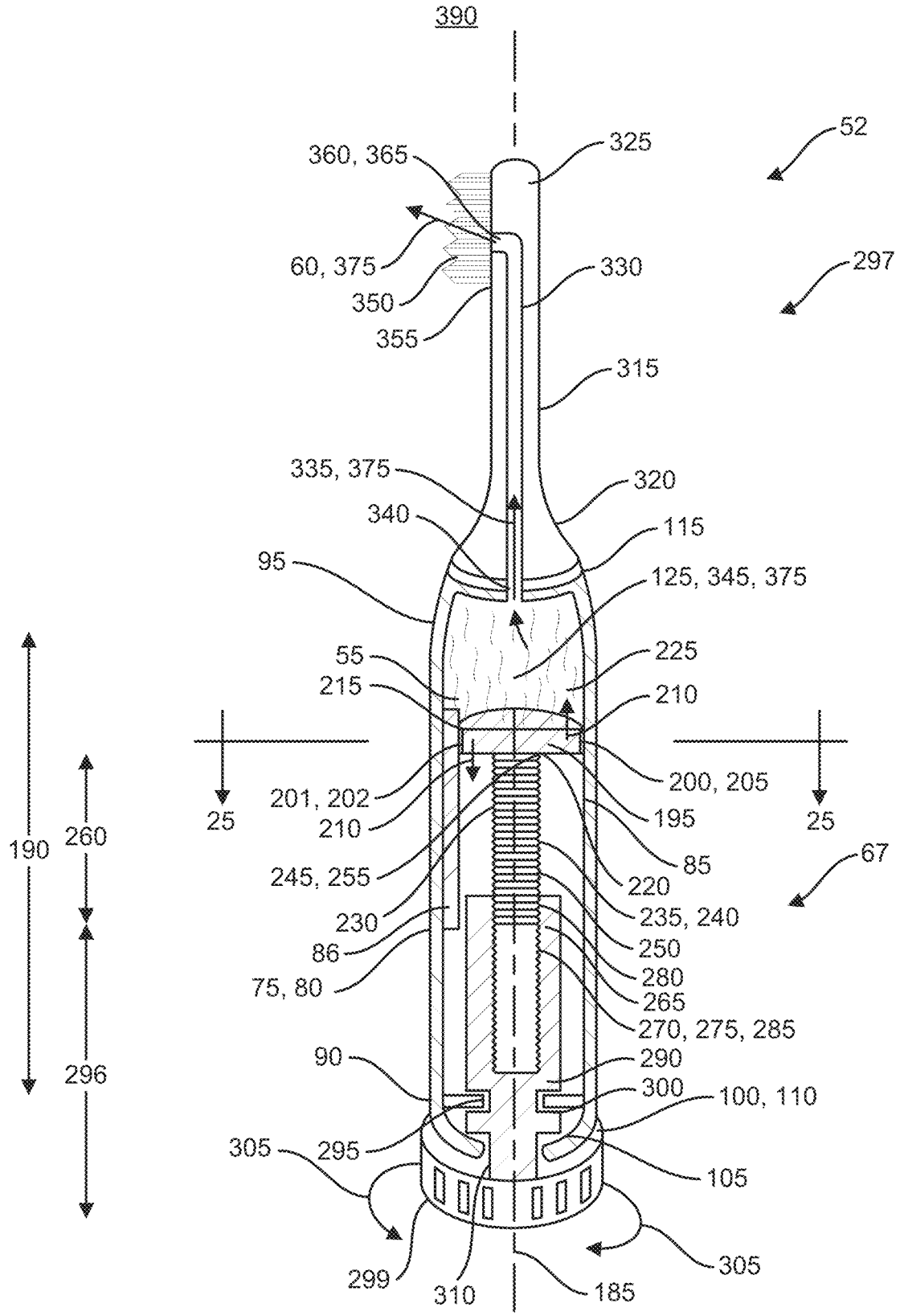
FIG. 24 shows a cross sectional view of the second alternative embodiment of the fluid dispenser that includes the plurality of bristle elements, the applicator assembly with the cavity, the second reservoir assembly, the surrounding sidewall, the variable second reservoir interior volume, the element having movement on the first threaded cylinder that is threadably engaged to the second threaded cylinder that is manually rotated by the turn knob extension, with the first threaded cylinder in the extended state that reduces the variable second reservoir interior to manually force the selected fluid coming out the discharge port within the plurality of bristles via manually turning the knob extension.

Next, FIG. 24 shows a cross sectional view of the second alternative embodiment 52 of the fluid dispenser that includes the plurality of bristle elements 350, the applicator assembly 315 with the cavity 330, the second reservoir assembly 67, the surrounding sidewall 75, the variable second reservoir interior volume 225, the element 195 having movement 210 on the first threaded cylinder 230 that is threadably engaged 280 to the second threaded cylinder 265 that is manually rotated 305 by the turn knob extension 299, with the first threaded cylinder 230 in the extended state 297 that reduces the variable second reservoir interior volume 225 to manually force the selected fluid 55 coming out the discharge port 360 within the plurality of bristles 350 via manually turning 305 the knob extension 299.

Figure 25:
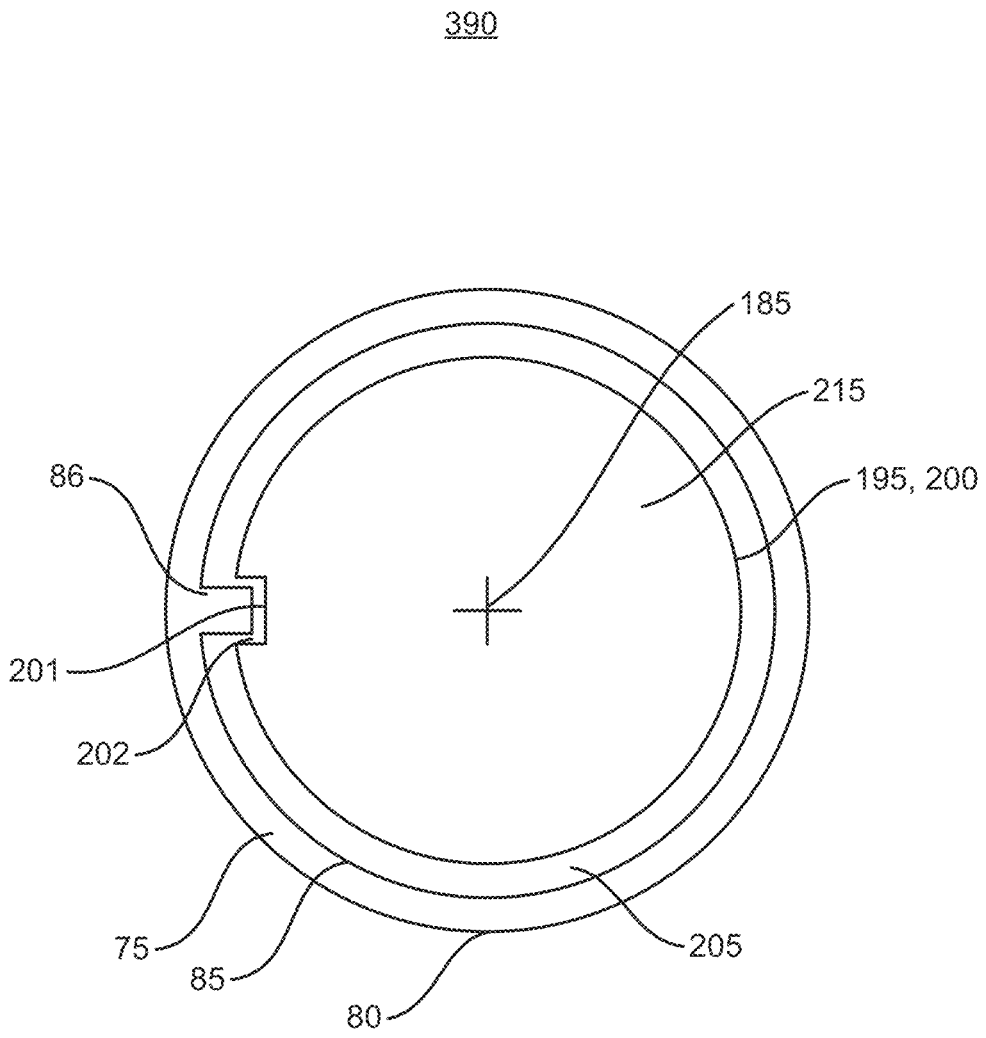

Further, FIG. 25 is cross sectional view 25-25 from FIG. 24, wherein FIG. 25 shows the element 195 disposed within the inner surface 85 of the surrounding sidewall 75 with an anti-rotation key slot 201 in the element 195 outer periphery 200 that is slidably engaged 205 to the key 86 that is disposed on the inner surface 85 of the surrounding sidewall 75.

Figure 26:
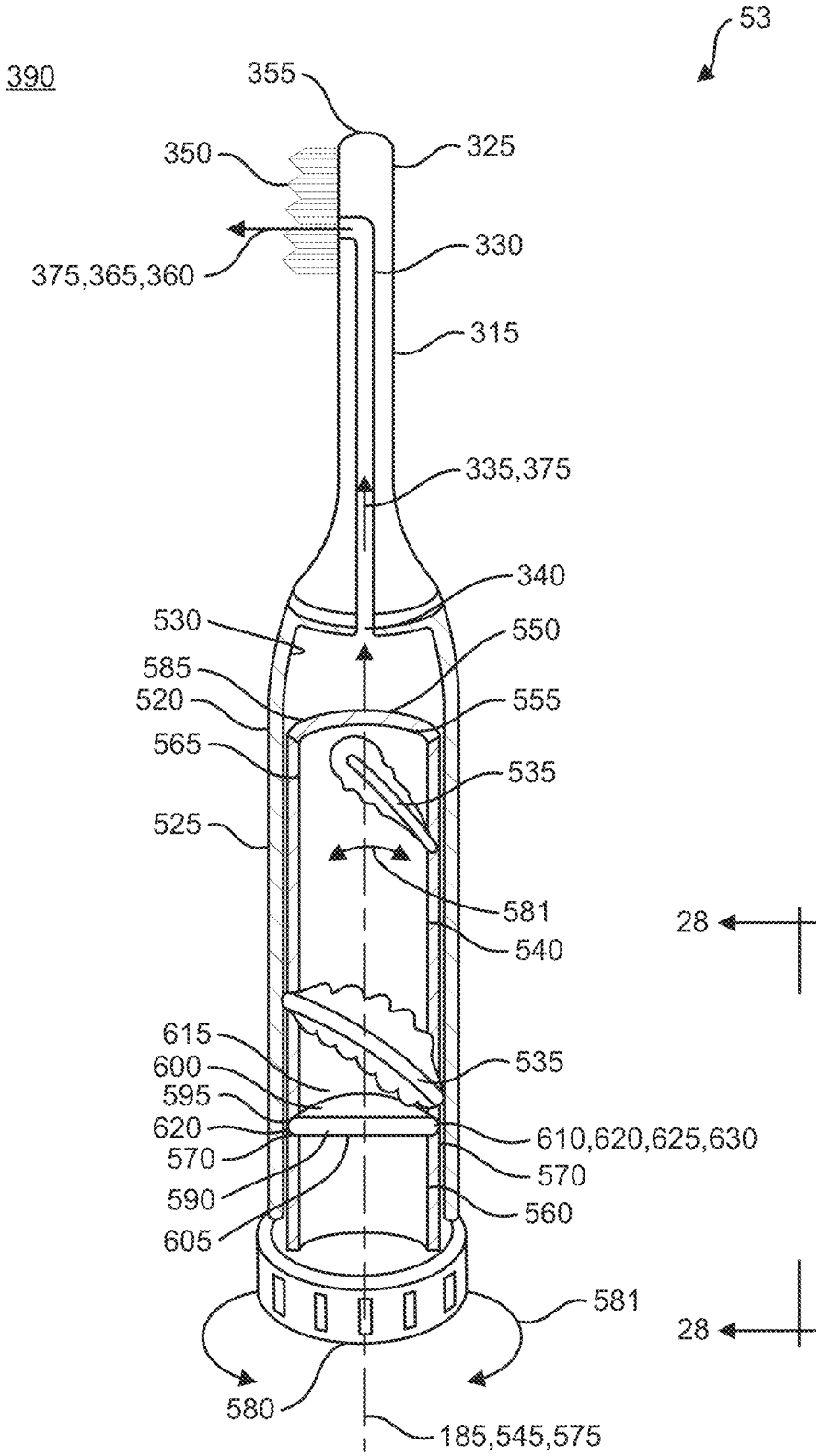
FIG. 26 shows a cross sectional view of the third alternative embodiment of the fluid dispenser that includes the plurality of bristle elements, the applicator assembly with the cavity, the third surrounding sidewall, the interior volume of the third surrounding sidewall, the disc having movement along the sleeve lengthwise axis within the third surrounding sidewall with the disc shown in the lower position, based on manual rotation of the manual grasping extension.

Continuing, FIG. 26 shows a cross sectional view of the third alternative embodiment 53 of the fluid dispenser that includes the plurality of bristle elements 350, the applicator assembly 315 with the cavity 330, the third surrounding sidewall 520, the interior volume of the third surrounding sidewall 520, the disc 590 having movement 581 along the sleeve lengthwise axis 545 within the third surrounding sidewall 520 with the disc 590 shown in the lower position, based on manual rotation 581 of the manual grasping extension 580.

Figure 27:
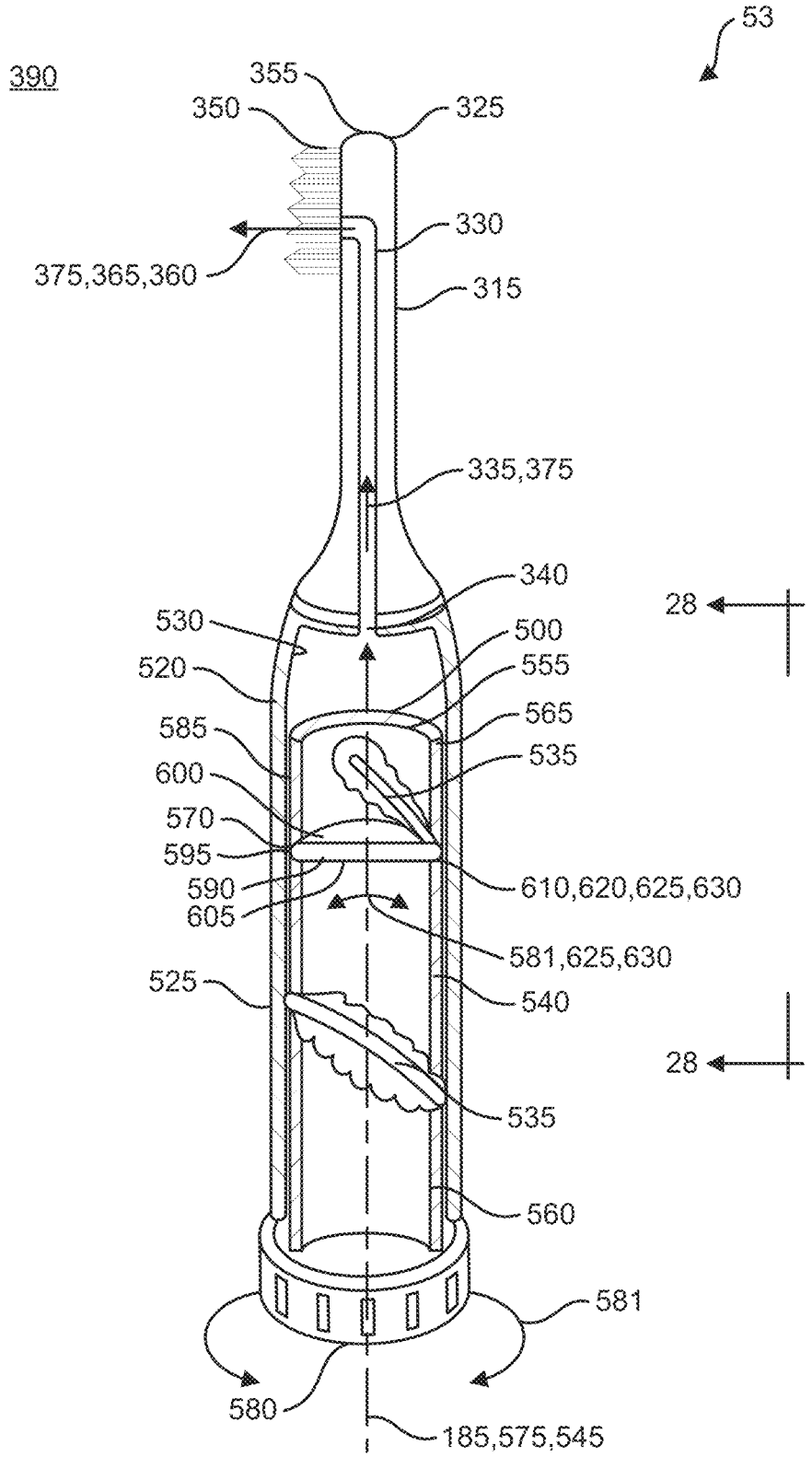
FIG. 27 shows a cross sectional view of the third alternative embodiment of the fluid dispenser that includes the plurality of bristle elements, the applicator assembly with the cavity, the third surrounding sidewall, the interior volume of the third surrounding sidewall, the disc having movement along the sleeve lengthwise axis within the third surrounding sidewall with the disc shown in the upper position, based on manual rotation of the manual grasping extension that reduces the interior volume of the third surrounding sidewall.

Next, FIG. 27 shows a cross sectional view of the third alternative embodiment 53 of the fluid dispenser that includes the plurality of bristle elements 350, the applicator assembly 315 with the cavity 330, the third surrounding sidewall 520, the interior volume of the third surrounding sidewall 520, the disc 590 having movement 581 along the sleeve 540 lengthwise axis 545 within the third surrounding sidewall 520 with the disc 590 shown in the upper position, based on manual rotation 581 of the manual grasping extension 580 that reduces the interior volume of the third surrounding sidewall 520.

Figure 28:
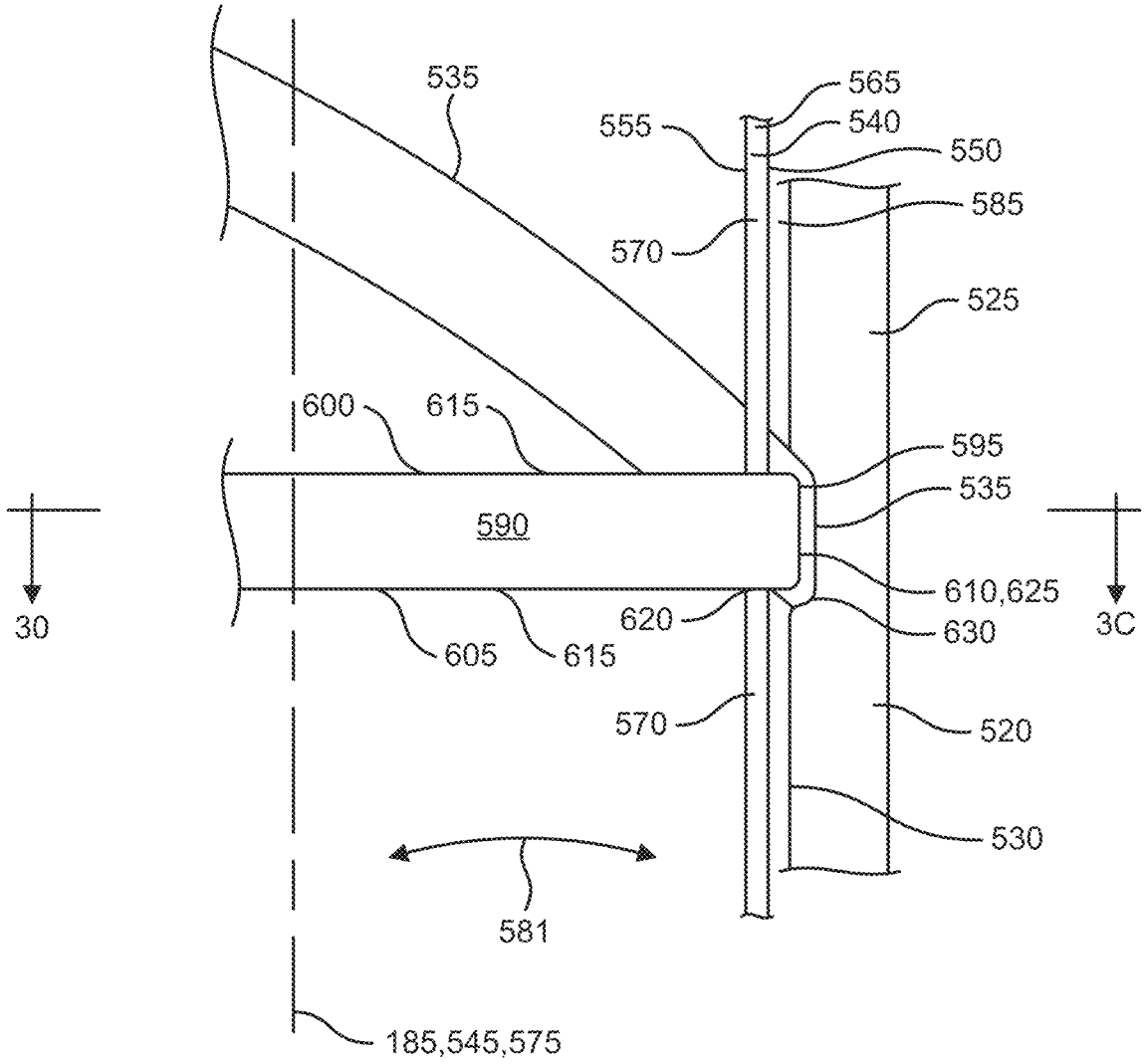

Further, FIG. 28 is cross sectional view 28-28 from FIGS. 26 and 27, wherein FIG. 28 shows a close-up of the assembly of the disc 590 that has a protrusion 610 that is slidably engaged 630 to the helical wrap channel 535, wherein the lengthwise slot 570 in the sleeve 540 moves the protrusion 610 of the disc 590 along the sleeve 540 lengthwise axis 545 via the protrusion 610 sliding within the helical channel 535 as the sleeve 540 rotates 581 within the third surrounding sidewall 520 through the manual rotation 581 of the manual grasping extension 580.

Figure 29:
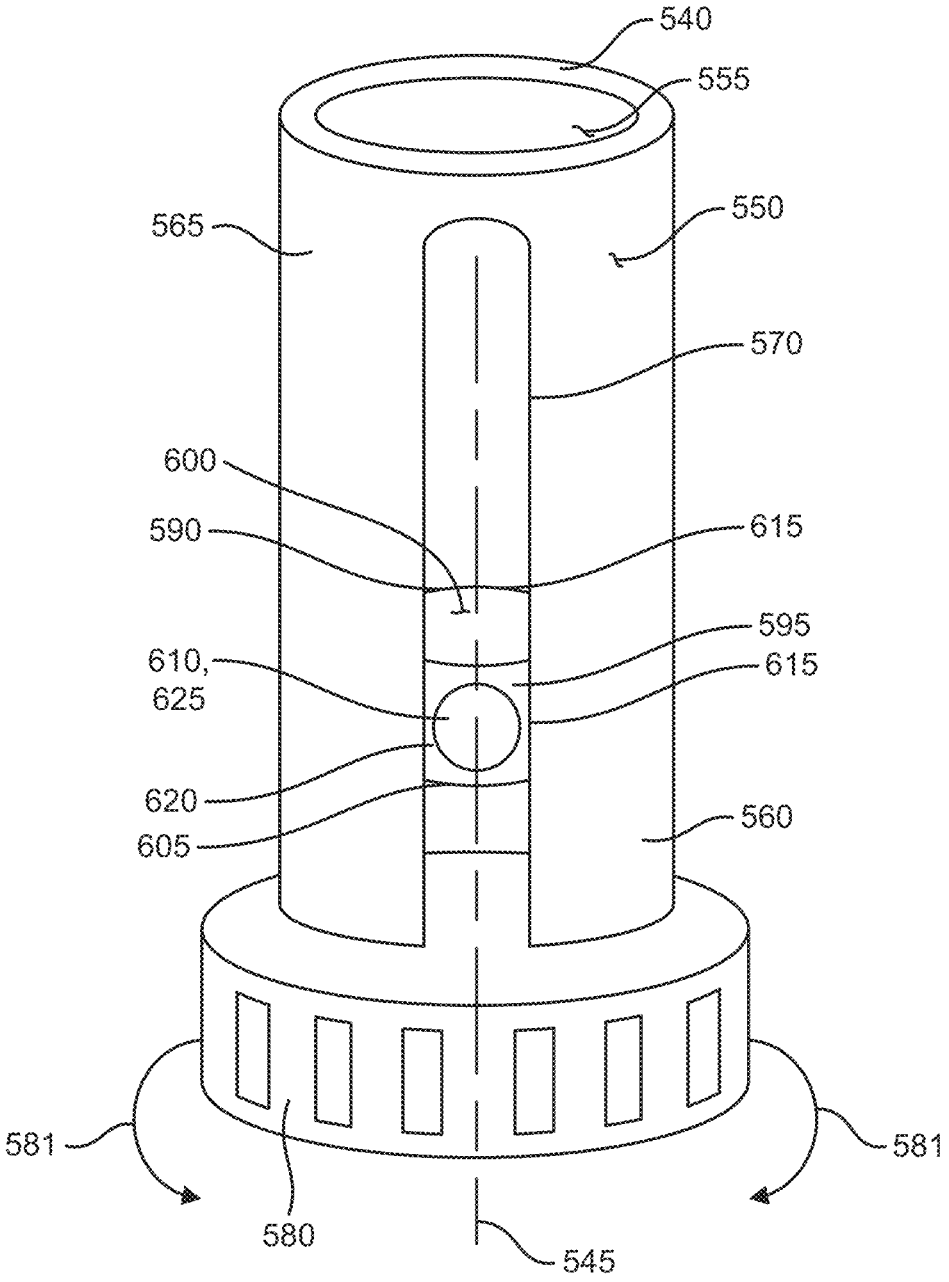
FIG. 29 shows a side elevation view of the sleeve that is rotationally affixed to the manual grasping extension with the sleeve slot shown that has the protrusion projecting therethrough the sleeve slot with the disc shown in the background.

Also, FIG. 29 shows a side elevation view of the sleeve 540 that is rotationally affixed to the manual grasping extension 580 with the sleeve slot 570 shown that has the protrusion 610 projecting therethrough 625 the sleeve slot 570 with the disc 590 shown in the background.

Figure 30:
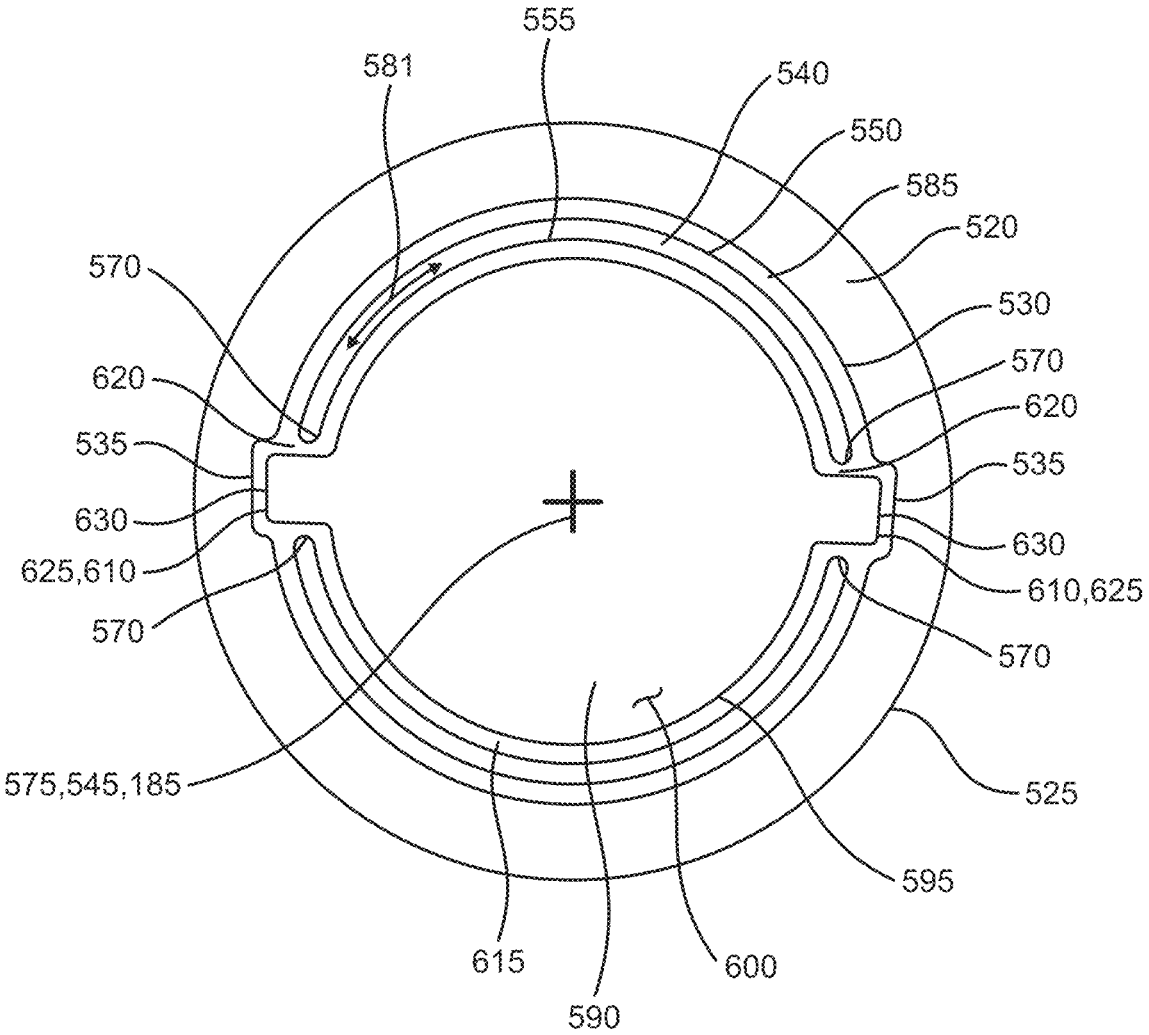

In addition, FIG. 30 is view 30-30 from FIG. 28, wherein FIG. 30 shows a close-up of the assembly of the disc 590 that has the protrusion 610 that is slidably engaged to 630 the helical wrap channel 535, wherein the lengthwise slot 570 in the sleeve 540 moves 620 the protrusion 610 of the disc 590 along the sleeve 540 lengthwise axis 545 via the protrusion 610 sliding 630 within the helical channel 535 as the sleeve 540 rotates 585 within the third surrounding sidewall 520 through the manual rotation 581 of the manual grasping extension 580 (not shown).

Figure 31:
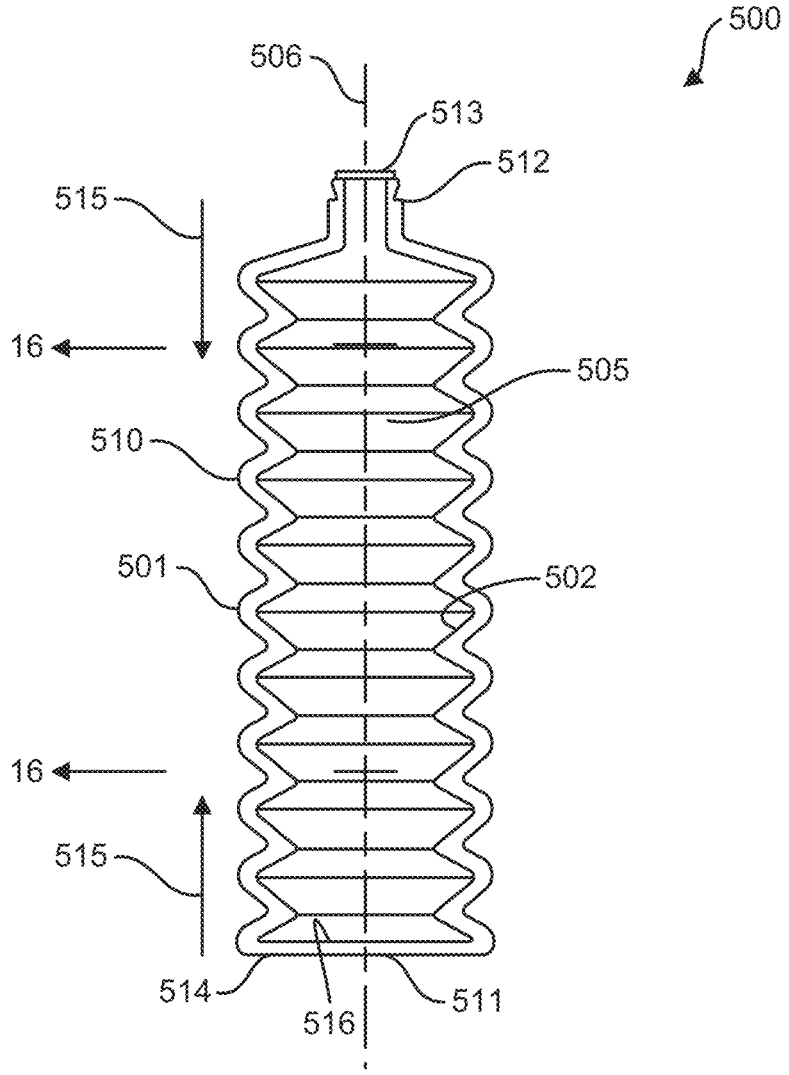
FIG. 31 shows a cross sectional side elevation view of the insert cartridge that has a collapsible accordion type surrounding sidewall that also includes a nozzle tip and a base with all defining the interior volume of the cartridge.

Next, FIG. 31 shows a cross sectional side elevation view of the insert cartridge 500 that has a collapsible accordion type surrounding sidewall 510 that also includes a nozzle tip 512 and a base 511 with all defining the interior volume 505 of the cartridge 500.

Figure 32:
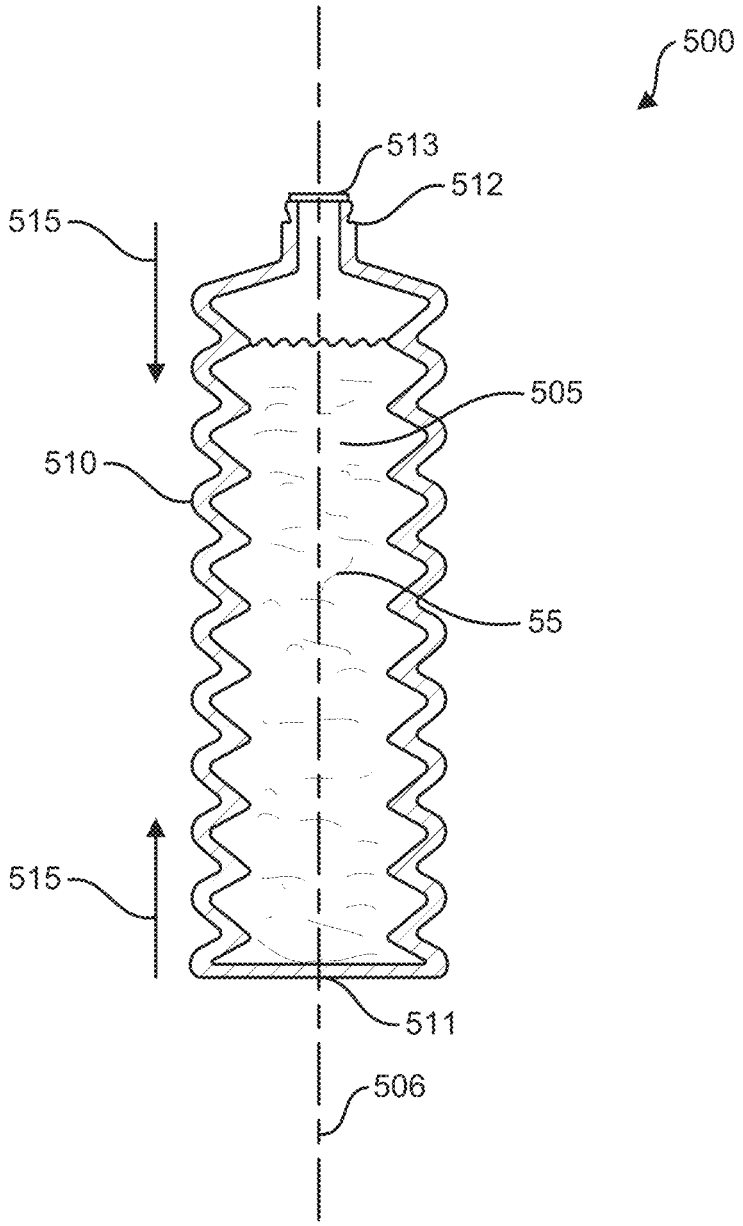
FIG. 32 shows a cross sectional side elevation view of the insert cartridge that has a collapsible accordion type surrounding sidewall that also includes a nozzle tip and a base with all defining the interior volume of the cartridge, wherein the interior volume is filled with the selected fluid.

Additionally FIG. 32 shows a cross sectional side elevation view of the insert cartridge 500 that has a collapsible accordion type surrounding sidewall 510 that also includes a nozzle tip 512 and the base 511 with all defining the interior volume 505 of the cartridge 500, wherein the interior volume 505 is filled with the selected fluid 55.

Figure 33:
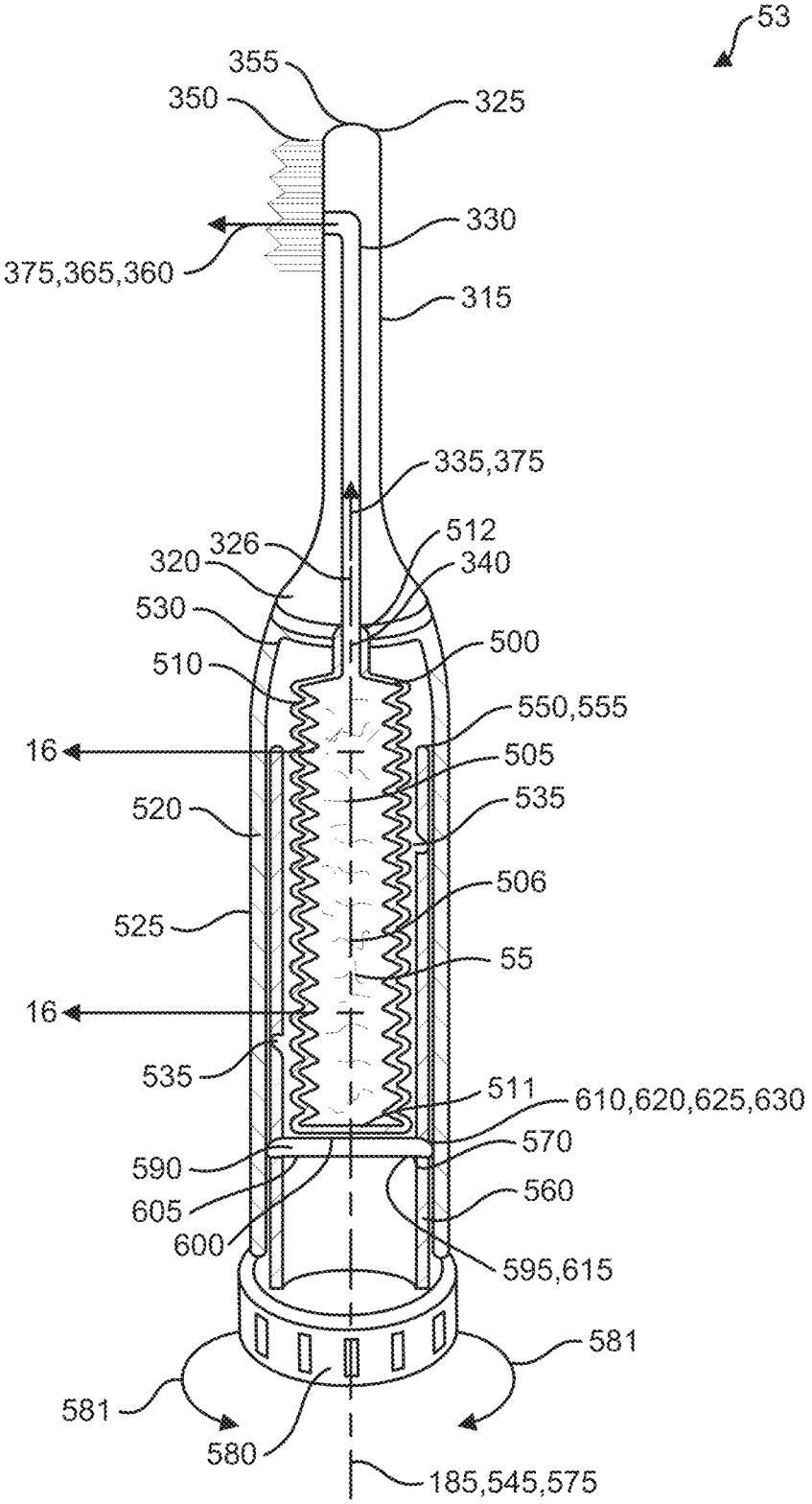
FIG. 33 shows a cross sectional view of the third alternative embodiment of the fluid dispenser that includes the plurality of bristle elements, the applicator assembly with the cavity, the third surrounding sidewall, the interior volume of the third surrounding sidewall, the disc having movement along the sleeve lengthwise axis within the third surrounding sidewall with the disc shown in the lower position, based on manual rotation of the manual grasping extension that reduces the interior volume of the third surrounding sidewall, further the insert cartridge is inserted above the disc within the third surrounding sidewall with the base of the insert cartridge adjacent to the disc, with the insert cartridge interior filled with the selected fluid.

Moving onward, FIG. 33 shows a cross sectional view of the third alternative embodiment 53 of the fluid dispenser that includes the plurality of bristle elements 350, the applicator assembly 315 with the cavity 330, the third surrounding sidewall 520, the interior volume of the third surrounding sidewall 520, the disc 590 having movement 581 along the sleeve 540 lengthwise axis 545 within the third surrounding sidewall 520 with the disc 590 shown in the lower position, based on manual rotation 581 of the manual grasping extension 580 that reduces the interior volume of the third surrounding sidewall 520, further the insert cartridge 500 is inserted above the disc 590 within the third surrounding sidewall 520 with the base 511 of the insert cartridge 500 adjacent to the disc 590, with the insert cartridge 500 interior volume 505 filled with the selected fluid 55.

Figure 34:
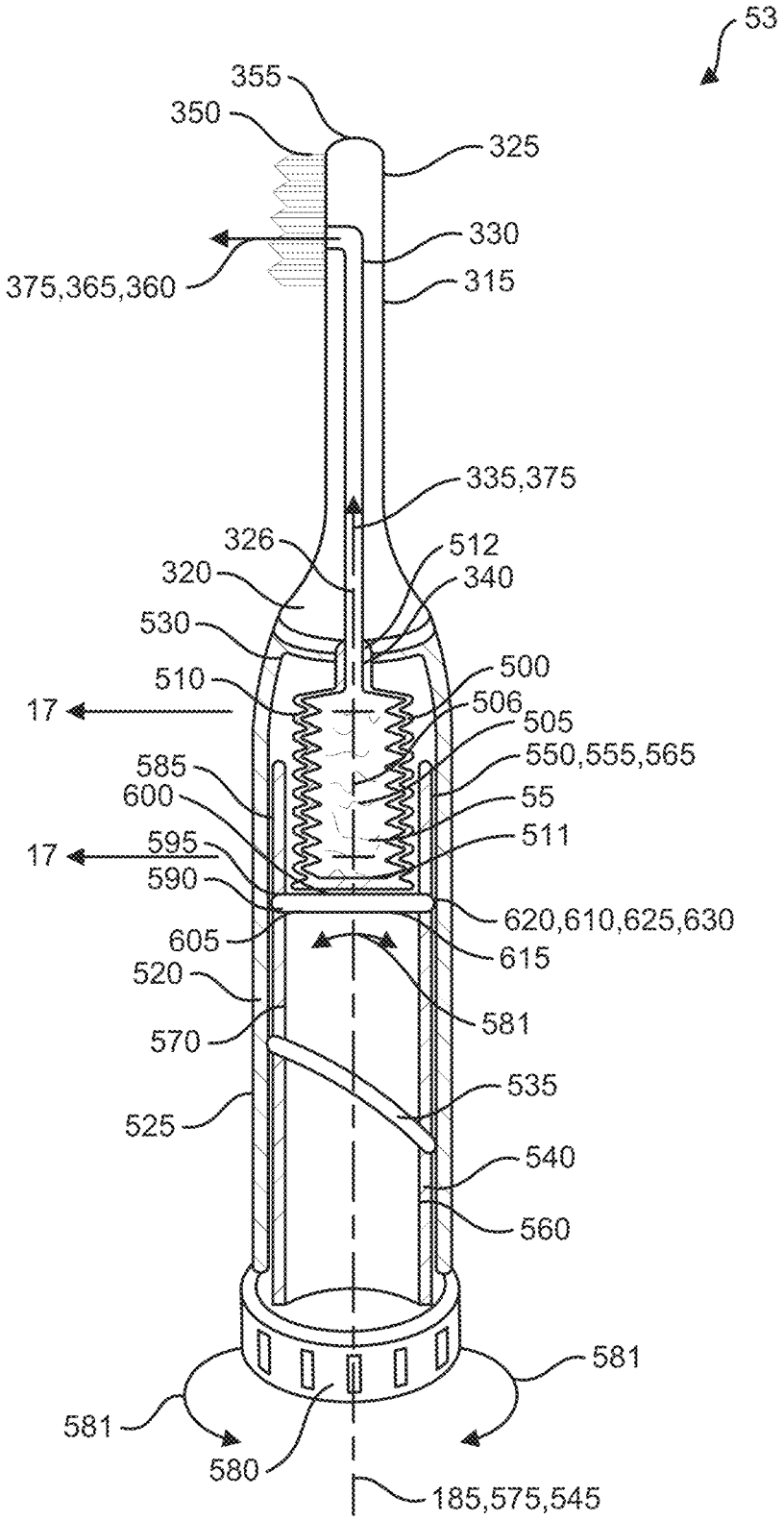
FIG. 34 shows a cross sectional view of the third alternative embodiment of the fluid dispenser that includes the plurality of bristle elements, the applicator assembly with the cavity, the third surrounding sidewall, the interior volume of the third surrounding sidewall, the disc having movement along the sleeve lengthwise axis within the third surrounding sidewall with the disc shown in the upper position, based on manual rotation of the manual grasping extension that reduces the interior volume of the third surrounding sidewall, further the insert cartridge is inserted above the disc within the third surrounding sidewall with the base of the insert cartridge adjacent to the disc, with the insert cartridge interior filled with the selected fluid, wherein the reduced insert cartridge interior volume manually forces the selected fluid to come out the discharge port within the plurality of bristles via manually turning the grasping extension.

Further, FIG. 34 shows a cross sectional view of the third alternative embodiment 53 of the fluid dispenser that includes the plurality of bristle elements 350, the applicator assembly 315 with the cavity 330, the third surrounding sidewall 520, the interior volume of the third surrounding sidewall 520, the disc 590 having movement 581 along the sleeve 540 lengthwise axis 545 within the third surrounding sidewall 520 with the disc 590 shown in the upper position, based on manual rotation 581 of the manual grasping extension 580 that reduces the interior volume of the third surrounding sidewall 520, further the insert cartridge 500 is inserted above the disc 590 within the third surrounding sidewall 520 with the base 511 of the insert cartridge 500 adjacent to the disc 590, with the insert cartridge 500 interior volume 505 filled with the selected fluid 55, wherein the reduced insert cartridge 500 interior volume 505 manually forces the selected fluid 55 to come out 375 the discharge port 360 within the plurality of bristles 350 via manually turning 581 the grasping extension 580.

Figure 35:
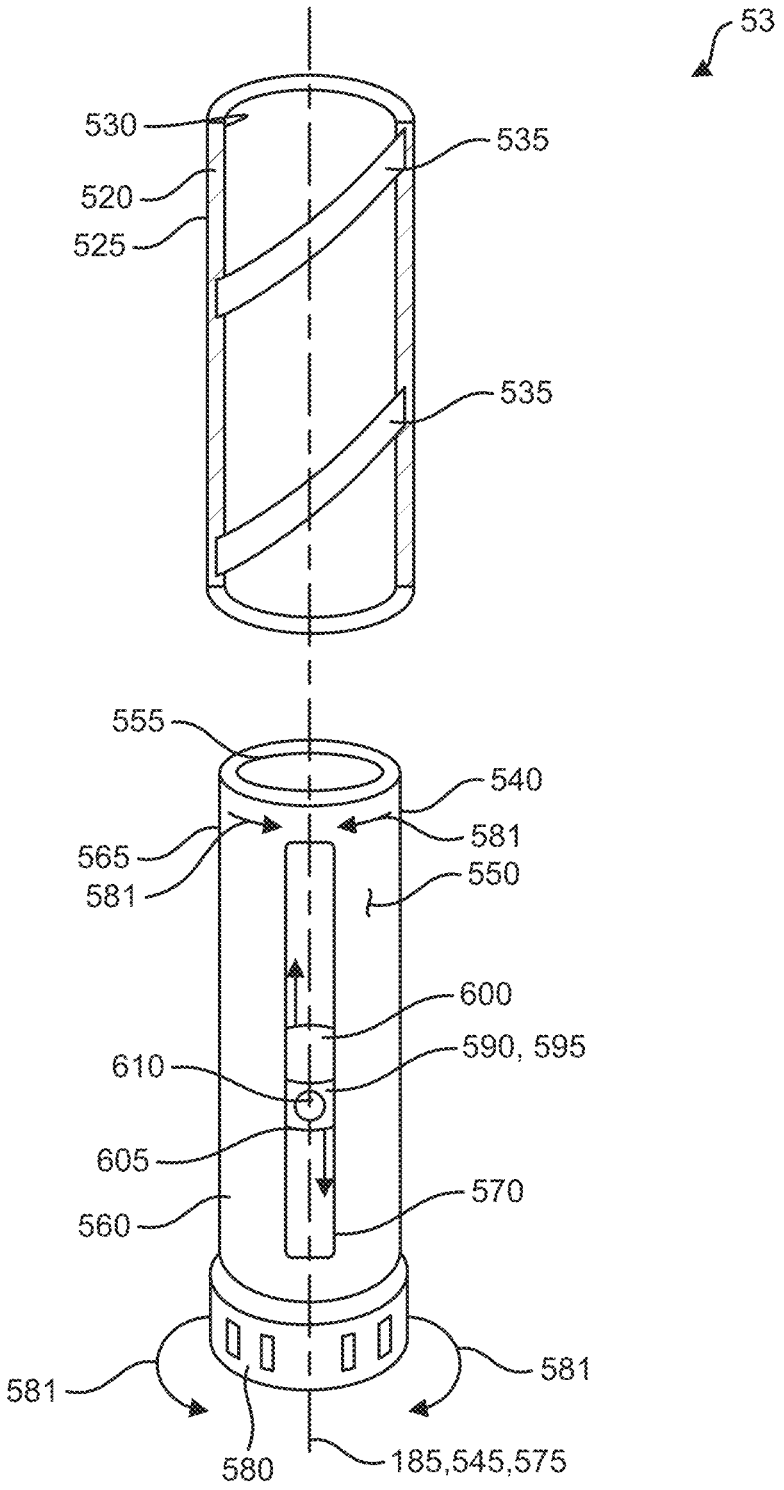
FIG. 35 shows an exploded perspective view of the third alternative embodiment of the fluid dispenser elements of the third surrounding sidewall with the helical channel disposed upon the inside surface of the third surrounding sidewall and further the sleeve with the slot that the disc protrusion slides within, wherein the bottom of the sleeve is rotationally affixed to the manual grasping extension, in addition it is shown that the third surrounding sidewall that slides over the sleeve, such that the third surrounding sidewall inside surface is in slidable contact with to the outer surface of the sleeve.

Also, FIG. 35 shows an exploded perspective view of the third alternative embodiment 53 of the fluid dispenser elements of the third surrounding sidewall 520 with the helical channel 535 disposed upon the inside surface 530 of the third surrounding sidewall 520 and further the sleeve 540 with the slot 570 that the disc 590 protrusion 610 slides 620 within, wherein the bottom of the sleeve 540 is rotationally 581 affixed to the manual grasping extension 580, in addition it is shown that the third surrounding sidewall 520 that slides over the sleeve 540, such that the third surrounding sidewall 520 inside surface 530 is in slidable contact 585 with to the outer surface 550 of the sleeve 540.

Figure 36:
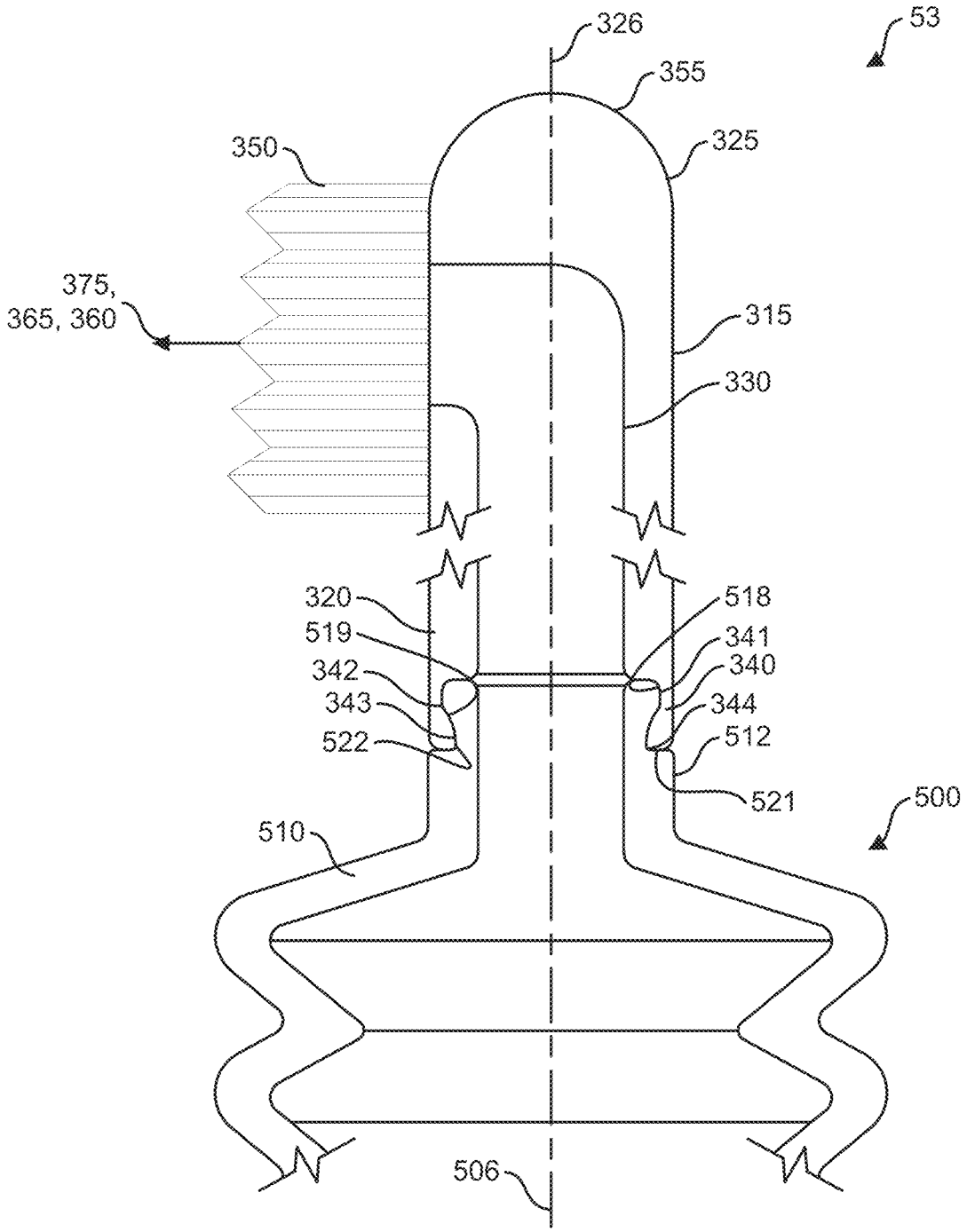
FIG. 36 shows a cross section of the proximal end portion of the applicator assembly interfacing with the deformable nozzle tip of the collapsible accordion type sidewall cartridge, specifically showing the axial fit interface, the inner surface, the axial fit interference interface, the inner surface, the inner ridge, the elastically deformable annulus, the adjacent gradual radius, the adjacent sharp radius, all of the fluid tight coupling.

Further, FIG. 36 shows a cross section of the proximal end portion 320 of the applicator assembly 315 interfacing with the deformable nozzle tip 512 of the collapsible accordion type sidewall cartridge 500, specifically showing the axial fit interface 521, the inner surface 522, the axial fit interference interface 344, the inner surface 343, the inner ridge 342, the elastically deformable annulus 341, the adjacent gradual radius 518, the adjacent sharp radius 519, all of the fluid tight coupling 340.

Figure 37:
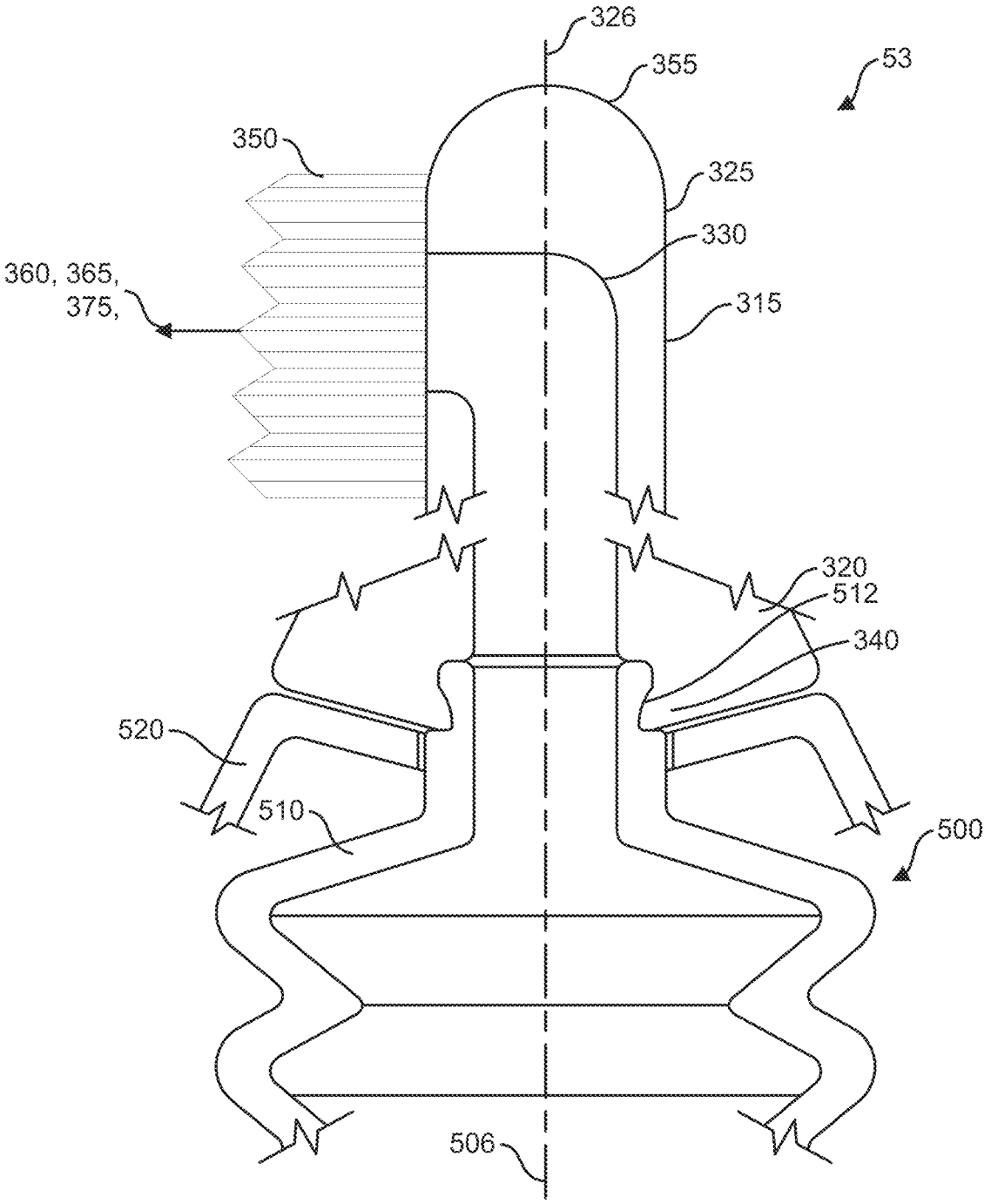
FIG. 37 shows essentially the cross section as shown in FIG. 36 with the addition of the third surrounding sidewall of the third alternative embodiment that is adjacent to the proximal end portion of the applicator assembly.

Next, FIG. 37 shows essentially the cross section as shown in FIG. 36 with the addition of the third surrounding sidewall 520 of the third alternative embodiment 53 that is adjacent to the proximal end portion 320 of the applicator assembly 315.

Continuing, FIG. 38 again shows essentially the cross section as shown in FIG. 36 with the addition of the selected fluid 55 being moved 375 and discharged through discharge port 360 after being pushed through the pressure openable film seal 513 with the third alternative embodiment 53 of the fluid dispenser being in use.

Figure 39:
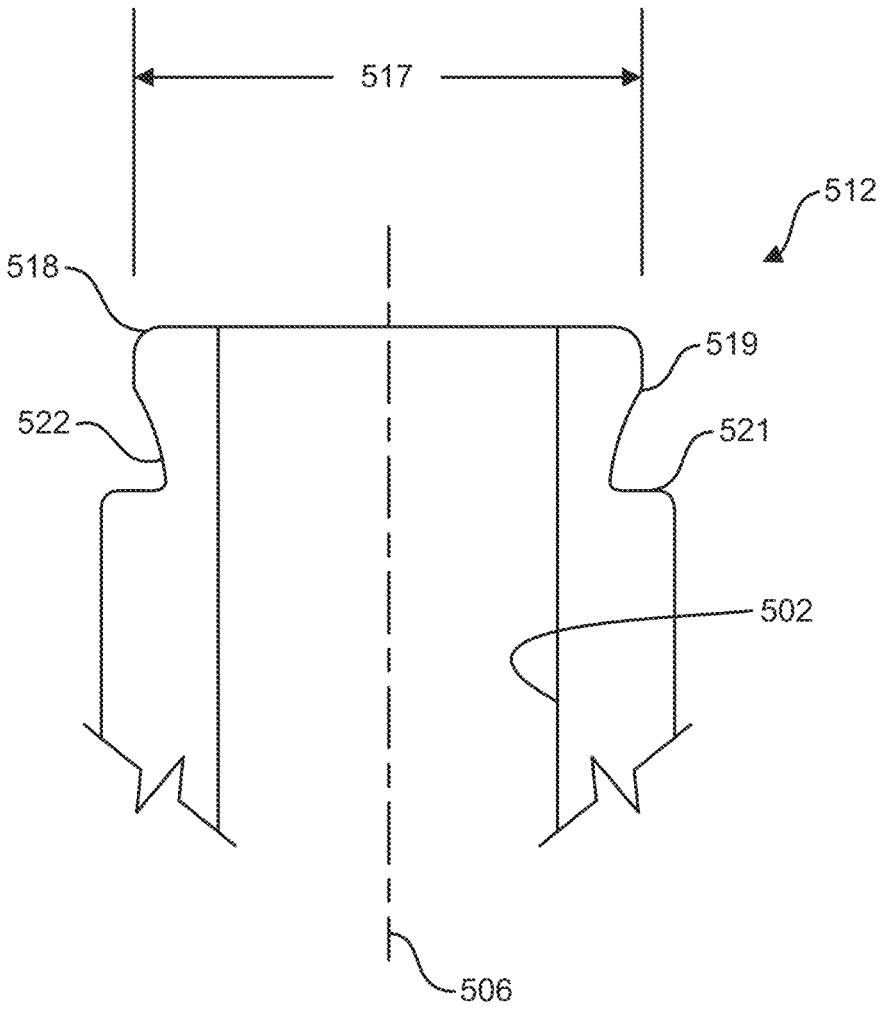
FIG. 39 shows a cross section detail of the deformable nozzle tip of the collapsible accordion type sidewall cartridge, specifically showing the axial fit interface, the inner surface, the adjacent gradual radius, the adjacent sharp radius, and the outer surface of the deformable nozzle tip.

Moving onward, FIG. 39 shows a cross section detail of the deformable nozzle tip 512 of the collapsible accordion type sidewall cartridge 500, specifically showing the axial fit interface 521, the inner surface 522, the adjacent gradual radius 518, the adjacent sharp radius 519, and the outer surface 517 of the deformable nozzle tip 512.

Figure 40:
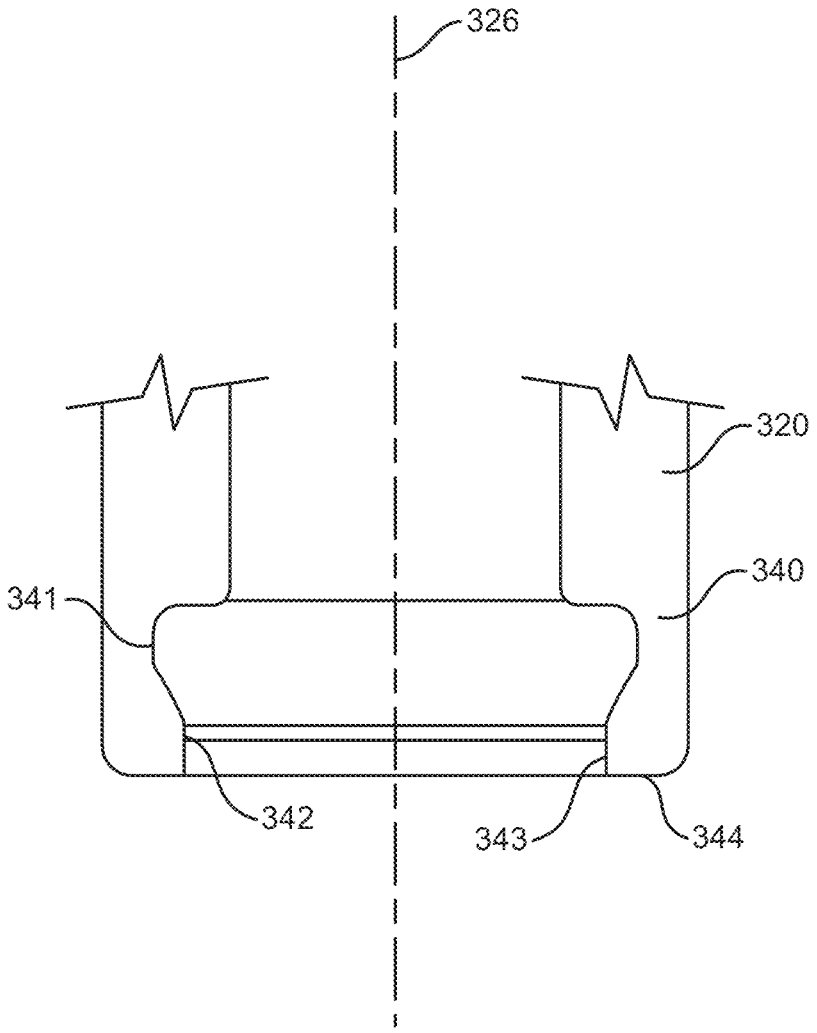
FIG. 40 shows a cross section detail of the proximal end portion of the applicator assembly, the axial fit interference interface, the inner surface, the inner ridge, the elastically deformable annulus, being a part of the fluid tight coupling.

Further, FIG. 40 shows a cross section detail of the proximal end portion 320 of the applicator assembly 315, the axial fit interference interface 344, the inner surface 343, the inner ridge 342, the elastically deformable annulus 341, being a part of the fluid tight coupling 340.

Figure 41:
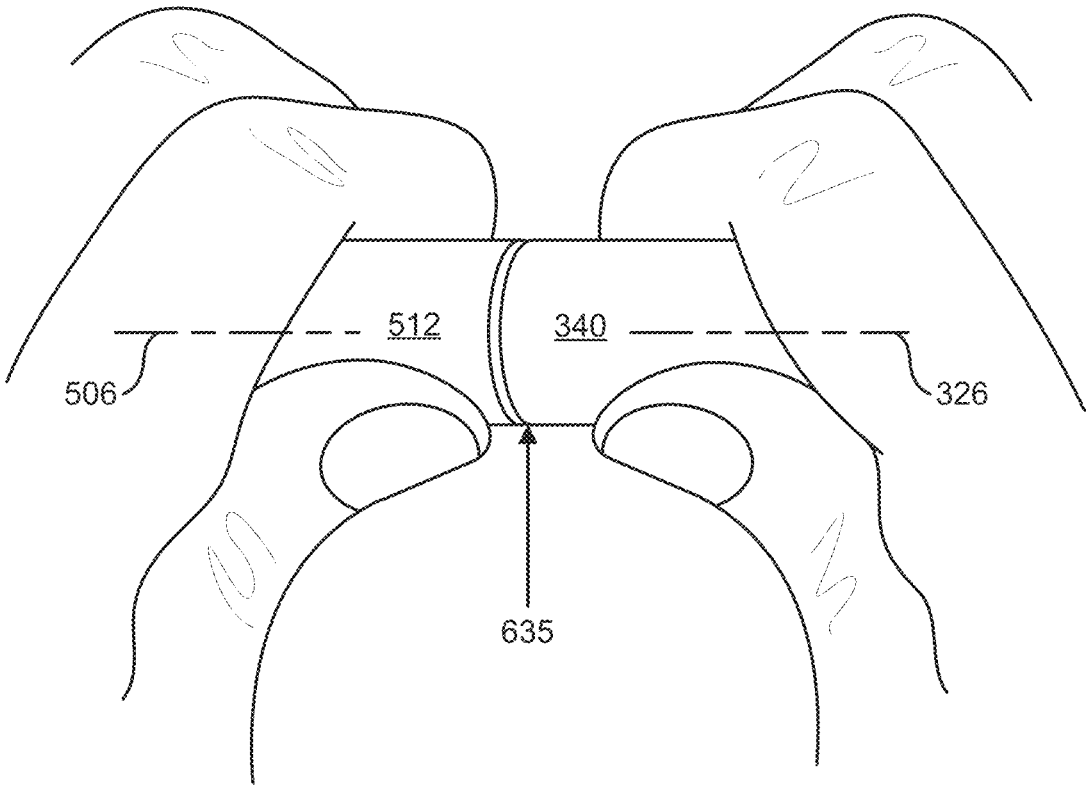
FIG. 41 shows an expanded view close up of the fluid tight coupling with the proximal end portion of the applicator assembly interfacing with the deformable nozzle tip of the collapsible accordion type sidewall cartridge, specifically showing the initial manual disengaging of the fluid tight coupling, via manually creating a perpendicular oriented disengaging force as between the proximal end portion and the deformable nozzle tip of the fluid tight coupling.

Continuing, FIG. 41 shows an expanded view close up of the fluid tight coupling 340 with the proximal end portion 320 of the applicator assembly 315 interfacing with the deformable nozzle tip 512 of the collapsible accordion type sidewall cartridge 500, specifically showing the initial manual disengaging of the fluid tight coupling 340, via manually creating the perpendicular oriented disengaging force 635 as between the proximal end portion 320 and the deformable nozzle tip 512 of the fluid tight coupling 340.

Figure 38:
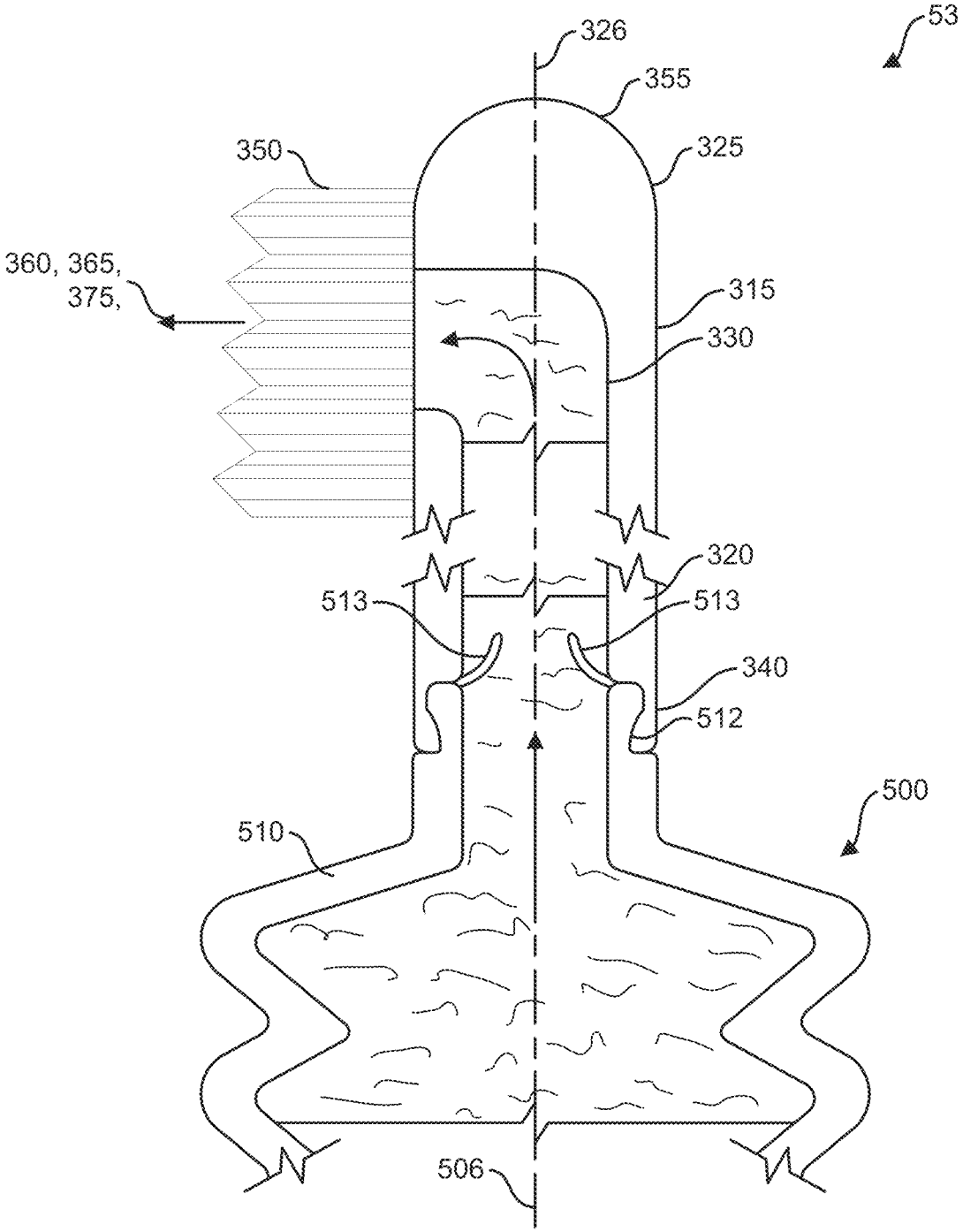
FIG. 38 again shows essentially the cross section as shown in FIG. 36 with the addition of the selected fluid being moved and discharged through discharge port after being pushed through the pressure openable film seal with the third alternative embodiment of the fluid dispenser being in use.
Figure 42:
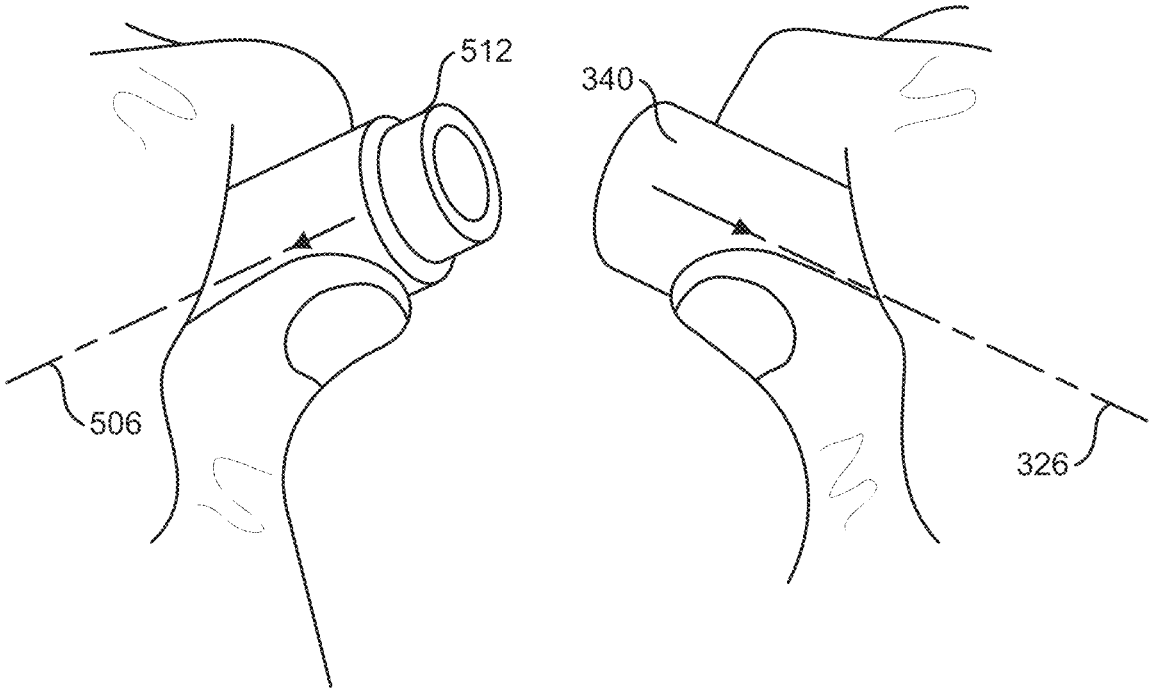
FIG. 42 shows an expanded view close up of the fluid tight coupling with the proximal end portion of the applicator assembly removably disengaged from the deformable nozzle tip of the collapsible accordion type sidewall cartridge, specifically showing the manual disengaging of the fluid tight coupling, via manually creating the perpendicular oriented disengaging force as shown in FIG. 41 as between the proximal end portion and the deformable nozzle tip of the fluid tight coupling by creating a bending moment perpendicular to the extension axis and to the longwise axis to effectively snap apart the adjacent gradual radius from the inner surface, note that for assembly purposes of the fluid tight coupling proximal end portion of the applicator assembly to the deformable nozzle tip of the collapsible accordion type sidewall cartridge, they are manually pushed together both along their respective extension axis and the longwise axis as best shown in FIGS. 36, 37, and 38.

Next, FIG. 42 shows an expanded view close up of the fluid tight coupling 340 with the proximal end portion 320 of the applicator assembly 315 removably disengaged from the deformable nozzle tip 512 of the collapsible accordion type sidewall cartridge 500, specifically showing the manual disengaging of the fluid tight coupling 340, via manually creating the perpendicular oriented disengaging force 635 as shown in FIG. 41 as between the proximal end portion 320 and the deformable nozzle tip 512 of the fluid tight coupling 340 by creating a bending moment perpendicular to the extension axis 326 and to the longwise axis 506 to effectively snap apart the adjacent gradual radius 518 from the inner surface 343, note that for assembly purposes of the fluid tight coupling 340 proximal end portion 320 of the applicator assembly 315 to the deformable nozzle tip 512 of the collapsible accordion type sidewall cartridge 500, they are manually pushed together both along their respective extension axis 326 and the longwise axis 506 as best shown in FIGS. 36, 37, and 38.

Figure 43:
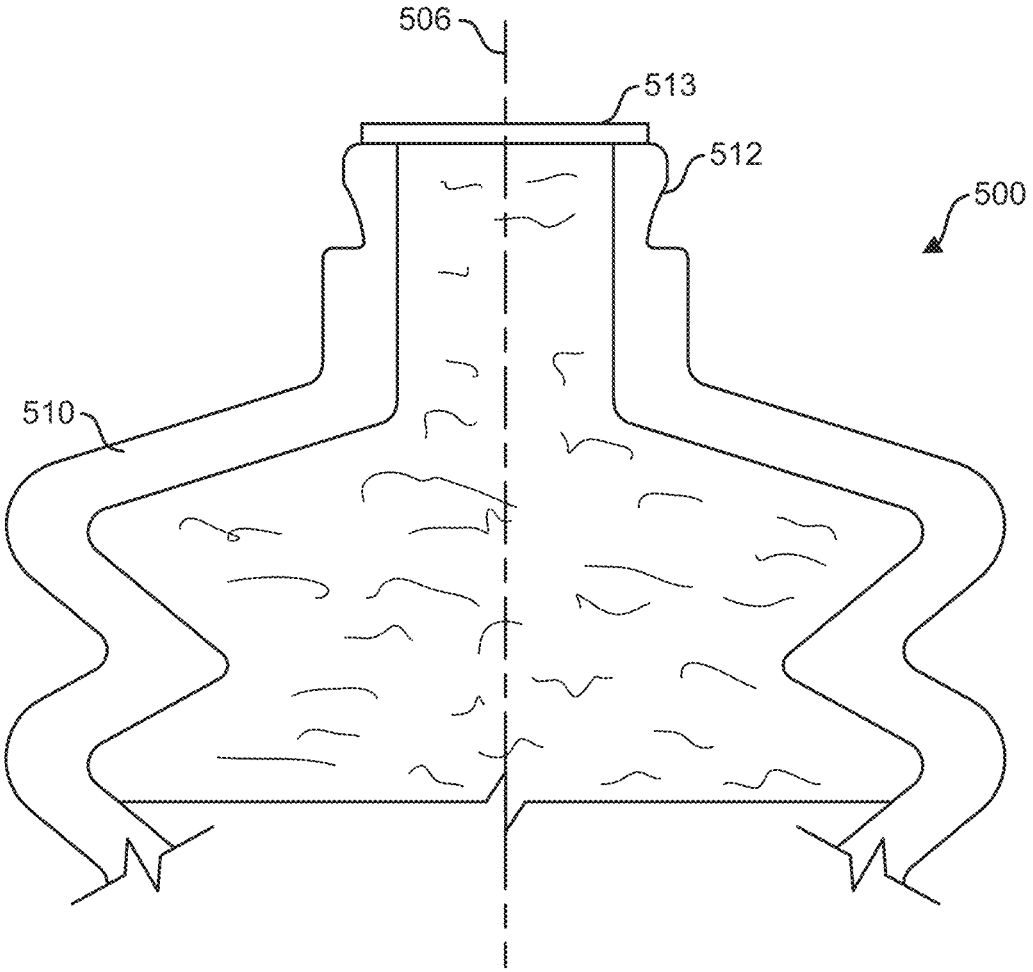
FIG. 43 shows the cross section of the deformable nozzle tip of the collapsible accordion type surrounding sidewall of the cartridge, with the addition of the selected fluid being disposed within the collapsible accordion type surrounding sidewall with the film seal disposed upon the deformable nozzle tip being in the configuration of the cartridge being sold separately as a refillable insert disposed within the inside surface of the third surrounding sidewall of the third alternative embodiment for the fluid dispenser being in use as shown in FIGS. 33 and 34.

Further, FIG. 43 shows the cross section of the deformable nozzle tip 512 of the collapsible accordion type surrounding sidewall 510 of the cartridge 500, with the addition of the selected fluid 55 being disposed within the collapsible accordion type surrounding sidewall 510 with the film seal 513 disposed upon the deformable nozzle tip 512 being in the configuration of the cartridge 500 being sold separately as a refillable insert disposed within the inside surface 530 of the third surrounding sidewall 520 of the third alternative embodiment 53 for the fluid dispenser being in use as shown in FIGS. 33 and 34.

Broadly, in looking at FIGS. 1 to 8, the present invention is the fluid dispenser 50 for manually applying the selected fluid 55 to a desired location, including the reservoir assembly 65 that is able to contain the selected fluid 55, the reservoir 65 includes a flexible resilient body portion 70 constructed of a surrounding sidewall 75 with a surrounding sidewall outer surface 80 and an opposing surrounding sidewall inner surface 85, the surrounding sidewall 75 having a first end portion 90 and an opposing second end portion 95. The first end portion 90 having a sealing cap portion 100 with a sealing cap inside surface 105 and an opposing sealing cap outside surface 110, and the second end portion 96 having an aperture interface 115, wherein the inner surface 85, the inside surface 105, and the aperture interface 115 define the reservoir interior volume 120 that is in fluid communication 125 with the aperture interface 115.

Further included in the fluid dispenser 50 is the applicator assembly 315 having a proximal end portion 320 and an opposing distal end portion 325, the applicator assembly includes the cavity 330 disposed within the applicator assembly 315, wherein the cavity 330 facilitates fluid communication 335 from the proximal end portion 320 to the distal end portion 325, the cavity 330 terminates in the proximal end portion 320 in a substantially fluid tight coupling 340 that is removably received by the aperture interface 115 to operationally accommodate fluid communication 345 from the reservoir interior 120 to the cavity 330. The distal end portion 325 has a partial disposing 355 of a plurality of bristle elements 350, such that the cavity 330 openly terminates in the distal end portion 325 at a discharge port 360 that is adjacent 365 to the plurality of bristle elements 350, wherein operationally the selected fluid 55 is manually moved 375 from the reservoir interior 120 via manually squeezing 370 the surrounding sidewall 75 with the selected fluid 55 moving into the aperture interface 115 and further into the cavity 330, and finally dispensing adjacent to the plurality of bristles 350, see FIG. 8 in particular.

Optionally on the fluid dispenser 50, it can further comprise a cover 380 that is disposed 385 around the distal end portion 325 in a removably engageable manner, wherein the cover 380 being disposed around the distal end portion 325 includes covering the plurality of bristle elements 350 and the discharge port 360 in a substantially fluid tight manner to operationally minimize exposure of the selected fluid 55 to an outside environment 390, see FIGS. 4, 5, and 6.

Referring to FIGS. 9 to 17, for the first alternative embodiment 51 of the fluid dispenser for manually applying the selected fluid 55 to a desired location, includes the first reservoir assembly 66 that is able to contain the selected fluid 55, the first reservoir 66 includes the flexible resilient body portion 70 constructed of a surrounding sidewall 75 with a surrounding sidewall outer surface 80 and an opposing surrounding sidewall inner surface 85, the surrounding sidewall 75 having the first end portion 90 and the opposing second end portion 95, the first end portion 90 having a sealing cap portion 100 with the sealing cap inside surface 105 and the opposing sealing cap outside surface 100, and the second end portion 95 having the aperture interface 115, wherein the inner surface 85, the inside surface 105, and the aperture interface 115 define the first reservoir interior volume 170 that is in fluid communication 125 with the aperture interface 115. The surrounding sidewall 75 is constructed of a bellows 130 that is defined by a plurality of angular segments 135 each having a pair of sides 140 that are of unequal length with the longer side 145 and the shorter side 150, the bellows 130 are oriented to retract 175 with the shorter side 150 of each pair 140 being folded back under 155 the longer side 145 resulting in the body retracting 175 between the first end portion 90 and the second end 95 portion with the body 130 maintaining its last selected retracted 160 or extended 165 position between the first end portion 90 and the second end portion 95 to create the selectable first reservoir interior volume 170 with manual compression 175 as between the first end portion 90 and the second end portion 95 or manual extension 180 between the first end portion 90 and the second end portion 95.

Continuing on the first alternative embodiment 51 of the fluid dispenser also included is the applicator assembly 315 having the proximal end portion 320 and the opposing distal end portion 325, the applicator assembly 315 includes a cavity 330 disposed within the applicator assembly 315, wherein the cavity 330 facilitates fluid communication 335 from the proximal end portion 320 to the distal end portion 325, the cavity 330 terminates in the proximal end portion 320 in a substantially fluid tight coupling 340 that is removably received by the aperture interface 115 to operationally accommodate fluid communication 345 from the first reservoir interior 120 to the cavity 330. The distal end portion 325 has a partial disposing 355 of a plurality of bristle elements 350, such that the cavity 330 openly terminates in the distal end portion 325 at the discharge port 360 that is adjacent 365 to the plurality of bristle elements 350. Wherein operationally the selected fluid 55 is manually moved from the selectable first reservoir interior volume 120 via manually compressing 186 the surrounding sidewall 130 between the first end portion 90 and the second end portion 95 with the selected fluid 55 moving into the aperture interface 115 and further into the cavity 330, and finally dispensing 375 the selected fluid 55 adjacent to the plurality of bristles 350.

Referring to FIGS. 18 to 25, for the second alternative embodiment 52 of the fluid dispenser for manually applying a selected fluid 55 to a desired location, the second alternative embodiment 52 of the fluid dispenser includes the second reservoir assembly 67 that is able to contain the selected fluid 55, the second reservoir 67 includes the surrounding sidewall 75 with a surrounding sidewall outer surface 80 and the opposing surrounding sidewall inner surface 85, the surrounding sidewall 75 is about the longitudinal axis 185. The surrounding sidewall 75 having a first end portion 90 and the opposing second end portion 95 with the longitudinal axis 185 spanning therebetween, the surrounding sidewall 75 first end portion 90 and the second end portion 95 defining the reservoir length 190, the first end portion 90 having a scaling cap portion 100 with the sealing cap inside surface 105 and the opposing sealing cap outside surface 110, and the second end portion 95 having the aperture interface 115, wherein the inner surface 85, the inside surface 105, and the aperture interface 115 define the reservoir interior volume 120 that is in fluid communication 125 with the aperture interface 115.

Further included in the second alternative embodiment 52 is the element 195 having an outer periphery 200, wherein the outer periphery 200 is slidably engaged 205 to the surrounding sidewall 75 inner surface 85 such that the element 195 having movement 210 along the longitudinal axis 185 within the sidewall interior 120, the element 195 having a reservoir interior side 215 and the opposing non-reservoir interior side 220, the inner surface 85, the inside surface 105, the aperture interface 115, and the reservoir interior side 215 define a variable second reservoir interior volume 225 that is in fluid communication 125 with the aperture interface 115.

Also included in the second alternative embodiment 52 is the first threaded cylinder 230 with threads 240 disposed on an outside diameter 235, wherein the first threaded cylinder 230 is about the longitudinal axis 185, the first threaded cylinder 230 having a first threaded cylinder proximal portion 245 and an opposing first threaded cylinder distal portion 250 with the longitudinal axis 185 spanning therebetween, the first threaded cylinder 230 proximal end portion 245 being affixed 255 to the non-reservoir interior side 220, the first threaded cylinder 230 having a first threaded cylinder length 260 as between the first threaded cylinder 230 proximal end portion 245 and the first threaded cylinder distal end portion 250, wherein the first threaded cylinder length 260 is less than the second reservoir length 190.

Additionally included in the second alternative embodiment 52 is the second threaded cylinder 265 with threads 275 disposed on an inside diameter 270, wherein the second threaded cylinder 230 is about the longitudinal axis 185, wherein the second threaded cylinder threads 275 are threadably engaged to the first threaded cylinder threads 240, the second threaded cylinder 265 having a second threaded cylinder proximal end portion 285 and an opposing second threaded cylinder distal end portion 290 with the longitudinal axis 185 spanning therebetween. The second threaded cylinder distal end portion 290 being rotatably engaged 295 to the surrounding sidewall first end portion 90 therethrough the sealing cap portion 100 such that the second threaded cylinder 265 rotates within the surrounding sidewall 75, however, not allowing movement 300 along the longitudinal axis 185, the second threaded cylinder 265 having a second threaded cylinder length 296 as between the second threaded cylinder proximal end portion 285 and the second threaded cylinder distal end portion 290, wherein the second threaded cylinder length 296 substantially equals the first threaded cylinder length 260, the second threaded cylinder distal end portion 290 projects therethrough 310 the sealing cap portion 100 to be manually rotated 305.

Further included in the second alternative embodiment 52 is the applicator assembly 315 having a proximal end portion 320 and an opposing distal end portion 325, the applicator assembly 315 includes the cavity 330 disposed within the applicator assembly 315, wherein the cavity 330 facilitates fluid communication 335 from the proximal end portion 320 to the distal end portion 325, the cavity 330 terminates in the proximal end portion 320 in a substantially fluid tight coupling 340 that is removably received by the aperture interface 115 to operationally accommodate fluid communication 345 from the reservoir interior 120 to the cavity 330, the distal end portion 325 has a partial disposing 355 of a plurality of bristle elements 350, such that the cavity 330 openly terminates 360 in the distal end portion 325 at the discharge port 360 that is adjacent to the plurality of bristle elements 350. Wherein operationally the selected fluid 55 is manually moved 375 from the variable reservoir interior 120 to the interface aperture 115 and further to the cavity 330 via the manually rotating 305 the second threaded cylinder distal end 290 about the longitudinal axis 185 to advance the first threaded cylinder 230 and the element 195 toward the aperture interface 115, and finally dispensing the selected fluid 55 adjacent to the plurality of bristles 350.

Broadly in referring to FIGS. 26 to 43 for the third alternative embodiment 53 of the fluid dispenser for manually applying a selected fluid 55 to a desired location, includes a third surrounding sidewall 520 that is about a longitudinal axis 185, the third surrounding sidewall 520 also includes a third surrounding sidewall outside surface 525 and an opposing third surrounding sidewall inside surface 530, the third surrounding sidewall further includes a helical wrap channel 535 that is in a continuous open channel being in a continuous spiral that is disposed on the third surrounding sidewall inside surface 530. The helical wrap channel 535 is rotationally about and axially along the longitudinal axis 185, further included is a symmetrically opposed like helical wrap channel 535 such that the two helical wrap channels 535 are symmetrically opposed rotationally about and axially along the longitudinal axis 185 positionally facing one another with each helical wrap channel 535 being positioned opposite of one another rotationally about the longitudinal axis 185 on the third surrounding sidewall inside surface 530, see in particular FIGS. 26 to 28, also FIGS. 30, 33, 34, and 35.

Further included in the third alternative embodiment 53 of the fluid dispenser is a sleeve 540 that is about the lengthwise axis 545, the sleeve including an outer surface 550 and an opposing inner surface 555, further the sleeve includes a sleeve proximal end portion 560 and a sleeve distal end portion 565, the sleeve also includes a lengthwise slot 570 despised therethrough the sleeve 540, the slot 570 is positioned parallel to the lengthwise axis 545 from the sleeve proximal end portion 560 to the sleeve distal end portion 565, wherein an additional like sleeve slot 570 is positioned opposite of the lengthwise axis 570 in a symmetric manner, wherein the sleeve lengthwise axis 545 is positioned coincident 575 to the longitudinal axis 185, see FIGS. 26 to 29, also FIGS. 30, 33, 34, and 35.

Further included in the third alternative embodiment 53 of the fluid dispenser is a rotational manual grasping extension 580 that is affixed on the sleeve proximal end portion 560, wherein operationally manual rotation 581 of the sleeve 540 and the manual grasping extension 580 results in the sleeve 540 and the manual grasping extension 580 being in rotational lockstep 581 about the longitudinal 185 and the lengthwise 575 axes, with the sleeve outer surface 550 being slidably rotationally adjacent 585 to the third surrounding sidewall 520 inside surface 530, see FIGS. 26, 27, 29, 33, 34, and 35.

Additionally included in the third alternative embodiment 53 of the fluid dispenser is a disc 590 having an outer periphery 595 with a first surface 600 and an opposing second surface 605, further the disc 590 including a protrusion 610 that is disposed on the disc outer periphery 595 with a like protrusion 610 that is oppositely disposed on the disc outer periphery 595, the disc outer periphery 595 has an axial slidable engagement 615 to the sleeve inner surface 555, and the disc protrusions 610 each have an axial slidable engagement 620 to each of the sleeve slots 570, wherein each of the disc protrusions 610 extend beyond 625 each of the sleeve slots 570 such that each of the disc protrusions 610 are slidably engaged 630 to each of the helical wrap channels 535. Wherein operationally manual rotation 581 of the rotational manual grasping extension 580 about the longitudinal 185 and lengthwise 575 axes results in the disc 590 having axial movement along the lengthwise 575 and longitudinal 185 axes with rotation of the disc 590 about the lengthwise 575 and longitudinal 185 axes, wherein the disc first 600 and second 605 surfaces remain in perpendicular position to the longitudinal 185 and lengthwise 575 axes during the disc 590 axial movement, see FIGS. 26, 27, 28, 29, 30, 34, and 35.

Also included in the third alternative embodiment 53 of the fluid dispenser is an insert cartridge 500 that is able to contain the selected fluid 55, the insert cartridge 500 includes a flexible resilient body portion constructed of a collapsible accordion type surrounding sidewall 510 that is about the longwise axis 506 with a collapsible accordion type surrounding sidewall outer surface 501 and an opposing collapsible accordion type surrounding sidewall inner surface 502, the surrounding sidewall 510 having a base 511 and an opposing nozzle tip 512, the base 511 having a base inner surface 516 and a base outer surface 514. The nozzle tip 512 having a pressure openable film seal 513, thee nozzle tip 512 includes an axial fit interference interface 521 that is oriented substantially perpendicular to the longwise axis 506, the interference interface transitions inward to a nozzle tip inner surface 522 and then transitioning to an adjacent sharp radius 519 that then transitions outward to a nozzle tip outer surface 517 and finally transitioning inward to an adjacent gradual radius 518 terminating at the collapsible accordion type surrounding sidewall inner surface 530. Wherein the collapsible accordion type surrounding sidewall inner surface 530, the base inner surface 516, and the nozzle tip 512 with the pressure openable film seal 513 all define a selectable interior volume 505 of the insert cartridge 500, wherein the insert cartridge interior volume 505 is filled with the selected fluid 55, the collapsible accordion type surrounding sidewall 510 is constructed of a bellows 130 that is defined by a plurality of angular segments 135 each having a pair of sides 140 that are of unequal length with a longer side 145 and an adjacent shorter side 150, the bellows are oriented to retract 155 with the shorter side 150 of each pair being folded back 155 under the longer side 145 resulting in the body retracting 160 between the base 511 and the nozzle tip 512 with the body maintaining its last selected retracted 160 or extended 165 position between the base 511 and the nozzle tip 512 to create a selectable first cartridge interior volume 505 with manual compression 160 along the longwise axis 506 from the rotational manual grasping extension 580 as between the base 511 and the nozzle tip 512, see in particular FIGS. 16 and 17, plus FIGS. 13, 32, 33, 34, and 36 to 43.

Additionally included in the third alternative embodiment 53 of the fluid dispenser is an applicator assembly 315 having a proximal end portion 320 and an opposing distal end portion 325 with an extension axis 326 spanning therebetween, the applicator assembly 315 includes a cavity 330 disposed within the applicator assembly 315, wherein the cavity 330 facilitates fluid communication 335 from the proximal end portion 320 to the distal end portion 325, the cavity 330 terminates in the proximal end portion 320 in a substantially fluid tight coupling 340 that is removably received by the nozzle tip 512 to operationally accommodate fluid communication 375 from the cartridge interior volume 505 to the cavity 330. The distal end portion 325 has a partial disposing 355 of a plurality of bristle elements 350, such that the cavity 330 openly terminates in the distal end portion 325 at a discharge port 360 that is adjacent to the plurality of bristle elements 350, wherein the substantially fluid tight coupling 340 includes an axial fit interference interface 344, an inner surface 343, an inner ridge 342 of an annulus, and an elastically deformable construction of the annulus 341, the substantially fluid tight coupling 340 has an axial snap fit to the deformable nozzle tip 512 along the longwise axis 506 and the extension axis 326. Wherein the axial fit interference interfaces 344/521 of the substantially fluid tight coupling 340 and the deformable nozzle tip 512 are in contact, the inner surfaces 343/522 of the substantially fluid tight coupling 340 and the deformable nozzle tip 512 are in contact, the adjacent sharp radius 519 and the inner ridge 342 of the annulus 341 are in contact, and the adjacent gradual radius 518 and the elastically deformable annulus 341 are in contact all to form the substantially fluid tight coupling 340 having an axial snap fit to the deformable nozzle tip 512. Wherein the axial snap fit has a lower closing force than a higher axial opening force due to the sharp radius 519 and the inner ridge 342 having a more blunt interface than the gradual radius 518 and the inner ridge 342, wherein the axial snap fit has a low separating force 635 perpendicular to the longwise axis 506 and the extension axis 326 via manually applying a bending moment between the substantially fluid tight coupling 340 and the deformable nozzle tip 512 as a force 635 perpendicular to the longwise axis 506 and the extension axis 326, to operationally separate the substantially fluid tight coupling 340 and the nozzle tip 512, for the purpose of replacing the insert cartridge 500 that is empty of the selected fluid 55 with a replacement insert cartridge 500 that is filled with the selected fluid 55. Wherein operationally the selected fluid 55 is manually moved from the selectable first cartridge interior volume 505 to the nozzle tip 512 and further to the substantially fluid tight coupling 340 to the cavity 330 via manually rotating 581 the rotational manual grasping extension 580 about the longitudinal 185 and the lengthwise 545 axes for the disc 590 to have axial movement along the lengthwise 545 and longitudinal 185 axes resulting in the body retracting 160 between the base 511 and the nozzle tip 512 to ultimately dispense 375 the selected fluid 55 adjacent to the plurality of bristles 350, see FIGS. 26, 27, 33, 34, and 36 to 43.

Optionally for the third alternative embodiment 53 of the fluid dispenser, it can further comprise a cover 380 that is disposed around 385 the applicator assembly 315 distal end portion 325 in a removably engageable manner 385, wherein the cover 380 being disposed around the applicator assembly 315 distal end portion 325 includes covering the plurality of bristle elements 350 and the discharge port 360 in a substantially fluid tight manner to operationally minimize exposure of the selected fluid 55 to an outside environment 390, see FIGS. 20, 21, and 22.

50 Fluid dispenser
51 First alternative embodiment of the fluid dispenser 50
52 Second alternative embodiment of the fluid dispenser 50
53 Third alternative embodiment of the fluid dispenser 50
55 Selected fluid that can be a liquid, gel, or paste, or any suitable equivalent
56 User 57 Fingers of the user 56
60 Desired location of the selected fluid
65 Reservoir assembly
66 First reservoir assembly
67 Second reservoir assembly
70 Flexible resilient body
75 Surrounding sidewall
80 Outer surface of the surrounding sidewall 75

85 Inner surface of the surrounding sidewall 75
86 Key disposed on the inner surface 85 being positioned parallel to the longitudinal axis 185
90 First end portion of the surrounding sidewall 75
95 Second end portion of the surrounding sidewall 75
100 Sealing cap portion
105 Inside surface of the sealing cap portion 100
110 Outside surface of the sealing cap portion 100
115 Aperture interface of the second end portion 95
120 Reservoir interior volume
125 Fluid communication between the reservoir interior volume 120, the selectable reservoir interior volume 170, or the variable reservoir interior volume 225, and the aperture interface 115
130 Snap bellows of the of the surrounding sidewall 75
135 Plurality of angular segments of the snap bellows 130
140 Pair of sides that are of unequal length of the snap bellows 130
145 Longer side of the snap bellows 130
150 Shorter side of the snap bellows 130
151 Small snap bellows 130 angle
152 Large snap bellows 130 angle
155 Fold back snap under of the shorter side 150 under the longer side 145
160 Manual body retracting compression state of the flexible resilient body 70 creating the fold back snap 155 as shown by the first reservoir 66 length 190 reducing
165 Body extending state of the flexible resilient body 70 undoing the fold back snap 155 as shown by the first reservoir 66 length 190 increasing
170 Selectable first reservoir interior volume
175 Manual retraction compression state of the bellows 130 to reduce the selectable reservoir interior volume 170 for fluid movement 375
180 Manual extension state of the bellows 130
185 Longitudinal axis of the surrounding sidewall 75 or the third surrounding sidewall 520
186 Manual compression state of the user 56 fingers 57 upon the surrounding sidewall 75
187 Uncompressed state of the surrounding sidewall 75
190 Reservoir length including the reservoir 65, or first reservoir 66, or second reservoir 67, lengths between the first 90 and second 95 end portions of the surrounding sidewall 75
195 Element
200 Outer periphery of the element 195
201 Key slot in the outer periphery 200 being positioned parallel to the longitudinal axis 185
202 Key 86 being slidably received into the key slot 201 for movement along the longitudinal axis 185 to prevent rotation of the element 195 about the longitudinal axis 185
205 Slidable engagement of the outer periphery 200 to the inner surface 85 of the surrounding sidewall 75
210 Movement of the element 195 along the longitudinal axis 185
215 Reservoir interior volume 120 side of the element 195
220 Non reservoir interior side of the element 195
225 Variable second reservoir interior volume
230 First threaded cylinder
235 Outside diameter of the first threaded cylinder 230
240 Threads disposed on the outside diameter 235
245 Proximal end portion of the first threaded cylinder 230
250 Distal end portion of the first threaded cylinder 230
255 Affixed nature of the proximal end portion 245 to the non reservoir interior side 220 of the element 195
260 Length of the first threaded cylinder 230 as between the proximal end portion
245 and the distal end portion 250
265 Second threaded cylinder
270 Inside diameter of the second threaded cylinder 265
275 Threads disposed on the inside diameter 270
280 Threadable engagement of the first 230 and second 265 threaded cylinders via the threads 240 and the threads 275 respectively to one another
285 Proximal end portion of the second threaded cylinder 265
290 Distal end portion of the second threaded cylinder 265
295 Rotatable engagement of the distal end portion 290 to the first end portion 90 of the surrounding sidewall 75 therethrough the sealing cap portion 100
296 Length of the second threaded cylinder 265 as between the proximal end portion 285 and the distal end portion 290
297 Extended state of the first threaded cylinder 230 and the second threaded cylinder 265
298 Retracted state of the first threaded cylinder 230 and the second threaded cylinder 265
299 Turn knob extension of the distal end portion 290 of the second threaded cylinder 265
300 Not allowing movement along the longitudinal axis 185 of the second threaded cylinder 265 in conjunction with the rotatable engagement 295
305 Manual rotation of the second threaded cylinder 265 about the longitudinal axis 185 to reduce the variable reservoir interior volume 225 for selected fluid 55 movement 375 via moving the element 195 toward the aperture interface 115
310 Projection therethrough of the second threaded cylinder 265 distal end portion 290 out of the cap portion 100 opposite of the element 195 to facilitate the manual rotation 305 of the second threaded cylinder 265 about the longitudinal axis 185 via the turn knob 315 Applicator assembly
320 Proximal end portion of the applicator assembly 315
325 Distal end portion of the applicator assembly 315
326 Extension axis of the applicator assembly 315
330 Cavity of the applicator assembly 315
335 Fluid communication from the proximal end portion 320 to the distal end portion 325
340 Fluid tight coupling in the proximal end portion 320
341 Elastically deformable annulus of the fluid tight coupling 340
342 Inner ridge of the annulus of the fluid tight coupling 340
343 Inner surface of the fluid tight coupling 340
344 Axial fit interference interface of the fluid tight coupling 340
345 Fluid communication from the reservoir interior volume 120 to the cavity 330
350 Plurality of bristle elements
355 Partial disposing of the plurality of bristle elements 350 on the distal end portion 325
360 Discharge port of the cavity 330 termination
365 Adjacent nature of the discharge port 360 to the plurality of bristle elements 350
370 Manually squeezing the surrounding sidewall 75 being laterally and perpendicular to the longitudinal axis 185

375 The selected fluid 55 moving from the reservoir interior volume 120 or selectable reservoir interior volume 170 or variable reservoir interior volume 225 or the cartridge 500 interior volume 505 to the aperture interface 115 through the fluid tight coupling 340 to the cavity 330 and finally to the discharge port 360

380 Cover that applies to the following embodiments of the fluid dispenser; fluid dispenser 50, the first alternative embodiment 51 of the fluid dispenser 50, the second alternative embodiment 52 of the fluid dispenser 50, and the third alternative embodiment 53 of the fluid dispenser 50

385 Disposing of the cover 380 around a portion of the distal end portion 325 in a removably engageable manner that is substantially fluid tight about the plurality of bristle elements 350 and discharge port 360

390 Outside environment

500 Insert cartridge

501 Outer surface of the surrounding sidewall 510

502 Inner surface of the surrounding sidewall 510

505 Interior volume of the insert cartridge 500 that can be the selectable first cartridge interior volume

506 Longwise axis of the insert cartridge 500

510 Collapsible accordion type surrounding sidewall of the cartridge 500

511 Base of the cartridge surrounding sidewall 510

512 Deformable nozzle tip of the cartridge surrounding sidewall 510

513 Pressure openable film seal

514 Base 511 outer surface

515 Movement of the collapsible accordion type surrounding sidewall 510 of the cartridge 500

516 Base 511 inner surface

517 Outer surface of the deformable nozzle tip 512

518 Adjacent gradual radius on the deformable nozzle tip 512

519 Adjacent sharp radius of the deformable nozzle tip 512

520 Third surrounding sidewall of the third alternative embodiment 53 of the fluid dispenser 50

521 Axial fit interference interface of the deformable nozzle tip 512

522 Inner surface of the deformable nozzle tip 512

525 Outside surface of the third surrounding sidewall 520

530 Inside surface of the third surrounding sidewall 520

535 Helical wrap channel in a continuous spiral being disposed on the inside surface

530 that also includes an opposing helical wrap channel 535 in a continuous spiral being disposed on the inside surface 530 such that the two opposing helical wrap channels 535 are symmetrically opposed about the longitudinal axis 185 to face one another being positioned opposite of the longitudinal axis 185 540 Sleeve

545 Lengthwise axis of the sleeve 540

550 Outer surface of the sleeve 540

555 Inner surface on the sleeve 540

560 Sleeve proximal end portion

565 Sleeve distal end portion

570 Lengthwise slot disposed therethrough the sleeve 540, wherein the slot is positioned parallel to the lengthwise axis 545 from the sleeve proximal portion 560 to the sleeve distal portion 565, wherein an additional slot 570 is positioned opposite of the lengthwise axis 545

575 Sleeve lengthwise axis 545 positioned coincident to the longitudinal axis 185

580 Rotational manual grasping extension of the sleeve proximal portion 560

581 Manual rotation of the sleeve 540 and grasping extension 580 in lockstep about the longitudinal 185 and lengthwise axes 575 that results in disc 590 movement along the lengthwise axis 545

585 Sleeve outer surface 550 slidably rotationally adjacent to the inside surface 530 of the third surrounding sidewall 520

590 Disc

595 Outer periphery of the disc 590

600 First surface of the disc 590

605 Second surface of the disc 590

610 Protrusion of the disc 590 disposed on the disc outer periphery 590 with another protrusion 610 oppositely disposed on the disc outer periphery 590

615 Axial slidable engagement of the disc 590 outer periphery 595 to the sleeve

540 inner surface 555

620 Axial slidable engagement of the disc 590 protrusion 610 to the sleeve 540 slot

625 The protrusion 610 extending beyond the sleeve 540 slot 570

630 The protrusion 610 extending 625 being slidably engaged in the helical wrap channel 535

635 Low separating resistance force direction that is positioned substantially transverse to the extension axis 326 and the longwise axis 506

Accordingly, the present invention of the fluid dispenser plus including the first, second, and third alternative embodiments has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. A first alternative embodiment of the fluid dispenser for manually applying a selected fluid to a desired location, comprising:

a. a first reservoir assembly that is able to contain the selected fluid, said first reservoir includes a flexible resilient body portion constructed of a surrounding sidewall with a surrounding sidewall outer surface and an opposing surrounding sidewall inner surface, said surrounding sidewall having a first end portion and an opposing second end portion, said first end portion having a sealing cap portion with a sealing cap inside surface and an opposing sealing cap outside surface, and said second end portion having an aperture interface, wherein said inner surface, said inside surface, and said aperture interface define a first reservoir interior that is in fluid communication with said aperture interface, said surrounding sidewall is constructed of a bellows that is defined by a plurality of angular segments each having a pair of sides that are of unequal length with a longer side and a shorter side, said bellows are oriented to retract with said shorter side of each said pair being folded back under said longer side resulting in said body retracting between said first end portion and said second end portion with said body maintaining its last selected retracted or extended position between said first end portion and said second end portion to create a selectable first reservoir interior volume with manual compression as between said first end portion and said second end portion or manual extension between said first end portion and said second end portion; and b. an applicator assembly having a proximal end portion and an opposing distal end portion, said applicator assembly includes a cavity disposed within said applicator assembly, wherein said cavity facilitates fluid communication from said proximal end portion to said distal end portion, said cavity terminates in said proximal end portion in a substantially fluid tight coupling that is removably received by said aperture interface to operationally accommodate fluid communication from said first reservoir interior to said cavity, said distal end portion has a partial disposing of a plurality of bristle elements, such that said cavity openly terminates in said distal end portion at a discharge port that is adjacent to said plurality of bristle elements, wherein operationally the selected fluid is manually moved from said selectable first reservoir interior volume via manually compressing said surrounding sidewall between said first end portion and said second end portion with the selected fluid moving into said aperture interface and further into said cavity, and finally dispensing the selected fluid adjacent to said plurality of bristles.

2. A first alternative embodiment of the fluid dispenser according to claim 1 further comprising a cover that is disposed around said applicator assembly distal end portion in a removably engageable manner, wherein said cover being disposed around said applicator assembly distal end portion includes covering said plurality of bristle elements and said discharge port in a substantially fluid tight manner to operationally minimize exposure of the selected fluid to an outside environment.

3. A second alternative embodiment of the fluid dispenser for manually applying a selected fluid to a desired location, comprising:

a. a second reservoir assembly that is able to contain the selected fluid, said second reservoir includes a surrounding sidewall with a surrounding sidewall outer surface and an opposing surrounding sidewall inner surface, said surrounding sidewall is about a longitudinal axis, said surrounding sidewall having a first end portion and an opposing second end portion with said longitudinal axis spanning therebetween, said surrounding sidewall first end portion and said second end portion defining a reservoir length, said first end portion having a sealing cap portion with a sealing cap inside surface and an opposing sealing cap outside surface, and said second end portion having an aperture interface, wherein said inner surface, said inside surface, and said aperture interface define a reservoir interior volume that is in fluid communication with said aperture interface;

b. an element having an outer periphery, wherein said outer periphery is slidably engaged to said surrounding sidewall inner surface such that said element having movement along said longitudinal axis within said sidewall interior, said element having a reservoir interior side and an opposing non-reservoir interior side, said inner surface, said inside surface, said aperture interface, and said reservoir interior side define a variable second reservoir interior volume that is in fluid communication with said aperture interface;

c. a first threaded cylinder with threads disposed on an outside diameter, wherein said first threaded cylinder is about said longitudinal axis, said first threaded cylinder having a first threaded cylinder proximal portion and an opposing first threaded cylinder distal portion with said longitudinal axis spanning therebetween, said first threaded cylinder proximal end portion being affixed to said non-reservoir interior side, said first threaded cylinder having a first threaded cylinder length as between said first threaded cylinder proximal end portion and said first threaded cylinder distal end portion, wherein said first threaded cylinder length is less than said second reservoir length;

d. a second threaded cylinder with threads disposed on an inside diameter, wherein said first threaded cylinder is about said longitudinal axis, wherein said second threaded cylinder threads are threadably engaged to said first threaded cylinder threads, said second threaded cylinder having a second threaded cylinder proximal end portion and an opposing second threaded cylinder distal end portion with said longitudinal axis spanning therebetween, said second threaded cylinder distal end portion being rotatably engaged to said surrounding sidewall first end portion therethrough said sealing cap portion such that said second threaded cylinder rotates within said surrounding sidewall, however, not allowing movement along said longitudinal axis, said second threaded cylinder having a second threaded cylinder length as between said second threaded cylinder proximal end portion and said second threaded cylinder distal end portion, wherein said second threaded cylinder length substantially equals said first threaded cylinder length, said second threaded cylinder distal end portion projects therethrough said sealing cap portion to be manually rotated; and e. an applicator assembly having a proximal end portion and an opposing distal end portion, said applicator assembly includes a cavity disposed within said applicator assembly, wherein said cavity facilitates fluid communication from said proximal end portion to said distal end portion, said cavity terminates in said proximal end portion in a substantially fluid tight coupling that is removably received by said aperture interface to operationally accommodate fluid communication from said reservoir interior to said cavity, said distal end portion has a partial disposing of a plurality of bristle elements, such that said cavity openly terminates in said distal end portion at a discharge port that is adjacent to said plurality of bristle elements, wherein operationally the selected fluid is manually moved from said variable reservoir interior to said interface aperture and further to said cavity via said manually rotating said second threaded cylinder distal end about said longitudinal axis to advance said first threaded cylinder and said element toward said aperture interface, and finally dispensing the selected fluid adjacent to said plurality of bristles.

4. A second alternative embodiment of the fluid dispenser according to claim 3 further comprising a cover that is disposed around said applicator assembly distal end portion in a removably engageable manner, wherein said cover being disposed around said applicator assembly distal end portion includes covering said plurality of bristle elements and said discharge port in a substantially fluid tight manner to operationally minimize exposure of the selected fluid to an outside environment.

5. A third alternative embodiment of the fluid dispenser for manually applying a selected fluid to a desired location, comprising:

a. a third surrounding sidewall that is about a longitudinal axis, said third surrounding sidewall also includes a third surrounding sidewall outside surface and an opposing third surrounding sidewall inside surface, said third surrounding sidewall further includes a helical wrap channel that is in a continuous open channel being in a continuous spiral that is disposed on said third surrounding sidewall inside surface, said helical wrap channel is rotationally about and axially along said longitudinal axis, further included is a symmetrically opposed like helical wrap channel such that said two helical wrap channels are symmetrically opposed rotationally about and axially along said longitudinal axis positionally facing one another with each said helical wrap channel being positioned opposite of one another rotationally about said longitudinal axis on said third surrounding sidewall inside surface;

b. a sleeve that is about a lengthwise axis, said sleeve including an outer surface and an opposing inner surface, further said sleeve includes a sleeve proximal end portion and a sleeve distal end portion, said sleeve also includes a lengthwise slot despised therethrough said sleeve, said slot is positioned parallel to said lengthwise axis from said sleeve proximal end portion to said sleeve distal end portion, wherein an additional like sleeve slot is positioned opposite of said lengthwise axis in a symmetric manner, wherein said sleeve lengthwise axis is positioned coincident to said longitudinal axis;

c. a rotational manual grasping extension that is affixed on said sleeve proximal end portion, wherein operationally manual rotation of said sleeve and said manual grasping extension results in said sleeve and said manual grasping extension being in rotational lockstep about said longitudinal and said lengthwise axes, with said sleeve outer surface being slidably rotationally adjacent to said third surrounding sidewall inside surface;

d. a disc having an outer periphery with a first surface and an opposing second surface, further said disc including a protrusion that is disposed on said disc outer periphery with a like protrusion that is oppositely disposed on said disc outer periphery, said disc outer periphery has an axial slidable engagement to said sleeve inner surface, and said disc protrusions each have an axial slidable engagement to each of said sleeve slots, wherein each of said disc protrusions extend beyond each of said sleeve slots such that each of said disc protrusions are slidably engaged to each of said helical wrap channels, wherein operationally manual rotation of said rotational manual grasping extension about said longitudinal and lengthwise axes results in said disc having axial movement along said lengthwise and longitudinal axes with rotation of said disc about said lengthwise and longitudinal axes, wherein said disc first and second surfaces remain in perpendicular position to said longitudinal and lengthwise axes during said disc axial movement;

e. an insert cartridge that is able to contain the selected fluid, said insert cartridge includes a flexible resilient body portion constructed of a collapsible accordion type surrounding sidewall that is about a longwise axis with a collapsible accordion type surrounding sidewall outer surface and an opposing collapsible accordion type surrounding sidewall inner surface, said surrounding sidewall having a base and an opposing nozzle tip, said base having a base inner surface and a base outer surface, said nozzle tip having a pressure openable film seal, said nozzle tip includes an axial fit interference interface that is oriented substantially perpendicular to said longwise axis, said interference interface transitions inward to a nozzle tip inner surface and then transitioning to an adjacent sharp radius that then transitions outward to a nozzle tip outer surface and finally transitioning inward to an adjacent gradual radius terminating at said collapsible accordion type surrounding sidewall inner surface, wherein said collapsible accordion type surrounding sidewall inner surface, said base inner surface, and said nozzle tip with said pressure openable film seal all define a selectable interior volume of said insert cartridge, wherein said insert cartridge interior volume is filled with the selected fluid, said collapsible accordion type surrounding sidewall is constructed of a bellows that is defined by a plurality of angular segments each having a pair of sides that are of unequal length with a longer side and an adjacent shorter side, said bellows are oriented to retract with said shorter side of each said pair being folded back under said longer side resulting in said body retracting between said base and said nozzle tip with said body maintaining its last selected retracted or extended position between said base and said nozzle tip to create a selectable first cartridge interior volume with manual compression along said longwise axis from said rotational manual grasping extension as between said base and said nozzle tip; and f. an applicator assembly having a proximal end portion and an opposing distal end portion with an extension axis spanning therebetween, said applicator assembly includes a cavity disposed within said applicator assembly, wherein said cavity facilitates fluid communication from said proximal end portion to said distal end portion, said cavity terminates in said proximal end portion in a substantially fluid tight coupling that is removably received by said nozzle tip to operationally accommodate fluid communication from said cartridge interior volume to said cavity, said distal end portion has a partial disposing of a plurality of bristle elements, such that said cavity openly terminates in said distal end portion at a discharge port that is adjacent to said plurality of bristle elements, wherein said substantially fluid tight coupling includes an axial fit interference interface, an inner surface, an inner ridge of an annulus, and an elastically deformable construction of said annulus, said substantially fluid tight coupling has an axial snap fit to said deformable nozzle tip along said longwise axis and said extension axis, wherein said axial fit interference interfaces of said substantially fluid tight coupling and said deformable nozzle tip are in contact, said inner surfaces of said substantially fluid tight coupling and said deformable nozzle tip are in contact, said adjacent sharp radius and said inner ridge of said annulus are in contact, and said adjacent gradual radius and said elastically deformable annulus are in contact all to form said substantially fluid tight coupling having an axial snap fit to said deformable nozzle tip, wherein said axial snap fit has a lower closing force than a higher axial opening force due to said sharp radius and said inner ridge having a more blunt interface than said gradual radius and said inner ridge, wherein said axial snap fit has a low separating force perpendicular to said longwise axis and said extension axis via manually applying a bending moment between said substantially fluid tight coupling and said deformable nozzle tip as a force perpendicular to said longwise axis and said extension axis, to operationally separate said substantially fluid tight coupling and said nozzle tip, for a purpose of replacing said insert cartridge that is empty of the selected fluid with a replacement insert cartridge that is filled with the selected fluid, wherein operationally the selected fluid is manually moved from said selectable first cartridge interior volume to said nozzle tip and further to said substantially fluid tight coupling to said cavity via said manually rotating said rotational manual grasping extension about said longitudinal and said lengthwise axes for said disc to have axial movement along said lengthwise and longitudinal axes resulting in said body retracting between said base and said nozzle tip to ultimately dispense the selected fluid adjacent to said plurality of bristles.

6. A third alternative embodiment of the fluid dispenser according to claim 5 further comprising a cover that is disposed around said applicator assembly distal end portion in a removably engageable manner, wherein said cover being disposed around said applicator assembly distal end portion includes covering said plurality of bristle elements and said discharge port in a substantially fluid tight manner to operationally minimize exposure of the selected fluid to an outside environment.

* * * * *